US009609902B2

(12) United States Patent
Waters

(10) Patent No.: US 9,609,902 B2
(45) **Date of Patent: *Apr. 4, 2017**

(54) HEADGEAR HAVING A CAMERA DEVICE

(71) Applicant: Michael Waters, Aspen, CO (US)

(72) Inventor: Michael Waters, Aspen, CO (US)

( * ) Notice: Subject to any disclaimer, the term of this patent is extended or adjusted under 35 U.S.C. 154(b) by 475 days.

This patent is subject to a terminal disclaimer.

(21) Appl. No.: 14/213,954

(22) Filed: Mar. 14, 2014

(65) Prior Publication Data

US 2014/0304891 A1 Oct. 16, 2014

Related U.S. Application Data

(63) Continuation-in-part of application No. PCT/US2012/071469, filed on Dec. 21, 2012.

(60) Provisional application No. 61/580,182, filed on Dec. 23, 2011, provisional application No. 61/801,838, filed on Mar. 15, 2013.

(51) Int. Cl.
*A42B 1/24* (2006.01)

(52) U.S. Cl.
CPC ..... *A42B 1/24* (2013.01); *A42B 1/244* (2013.01)

(58) Field of Classification Search
CPC ..... A24B 1/24; A24B 1/244
See application file for complete search history.

(56) References Cited

U.S. PATENT DOCUMENTS

| | | | |
|---|---|---|---|
| 645,984 | A | 3/1900 | Tournier |
| 909,742 | A | 1/1909 | Borchert |
| 1,098,628 | A | 6/1914 | Hyman |
| 1,109,415 | A | 9/1914 | Harris |
| 1,261,824 | A | 1/1918 | La Vine |
| 1,255,265 | A | 2/1918 | Zachara |
| 1,323,822 | A | 12/1919 | Bramming |
| D58,302 | S | 7/1921 | Bartholomew |
| 1,438,586 | A | 12/1922 | Eaton |
| 1,448,353 | A | 3/1923 | Barany |
| 1,475,653 | A | 11/1923 | Rosenberg |
| 1,572,210 | A | 2/1926 | Kolibas |
| 1,615,067 | A | 1/1927 | Boerman |
| 1,744,777 | A | 1/1930 | Lundgren |

(Continued)

FOREIGN PATENT DOCUMENTS

| | | |
|---|---|---|
| AU | 1178576 | 9/1977 |
| AU | 6310994 | 11/1994 |

(Continued)

OTHER PUBLICATIONS

'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).

(Continued)

*Primary Examiner* — David V Bruce
(74) *Attorney, Agent, or Firm* — Fitch, Even, Tabin & Flannery LLP

(57) ABSTRACT

Headgear is described herein having a camera device mounted to a brim thereof and accessories therefor. The camera device can include a viewfinder, such as a pivoting viewfinder or a viewfinder having a ball-and-socket mounting joint. The frame of reference of the camera device can be indicated to a wearer of the headgear with sighting members mounted to the brim.

21 Claims, 61 Drawing Sheets

(56) References Cited

U.S. PATENT DOCUMENTS

| | | | |
|---|---|---|---|
| 1,749,998 | A | 3/1930 | Collins |
| 1,879,512 | A | 9/1932 | Rotea |
| 1,883,756 | A | 10/1932 | Bloom |
| D114,980 | S | 1/1939 | Wengen |
| 2,196,543 | A | 4/1940 | Anderson |
| 2,373,553 | A | 10/1942 | Fetterman |
| D137,375 | S | 2/1944 | Heit |
| 2,369,829 | A | 2/1945 | Johnson |
| 2,461,254 | A | 2/1949 | Bassett |
| 2,473,394 | A | 6/1949 | Scott |
| 2,531,585 | A | 11/1950 | Pope |
| 2,540,435 | A | 2/1951 | Ferguson |
| 2,552,764 | A | 5/1951 | Bedford, Jr. |
| 2,567,046 | A | 9/1951 | Anderson |
| 2,591,112 | A | 4/1952 | Zwierzynski |
| 2,638,532 | A | 5/1953 | Brady |
| 2,640,980 | A | 6/1953 | Prupis |
| 2,705,751 | A | 4/1955 | Harris |
| 2,730,720 | A | 1/1956 | Saunders |
| 2,788,439 | A | 4/1957 | Hesse |
| 2,904,670 | A | 9/1959 | Calmes |
| 2,966,580 | A | 12/1960 | Taylor |
| 2,978,696 | A | 4/1961 | Keller |
| 3,008,040 | A | 11/1961 | Moore |
| 3,032,647 | A | 5/1962 | Wansky |
| 3,040,881 | A | 6/1962 | McNeill |
| 3,057,992 | A | 10/1962 | Baker |
| 3,060,308 | A | 10/1962 | Fortuna |
| 3,123,208 | A | 3/1964 | Barnum |
| 3,184,058 | A | 5/1965 | Crowther |
| 3,201,771 | A | 8/1965 | Proulx |
| D207,919 | S | 6/1967 | Fai |
| 3,350,552 | A | 10/1967 | Lawrence |
| 3,358,137 | A | 12/1967 | Sinclair |
| 3,447,164 | A | 6/1969 | Greenhouse |
| D215,751 | S | 10/1969 | Castellano |
| 3,491,374 | A | 1/1970 | Frangos |
| 3,535,282 | A | 10/1970 | Mallory |
| 3,537,909 | A | 11/1970 | Horton |
| 3,602,759 | A | 8/1971 | Evans |
| 3,634,676 | A | 1/1972 | Castellano |
| 3,647,059 | A | 3/1972 | Humphreys |
| 3,666,901 | A | 5/1972 | Weinhart |
| 3,683,168 | A | 8/1972 | Tatje |
| 3,749,902 | A | 7/1973 | Drew |
| 3,769,663 | A | 11/1973 | Perl |
| D229,975 | S | 1/1974 | Klugmann |
| 3,793,517 | A | 2/1974 | Carlini |
| 3,845,389 | A | 10/1974 | Phillips |
| 3,947,676 | A | 3/1976 | Battilana |
| 3,963,917 | A | 6/1976 | Romano |
| 4,005,776 | A | 2/1977 | Seeley |
| 4,011,600 | A | 3/1977 | Malk |
| 4,053,688 | A | 10/1977 | Perkins |
| 4,092,704 | A | 5/1978 | Malm |
| 4,176,932 | A | 12/1979 | Young |
| 4,186,429 | A | 1/1980 | Johnston |
| 4,210,952 | A | 7/1980 | Ressmeyer |
| 4,231,079 | A | 10/1980 | Heminover |
| 4,254,451 | A | 3/1981 | Cochran |
| 4,268,894 | A | 5/1981 | Bartunek |
| 4,270,227 | A | 6/1981 | Wolfe |
| 4,283,127 | A | 8/1981 | Rosenwinkel |
| 4,298,913 | A | 11/1981 | Lozar |
| 4,317,162 | A | 2/1982 | Richards et al. |
| 4,332,007 | A | 5/1982 | Gibstein |
| 4,364,107 | A | 12/1982 | Wieczorek |
| 4,392,183 | A | 7/1983 | Ostlund |
| 4,398,237 | A | 8/1983 | Doyel |
| 4,406,040 | A | 9/1983 | Cannone |
| 4,425,531 | A | 1/1984 | Holmes |
| D272,733 | S | 2/1984 | Cosmos |
| 4,430,532 | A | 2/1984 | Matsumoto |
| 4,442,478 | A | 4/1984 | Stansbury |
| 4,462,064 | A | 7/1984 | Schweitzer |
| 4,470,263 | A | 9/1984 | Lehovec |
| 4,483,021 | A | 11/1984 | McCall |
| 4,516,157 | A | 5/1985 | Campbell |
| 4,521,831 | A | 6/1985 | Thayer |
| 4,541,698 | A | 9/1985 | Lerner |
| 4,551,857 | A | 11/1985 | Galvin |
| 4,559,516 | A | 12/1985 | Schott |
| 4,570,206 | A | 2/1986 | Deutsch |
| 4,602,191 | A | 7/1986 | Davila |
| 4,604,760 | A | 8/1986 | Coin |
| 4,616,297 | A | 10/1986 | Liu |
| 4,631,644 | A | 12/1986 | Dannhauer |
| 4,638,410 | A | 1/1987 | Barker |
| 4,641,647 | A | 2/1987 | Behan |
| 4,642,817 | A | 2/1987 | Ferstenfeld |
| 4,665,568 | A | 5/1987 | Stutes |
| 4,667,274 | A | 5/1987 | Daniel |
| 4,669,610 | A | 6/1987 | Lindsey |
| 4,680,815 | A | 7/1987 | Hirsch |
| 4,774,643 | A | 9/1988 | McGinnis |
| 4,794,496 | A | 12/1988 | Lanes |
| 4,817,212 | A | 4/1989 | Benoit |
| 4,822,160 | A | 4/1989 | Tsai |
| 4,822,161 | A | 4/1989 | Jimmy |
| 4,827,384 | A | 5/1989 | VonSchlemmer |
| 4,829,285 | A | 5/1989 | Brand |
| 4,872,218 | A | 10/1989 | Holt |
| 4,875,147 | A | 10/1989 | Auer |
| 4,884,067 | A | 11/1989 | Nordholm |
| 4,901,210 | A | 2/1990 | Hanabusa |
| 4,901,211 | A | 2/1990 | Shen |
| 4,902,119 | A | 2/1990 | Porsche |
| 4,904,078 | A | 2/1990 | Gorike |
| 4,920,466 | A | 4/1990 | Liu |
| 4,945,458 | A | 7/1990 | Batts |
| 4,951,068 | A | 8/1990 | Ichikawa |
| 4,959,760 | A | 9/1990 | Wu |
| 4,963,045 | A | 10/1990 | Willcox |
| 4,991,068 | A | 2/1991 | Mickey |
| 4,998,187 | A | 3/1991 | Herrick |
| 5,003,640 | A | 4/1991 | Pizzacar |
| D316,932 | S | 5/1991 | Escher, Jr. |
| 5,039,829 | A | 8/1991 | Brucksch |
| 5,060,814 | A | 10/1991 | Oglesbee |
| 5,068,771 | A | 11/1991 | Savage, Jr. |
| 5,070,436 | A | 12/1991 | Alexander |
| 5,088,127 | A | 2/1992 | Thornock |
| 5,111,366 | A | 5/1992 | Rife |
| 5,113,325 | A | 5/1992 | Eisenbraun |
| 5,117,510 | A | 6/1992 | Broussard |
| 5,122,943 | A | 6/1992 | Pugh |
| 5,138,538 | A | 8/1992 | Sperling |
| 5,140,116 | A | 8/1992 | Schmitt-Walter |
| 5,140,220 | A | 8/1992 | Hasegawa |
| 5,143,443 | A | 9/1992 | Madsen |
| 5,158,356 | A | 10/1992 | Guthrie |
| 5,163,420 | A | 11/1992 | VanDerBel |
| 5,164,749 | A | 11/1992 | Shelton |
| 5,165,789 | A | 11/1992 | Womack |
| 5,183,326 | A | 2/1993 | Case |
| 5,189,512 | A | 2/1993 | Cameron |
| 5,193,220 | A | 3/1993 | Ichinohe |
| 5,193,347 | A | 3/1993 | Apisdorf |
| 5,207,500 | A | 5/1993 | Rios |
| 5,218,385 | A | 6/1993 | Lii |
| 5,224,772 | A | 7/1993 | Fustos |
| 5,230,558 | A | 7/1993 | Jong |
| 5,238,344 | A | 8/1993 | Nagayama |
| 5,245,516 | A | 9/1993 | deHaas |
| 5,249,675 | A | 10/1993 | Strauss |
| D343,470 | S | 1/1994 | Yuen |
| 5,278,734 | A | 1/1994 | Ferber |
| D349,123 | S | 7/1994 | Cooley |
| 5,329,637 | A | 7/1994 | Walker |
| 5,331,333 | A | 7/1994 | Tagawa |
| 5,331,357 | A | 7/1994 | Cooley |
| 5,353,205 | A | 10/1994 | Hudak |
| 5,357,409 | A | 10/1994 | Glatt |
| 5,363,291 | A | 11/1994 | Steiner |

(56) References Cited

U.S. PATENT DOCUMENTS

| | | | |
|---|---|---|---|
| 5,367,345 | A | 11/1994 | da Silva |
| 5,404,593 | A | 4/1995 | Kronenberger |
| 5,408,393 | A | 4/1995 | Becker |
| 5,410,746 | A | 4/1995 | Gelber |
| 5,412,545 | A | 5/1995 | Rising |
| 5,418,565 | A | 5/1995 | Smith |
| 5,423,419 | A | 6/1995 | Wentz |
| 5,438,698 | A | 8/1995 | Burton |
| 5,452,190 | A | 9/1995 | Priesemuth |
| 5,460,346 | A | 10/1995 | Hirsch |
| 5,463,538 | A | 10/1995 | Womack |
| 5,467,992 | A | 11/1995 | Harkness |
| 5,485,358 | A | 1/1996 | Chien |
| 5,488,361 | A | 1/1996 | Perry |
| 5,503,637 | A | 4/1996 | Kyricos |
| 5,508,900 | A | 4/1996 | Norman |
| 5,510,961 | A | 4/1996 | Peng |
| 5,541,767 | A | 7/1996 | Murphy |
| 5,541,816 | A | 7/1996 | Miserendino |
| 5,542,627 | A | 8/1996 | Crenshaw |
| 5,546,099 | A | 8/1996 | Quint |
| 5,564,128 | A | 10/1996 | Richardson |
| 5,567,038 | A | 10/1996 | Lary |
| D375,372 | S | 11/1996 | Allen |
| 5,575,554 | A | 11/1996 | Guritz |
| 5,601,358 | A | 2/1997 | Chien |
| 5,606,743 | A | 2/1997 | Vogt |
| 5,608,808 | A | 3/1997 | da Silva |
| 5,610,678 | A | 3/1997 | Tsuboi |
| 5,644,189 | A | 7/1997 | Busby |
| 5,655,374 | A | 8/1997 | Santilli |
| D383,754 | S | 9/1997 | Yuen |
| D383,863 | S | 9/1997 | Yuen |
| 5,667,291 | A | 9/1997 | Caplan |
| 5,667,292 | A | 9/1997 | Sabalvaro, Jr. |
| 5,676,449 | A | 10/1997 | Newsome |
| 5,677,079 | A | 10/1997 | DeZorzi |
| 5,680,718 | A | 10/1997 | Ratcliffe |
| 5,688,039 | A | 11/1997 | Johnson |
| D388,113 | S | 12/1997 | Feinbloom |
| 5,692,244 | A | 12/1997 | Johnson |
| 5,708,449 | A | 1/1998 | Heacock |
| 5,709,464 | A | 1/1998 | Tseng |
| 5,718,335 | A | 2/1998 | Boudreaux |
| 5,722,762 | A | 3/1998 | Soll |
| 5,730,290 | A | 3/1998 | Futo |
| 5,741,060 | A | 4/1998 | Johnson |
| 5,743,621 | A | 4/1998 | Mantha |
| 5,758,947 | A | 6/1998 | Glatt |
| 5,774,338 | A | 6/1998 | Wessling, III |
| 5,786,665 | A | 7/1998 | Ohtsuki |
| 5,800,278 | A | 9/1998 | Varriano |
| 5,806,961 | A | 9/1998 | Dalton |
| 5,822,636 | A | 10/1998 | Cho |
| 5,829,063 | A | 11/1998 | Cheng |
| 5,829,860 | A | 11/1998 | Lawther |
| 5,836,673 | A | 11/1998 | Lo |
| 5,845,778 | A | 12/1998 | Hickey, Jr. |
| 5,845,987 | A | 12/1998 | Painter |
| 5,857,220 | A | 1/1999 | Erny |
| 5,865,333 | A | 2/1999 | Wolfe |
| 5,871,271 | A | 2/1999 | Chien |
| D407,187 | S | 3/1999 | Makki |
| 5,876,241 | A | 3/1999 | Frantz |
| 5,893,631 | A | 4/1999 | Padden |
| 5,894,604 | A | 4/1999 | Crabb |
| 5,918,966 | A | 7/1999 | Arnold |
| 5,920,910 | A | 7/1999 | Calvo |
| 5,921,674 | A | 7/1999 | Koczi |
| 5,922,489 | A | 7/1999 | Adachi |
| 5,931,693 | A | 8/1999 | Yamazaki |
| 5,946,071 | A | 8/1999 | Feldman |
| 5,982,969 | A | 11/1999 | Sugiyama |
| 5,997,165 | A | 12/1999 | Lehrer |
| 6,005,536 | A | 12/1999 | Beadles |
| 6,007,212 | A | 12/1999 | Chan |
| 6,007,213 | A | 12/1999 | Baumgartner |
| 6,009,563 | A | 1/2000 | Swanson |
| 6,012,822 | A | 1/2000 | Robinson |
| 6,012,827 | A | 1/2000 | Caplan |
| D420,035 | S | 2/2000 | Hartman |
| D420,207 | S | 2/2000 | Barton |
| 6,021,525 | A | 2/2000 | Mertins |
| 6,023,788 | A | 2/2000 | McCallum |
| 6,028,627 | A | 2/2000 | Helmsderfer |
| 6,032,291 | A | 3/2000 | Asenguah |
| 6,032,293 | A | 3/2000 | Makki |
| 6,056,413 | A | 5/2000 | Urso |
| D428,431 | S | 7/2000 | Jordan |
| 6,086,214 | A | 7/2000 | Ridge |
| 6,087,037 | A | 7/2000 | Rieder |
| 6,088,053 | A | 7/2000 | Hammack |
| 6,094,749 | A | 8/2000 | Proctor |
| 6,113,243 | A | 9/2000 | Saul |
| 6,113,244 | A | 9/2000 | Baumgartner |
| 6,116,745 | A | 9/2000 | Yei |
| 6,124,056 | A | 9/2000 | Kimura |
| 6,126,294 | A | 10/2000 | Koyama |
| 6,167,570 | B1 | 1/2001 | Su |
| 6,168,286 | B1 | 1/2001 | Duffy |
| 6,172,657 | B1 | 1/2001 | Kamakura |
| 6,174,075 | B1 | 1/2001 | Fuwausa |
| 6,176,601 | B1 | 1/2001 | Nester |
| 6,206,543 | B1 | 3/2001 | Henry |
| 6,236,007 | B1 | 5/2001 | Ho |
| 6,237,147 | B1 | 5/2001 | Brockman |
| 6,240,566 | B1 | 6/2001 | Scantlin |
| 6,244,721 | B1 | 6/2001 | Rodriguez |
| 6,250,769 | B1 | 6/2001 | Kirk |
| D445,928 | S | 7/2001 | Sharrah |
| 6,256,795 | B1 | 7/2001 | Habel |
| D446,324 | S | 8/2001 | Lynch |
| 6,290,368 | B1 | 9/2001 | Lehrer |
| 6,299,323 | B1 | 10/2001 | Yu |
| 6,302,570 | B1 | 10/2001 | Petell |
| 6,306,538 | B1 | 10/2001 | Saitoh |
| 6,307,526 | B1 | 10/2001 | Mann |
| 6,311,350 | B1 | 11/2001 | Kaiserman |
| 6,311,837 | B1 | 11/2001 | Blaustein |
| 6,320,822 | B1 | 11/2001 | Okeya |
| 6,325,521 | B1 | 12/2001 | Gregg |
| 6,328,454 | B1 | 12/2001 | Davis |
| 6,340,234 | B1 | 1/2002 | Brown, Jr. |
| 6,345,716 | B1 | 2/2002 | Chapman |
| 6,347,410 | B1 | 2/2002 | Lee |
| 6,363,537 | B1 | 4/2002 | Park |
| 6,366,344 | B1 | 4/2002 | Lach |
| 6,367,949 | B1 | 4/2002 | Pederson |
| D457,670 | S | 5/2002 | Allen |
| 6,382,407 | B1 | 5/2002 | Chao |
| 6,386,701 | B1 | 5/2002 | Khulusi |
| 6,390,640 | B1 | 5/2002 | Wong |
| 6,398,386 | B1 | 6/2002 | Huang |
| 6,416,199 | B1 | 7/2002 | Heine |
| 6,431,904 | B1 | 8/2002 | Berelsman |
| 6,439,738 | B1 | 8/2002 | Matthews |
| 6,442,764 | B1 | 9/2002 | Badillo |
| 6,457,838 | B1 | 10/2002 | Dugmore |
| 6,461,015 | B1 | 10/2002 | Welch |
| 6,461,025 | B1 | 10/2002 | Payne |
| 6,474,830 | B1 | 11/2002 | Hansen |
| 6,476,391 | B1 | 11/2002 | Zhang |
| 6,497,493 | B1 | 12/2002 | Theisen |
| D469,198 | S | 1/2003 | Olson |
| 6,504,099 | B2 | 1/2003 | Huang |
| 6,523,973 | B2 | 2/2003 | Galli |
| 6,530,672 | B2 | 3/2003 | Galli |
| 6,538,567 | B2 | 3/2003 | Stewart |
| D473,890 | S | 4/2003 | Waters |
| 6,549,231 | B1 | 4/2003 | Matsui |
| 6,553,570 | B1 | 4/2003 | Flynn |
| 6,554,444 | B2 | 4/2003 | Shimada |
| 6,578,982 | B1 | 6/2003 | Lynch |
| D477,432 | S | 7/2003 | Parsons |

(56) References Cited

U.S. PATENT DOCUMENTS

| | | | |
|---|---|---|---|
| 6,598,991 | B2 | 7/2003 | Altman |
| 6,604,837 | B2 | 8/2003 | Sandberg |
| 6,612,695 | B2 | 9/2003 | Waters |
| 6,612,696 | B2 | 9/2003 | Waters |
| 6,616,293 | B2 | 9/2003 | Mickey |
| 6,634,031 | B1 | 10/2003 | Schlapkohl |
| 6,642,667 | B2 | 11/2003 | Avis |
| D483,928 | S | 12/2003 | Mansell |
| 6,659,618 | B2 | 12/2003 | Waters |
| D484,905 | S | 1/2004 | Waters |
| 6,679,615 | B2 | 1/2004 | Spearing |
| 6,704,044 | B1 | 3/2004 | Foster |
| 6,709,142 | B2 | 3/2004 | Gyori |
| 6,713,956 | B2 | 3/2004 | HsingChen |
| 6,715,309 | B1 | 4/2004 | Junkins |
| 6,719,437 | B2 | 4/2004 | Lary |
| 6,721,962 | B1 | 4/2004 | Polaire |
| D489,165 | S | 5/2004 | Waters |
| 6,733,150 | B1 | 5/2004 | Hanley |
| 6,749,166 | B2 | 6/2004 | Valentine |
| 6,760,925 | B1 | 7/2004 | Maxwell |
| 6,764,194 | B1 | 7/2004 | Cooper |
| 6,802,636 | B1 | 10/2004 | Bailey, Jr. |
| 6,808,284 | B1 | 10/2004 | Chao |
| 6,811,441 | B2 | 11/2004 | Simpson |
| 6,817,711 | B2 | 11/2004 | Schubert |
| 6,830,357 | B2 | 12/2004 | Lopez |
| D501,266 | S | 1/2005 | Harris |
| 6,837,590 | B2 | 1/2005 | Marston |
| 6,857,739 | B1 | 2/2005 | Watson |
| 6,860,628 | B2 | 3/2005 | Robertson |
| 6,863,416 | B2 | 3/2005 | Waters |
| 6,865,285 | B1 | 3/2005 | Villa-Aleman |
| 6,880,989 | B2 | 4/2005 | Sotome |
| 6,908,208 | B1 | 6/2005 | Hyde |
| D507,368 | S | 7/2005 | Waters |
| D507,369 | S | 7/2005 | Waters |
| 6,918,678 | B2 | 7/2005 | McClanahan |
| 6,923,322 | B2 | 8/2005 | Lenker |
| 6,929,375 | B2 | 8/2005 | Satomi |
| 6,929,878 | B2 | 8/2005 | Chen |
| 6,932,216 | B2 | 8/2005 | Blaustein |
| 6,935,761 | B2 | 8/2005 | Vanderschuit |
| 6,941,583 | B2 | 9/2005 | Yan |
| 6,966,668 | B2 | 11/2005 | Cugini |
| 6,969,178 | B2 | 11/2005 | Zuloff |
| 6,977,776 | B2 | 12/2005 | Volkenandt |
| 6,993,803 | B2 | 2/2006 | Chan |
| 6,994,445 | B1 | 2/2006 | Pomes |
| 6,997,552 | B1 | 2/2006 | Hung |
| 7,000,841 | B2 | 2/2006 | Becker |
| 7,003,353 | B1 | 2/2006 | Parkhouse |
| 7,004,439 | B1 | 2/2006 | Taylor |
| 7,004,582 | B2 | 2/2006 | Jannard |
| 7,008,074 | B1 | 3/2006 | Halm |
| 7,021,790 | B2 | 4/2006 | Parsons |
| D520,460 | S | 5/2006 | Wadsworth |
| 7,052,154 | B2 | 5/2006 | Vanderschuit |
| 7,055,179 | B2 | 6/2006 | Warner |
| 7,086,749 | B1 | 8/2006 | Hanley |
| 7,094,981 | B2 | 8/2006 | Sorrentino |
| 7,104,670 | B2 | 9/2006 | Waters |
| 7,105,939 | B2 | 9/2006 | Bednyak |
| 7,111,956 | B2 | 9/2006 | Brown |
| 7,114,823 | B2 | 10/2006 | McCullough et al. |
| 7,118,241 | B2 | 10/2006 | Sohn |
| 7,118,262 | B2 | 10/2006 | Negley |
| 7,128,434 | B1 | 10/2006 | Nally |
| 7,147,324 | B2 | 12/2006 | Jannard |
| 7,147,338 | B2 | 12/2006 | Gregg |
| 7,150,526 | B2 | 12/2006 | Jannard |
| 7,163,309 | B2 | 1/2007 | Sohn |
| 7,182,478 | B2 | 2/2007 | Marston |
| 7,186,159 | B1 | 3/2007 | Baxter |
| 7,192,151 | B2 | 3/2007 | Clupper |
| 7,209,652 | B2 | 4/2007 | Uenaka |
| 7,213,917 | B2 | 5/2007 | Jannard |
| 7,216,973 | B2 | 5/2007 | Jannard |
| 7,226,180 | B2 | 6/2007 | Sung |
| 7,234,831 | B1 | 6/2007 | Hanley |
| 7,255,437 | B2 | 8/2007 | Howell |
| 7,264,350 | B2 | 9/2007 | Jannard |
| D553,177 | S | 10/2007 | Chen |
| 7,278,734 | B2 | 10/2007 | Jannard |
| 7,281,826 | B2 | 10/2007 | Huang |
| 7,318,654 | B2 | 1/2008 | McClanahan |
| 7,331,064 | B1 | 2/2008 | Quintal |
| D566,044 | S | 4/2008 | D'Arco et al. |
| D568,922 | S | 5/2008 | Anderl |
| 7,369,174 | B2 | 5/2008 | Olita |
| 7,377,664 | B2 | 5/2008 | Waters |
| 7,427,149 | B2 | 9/2008 | Sohn |
| 7,431,472 | B2 | 10/2008 | Becker |
| 7,438,409 | B2 | 10/2008 | Jordan |
| 7,457,536 | B2 | 11/2008 | Hamada |
| 7,461,764 | B2 | 12/2008 | Thompson |
| 7,466,040 | B2 | 12/2008 | Bruwer |
| 7,470,022 | B2 | 12/2008 | Lerner |
| 7,506,992 | B2 | 3/2009 | Carter |
| D591,675 | S | 5/2009 | Waters |
| 7,562,979 | B2 | 7/2009 | Waters |
| 7,576,800 | B2 | 8/2009 | Swain |
| D600,208 | S | 9/2009 | Waters |
| D600,738 | S | 9/2009 | Su |
| 7,598,928 | B1 | 10/2009 | Buskop |
| 7,607,775 | B2 | 10/2009 | Hermanson |
| 7,609,295 | B2 | 10/2009 | Aridome |
| 7,611,255 | B1 | 11/2009 | Lagassey |
| 7,621,000 | B1 | 11/2009 | Fulton |
| D605,381 | S | 12/2009 | Mastrantonio et al. |
| 7,661,818 | B2 | 2/2010 | Waters |
| D611,086 | S | 3/2010 | Meng-Suen |
| 7,677,751 | B2 | 3/2010 | Kinsman |
| 7,699,486 | B1 | 4/2010 | Beiner |
| D617,826 | S | 6/2010 | Waters |
| 7,753,547 | B2 | 7/2010 | Waters |
| 7,755,219 | B2 | 7/2010 | Bruwer |
| 7,784,960 | B2 | 8/2010 | Lahtinen |
| 7,862,979 | B2 | 1/2011 | Waters |
| 7,934,846 | B1 | 5/2011 | Schwanz |
| 7,938,553 | B1 | 5/2011 | Beiner |
| 7,942,543 | B2 | 5/2011 | Ritter |
| 8,002,437 | B2 | 8/2011 | Sohn |
| 8,075,153 | B2 | 12/2011 | Werner |
| 8,141,395 | B2 | 3/2012 | Dillavou |
| 8,157,403 | B2 | 4/2012 | Lau |
| D659,351 | S | 5/2012 | Benkendorfer |
| 8,333,485 | B2 | 12/2012 | Waters |
| 8,364,220 | B2 | 1/2013 | Sandmore |
| 8,388,164 | B2 | 3/2013 | Waters |
| 8,491,145 | B2 | 7/2013 | Waters |
| 8,550,651 | B2 | 10/2013 | Waters |
| 8,698,027 | B2 | 4/2014 | Anderst |
| 8,757,831 | B2 * | 6/2014 | Waters ..... A42B 1/244 200/566 |
| 8,769,723 | B1 | 7/2014 | Ilges |
| 8,774,420 | B2 | 7/2014 | Belafonte et al. |
| 8,813,268 | B1 | 8/2014 | Fitzgerald et al. |
| 8,919,984 | B1 | 12/2014 | Fitzgerald |
| 8,950,012 | B2 | 2/2015 | Ilges et al. |
| 9,057,500 | B2 | 6/2015 | Opolka |
| D734,925 | S | 7/2015 | Waters |
| 2001/0024365 | A1 | 9/2001 | Aknine |
| 2002/0027777 | A1 | 3/2002 | Takasu |
| 2002/0129989 | A1 | 9/2002 | Parsons |
| 2002/0131275 | A1 | 9/2002 | Yamamoto |
| 2002/0159250 | A1 | 10/2002 | Kuo |
| 2002/0163800 | A1 | 11/2002 | Hansen |
| 2002/0186557 | A1 | 12/2002 | Lary |
| 2002/0187806 | A1 | 12/2002 | Jang |
| 2003/0079387 | A1 | 5/2003 | Derose |
| 2003/0086053 | A1 | 5/2003 | Waters |
| 2003/0086054 | A1 | 5/2003 | Waters |
| 2003/0106918 | A1 | 6/2003 | Hung |

(56) References Cited

U.S. PATENT DOCUMENTS

| | | | |
|---|---|---|---|
| 2003/0122958 | A1 | 7/2003 | Olita |
| 2003/0151910 | A1 | 8/2003 | Marston |
| 2003/0169207 | A1 | 9/2003 | Beigel |
| 2003/0189824 | A1 | 10/2003 | Meeder |
| 2003/0206269 | A1 | 11/2003 | Waters |
| 2003/0231489 | A1 | 12/2003 | Hsiao |
| 2004/0001150 | A1 | 1/2004 | Schindler |
| 2004/0008157 | A1 | 1/2004 | Brubaker |
| 2004/0085745 | A1 | 5/2004 | Yoshihara |
| 2004/0128737 | A1 | 7/2004 | Gesten |
| 2004/0141312 | A1 | 7/2004 | Henning |
| 2004/0141316 | A1 | 7/2004 | Twardawski |
| 2004/0165109 | A1 | 8/2004 | Lee |
| 2004/0222638 | A1 | 11/2004 | Bednyak |
| 2004/0240067 | A1 | 12/2004 | Marusi |
| 2004/0240204 | A1 | 12/2004 | Russ |
| 2004/0264176 | A1 | 12/2004 | Vanderschuit |
| 2005/0001433 | A1 | 1/2005 | Seelin |
| 2005/0035925 | A1 | 2/2005 | Ostromek |
| 2005/0047116 | A1 | 3/2005 | Gagne |
| 2005/0066422 | A1 | 3/2005 | Yan |
| 2005/0072458 | A1 | 4/2005 | Goldstein |
| 2005/0078473 | A1 | 4/2005 | Zuloff |
| 2005/0083676 | A1 | 4/2005 | VanderSchuit |
| 2005/0099799 | A1 | 5/2005 | Cugini |
| 2005/0105285 | A1 | 5/2005 | Maden |
| 2005/0161313 | A1 | 7/2005 | Sorrentino |
| 2005/0174753 | A1 | 8/2005 | Cao |
| 2005/0204490 | A1 | 9/2005 | Kemp |
| 2005/0211187 | A1 | 9/2005 | Harman |
| 2005/0211574 | A1 | 9/2005 | Reeve |
| 2005/0213340 | A1 | 9/2005 | Suzuki |
| 2005/0219837 | A1 | 10/2005 | Brown |
| 2005/0237479 | A1 | 10/2005 | Rose |
| 2005/0248932 | A1 | 11/2005 | Waters |
| 2005/0254238 | A1 | 11/2005 | Parker |
| 2005/0265015 | A1 | 12/2005 | Salazar |
| 2006/0012974 | A1 | 1/2006 | Su |
| 2006/0012975 | A1 | 1/2006 | Huttner |
| 2006/0037125 | A1 | 2/2006 | McDowell |
| 2006/0091784 | A1 | 5/2006 | Conner |
| 2006/0092621 | A1 | 5/2006 | Lai |
| 2006/0093264 | A1 | 5/2006 | Tabuchi |
| 2006/0107952 | A1 | 5/2006 | Schlosser |
| 2006/0125624 | A1 | 6/2006 | Ostrovsky |
| 2006/0126323 | A1 | 6/2006 | Pomes |
| 2006/0138440 | A1 | 6/2006 | Jyo |
| 2006/0141828 | A1 | 6/2006 | Dean |
| 2006/0157569 | A1 | 7/2006 | Becker |
| 2006/0158895 | A1 | 7/2006 | Brands |
| 2006/0165160 | A1 | 7/2006 | Winningstad |
| 2006/0198122 | A1 | 9/2006 | Senter |
| 2006/0212994 | A1 | 9/2006 | Proctor |
| 2006/0215393 | A1 | 9/2006 | VanderSchuit |
| 2006/0232955 | A1 | 10/2006 | Labine |
| 2006/0238995 | A1 | 10/2006 | Wang |
| 2006/0239018 | A1 | 10/2006 | Jardin |
| 2006/0263677 | A1 | 11/2006 | Tsai |
| 2006/0285315 | A1 | 12/2006 | Tufenkjian |
| 2006/0286443 | A1 | 12/2006 | Huang |
| 2006/0291193 | A1 | 12/2006 | Hill |
| 2007/0003826 | A1 | 1/2007 | Hsu |
| 2007/0013865 | A1 | 1/2007 | Jordan |
| 2007/0030442 | A1 | 2/2007 | Howell |
| 2007/0048598 | A1 | 3/2007 | Huang |
| 2007/0053179 | A1 | 3/2007 | Pang |
| 2007/0058361 | A1 | 3/2007 | Sevilla |
| 2007/0064413 | A1 | 3/2007 | Slater |
| 2007/0072655 | A1 | 3/2007 | Cascone |
| 2007/0074752 | A1 | 4/2007 | Shau |
| 2007/0086182 | A1 | 4/2007 | Kelly |
| 2007/0097668 | A1 | 5/2007 | Choi |
| 2007/0127250 | A1 | 6/2007 | Waters |
| 2007/0140675 | A1 | 6/2007 | Yanagi |
| 2007/0145746 | A1 | 6/2007 | Biamonte |
| 2007/0153500 | A1 | 7/2007 | Waters |
| 2007/0153537 | A1 | 7/2007 | Scott |
| 2007/0159810 | A1 | 7/2007 | Kim |
| 2007/0159823 | A1 | 7/2007 | Ho |
| 2007/0171628 | A1 | 7/2007 | Seade |
| 2007/0189003 | A1 | 8/2007 | Daley |
| 2007/0206373 | A1 | 9/2007 | Whiteside |
| 2007/0236649 | A1 | 10/2007 | Lin |
| 2007/0236915 | A1 | 10/2007 | Chen |
| 2007/0236916 | A1 | 10/2007 | Hsu |
| 2008/0049963 | A1 | 2/2008 | Mann et al. |
| 2008/0069391 | A1 | 3/2008 | Steyn |
| 2008/0130272 | A1 | 6/2008 | Waters |
| 2008/0152482 | A1 | 6/2008 | Patel |
| 2008/0186705 | A1 | 8/2008 | Liu |
| 2008/0263750 | A1 | 10/2008 | Chen |
| 2008/0266839 | A1 | 10/2008 | Claypool |
| 2009/0010474 | A1 | 1/2009 | Ouryouji |
| 2009/0126076 | A1 | 5/2009 | Ochoa |
| 2009/0147503 | A1 | 6/2009 | Bennett |
| 2009/0148149 | A1 | 6/2009 | Chishima |
| 2009/0193566 | A1 | 8/2009 | Waters |
| 2009/0213323 | A1 | 8/2009 | Mermanson |
| 2009/0268936 | A1 | 10/2009 | Goldberg et al. |
| 2009/0323317 | A1 | 12/2009 | Spartano |
| 2010/0024091 | A1 | 2/2010 | Mehtab |
| 2010/0095431 | A1 | 4/2010 | Liao |
| 2010/0134761 | A1 | 6/2010 | Johns |
| 2010/0182563 | A1 | 7/2010 | Waters |
| 2010/0214767 | A1 | 8/2010 | Waters |
| 2010/0242155 | A1 | 9/2010 | Carullo |
| 2010/0307931 | A1 | 12/2010 | Waters |
| 2010/0313335 | A1 | 12/2010 | Waters |
| 2011/0013135 | A1 | 1/2011 | Waters |
| 2011/0075095 | A1 | 3/2011 | Waters |
| 2011/0122601 | A1 | 5/2011 | Waters |
| 2011/0187989 | A1 | 8/2011 | Waters |
| 2011/0210685 | A1 | 9/2011 | Liao |
| 2011/0211156 | A1 | 9/2011 | Beiner |
| 2011/0228211 | A1 | 9/2011 | Waters |
| 2012/0014095 | A2 | 1/2012 | Waters |
| 2012/0098465 | A1 | 4/2012 | Rothschild |
| 2013/0025612 | A1 | 1/2013 | Hunter |
| 2013/0111651 | A1 | 5/2013 | Waters |
| 2013/0192961 | A1 | 8/2013 | Waters |
| 2013/0198935 | A1 | 8/2013 | Waters |
| 2014/0049947 | A1 | 2/2014 | Lombard |
| 2014/0101827 | A1 | 4/2014 | Dennis |
| 2014/0173807 | A1 | 6/2014 | Waters |
| 2014/0237706 | A1 | 8/2014 | OConner |
| 2014/0268683 | A1 | 9/2014 | Waters |
| 2014/0270685 | A1* | 9/2014 | Letke ..... A42B 1/244 386/224 |
| 2015/0358515 | A1* | 12/2015 | Resnick ..... G03B 17/566 348/373 |

FOREIGN PATENT DOCUMENTS

| | | |
|---|---|---|
| AU | 199940150 | 2/2000 |
| AU | 199959545 | 3/2000 |
| AU | 2002100976 | 6/2003 |
| AU | 2003100277 | 7/2003 |
| AU | 2003248016 | 11/2004 |
| CA | 2029772 | 5/1991 |
| CA | 2198625 | 2/1997 |
| CA | 2184336 | 5/1997 |
| CA | 2406450 | 11/2001 |
| CA | 2466175 A1 | 5/2003 |
| CA | 2608746 A1 | 11/2006 |
| CA | 2610073 A1 | 5/2008 |
| CN | 86208973 | 10/1987 |
| CN | 2173427 | 8/1994 |
| CN | 2239167 | 11/1996 |
| CN | 2423761 | 3/2001 |
| CN | 2433836 | 6/2001 |
| CN | 2458892 | 11/2001 |
| CN | 2508592 | 9/2002 |
| CN | 2544551 | 4/2003 |
| CN | 1462597 | 12/2003 |

(56) References Cited

FOREIGN PATENT DOCUMENTS

| | | | |
|---|---|---|---|
| CN | 1603677 | A | 4/2005 |
| CN | 101950091 | A | 1/2011 |
| CN | 301445845 | S | 1/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 2290433 | A1 | 3/2011 |
| EP | 2299311 | A1 | 3/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H10081275 | A | 3/1998 |
| JP | H10331019 | A | 12/1998 |
| JP | 2001131818 | A | 5/2001 |
| JP | 3084061 | | 11/2001 |
| JP | 3090973 | | 10/2002 |
| JP | 2004207580 | | 7/2004 |
| JP | 2004346470 | | 12/2004 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 0177575 | A1 | 10/2001 |
| WO | 0244611 | | 6/2002 |
| WO | 02062165 | | 8/2002 |
| WO | 02074398 | | 9/2002 |
| WO | 02077520 | | 10/2002 |
| WO | 03040808 | A2 | 5/2003 |
| WO | 03047377 | | 6/2003 |
| WO | 03083811 | | 10/2003 |
| WO | 2004000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005216832 | A | 8/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |
| WO | 2013096895 | | 6/2013 |
| WO | 2013096904 | | 6/2013 |
| ZA | 20043826 | A | 9/2005 |

OTHER PUBLICATIONS

"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).

"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trade-beanie.htm. (2 pages).

Extended European search report issued in the related European Application No. 08 86 2753.4 dated Dec. 7, 2012 (7 pages).

Extended European search report issued in the related European Application No. 10 18 1592.6 dated Jan. 31, 2011 (7 pages).

Extended European search report issued in the related European Application No. 10 18 1593.4 dated Feb. 1, 2011 (8 pages).

International Search Report from the International Bureau of WIPO issued in the related International Application No. PCT/US02/35665, dated Jun. 27, 2003, 1 page.

Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.

Notification of Transmittal of the International Search Report and the Written Opinion of the International Searching Authority, or the Declaration from the International Bureau of WIPO for International Application No. PCT/US10/50978, dated Dec. 3, 2010, 16 pages.

Notification of Transmittal of the International Search Report and the Written Opinion of the International Searching Authority, or the

(56) References Cited

OTHER PUBLICATIONS

Declaration from the International Bureau of WIPO for International Application No. PCT/US14/28613, 13 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013 and English translation of the same (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.
"4 LED Lighted Fleece Beanie; POWERCAP," article posted online to Wise-Shop.ca. Added to the businesses catalog on Nov. 6, 2013. Retrieved from the Internet on Jun. 17, 2014. URL: http://www.wise-shop.ca/product_info.php?products_id=489.
Notification of Transmittal of the International Search Report and the Written Opinion of the International Searching Authority, or the Declaration from the International Bureau of WIPO for International Application No. PCT/US2014/028945 dated Jul. 31, 2014, 9 pages.

* cited by examiner

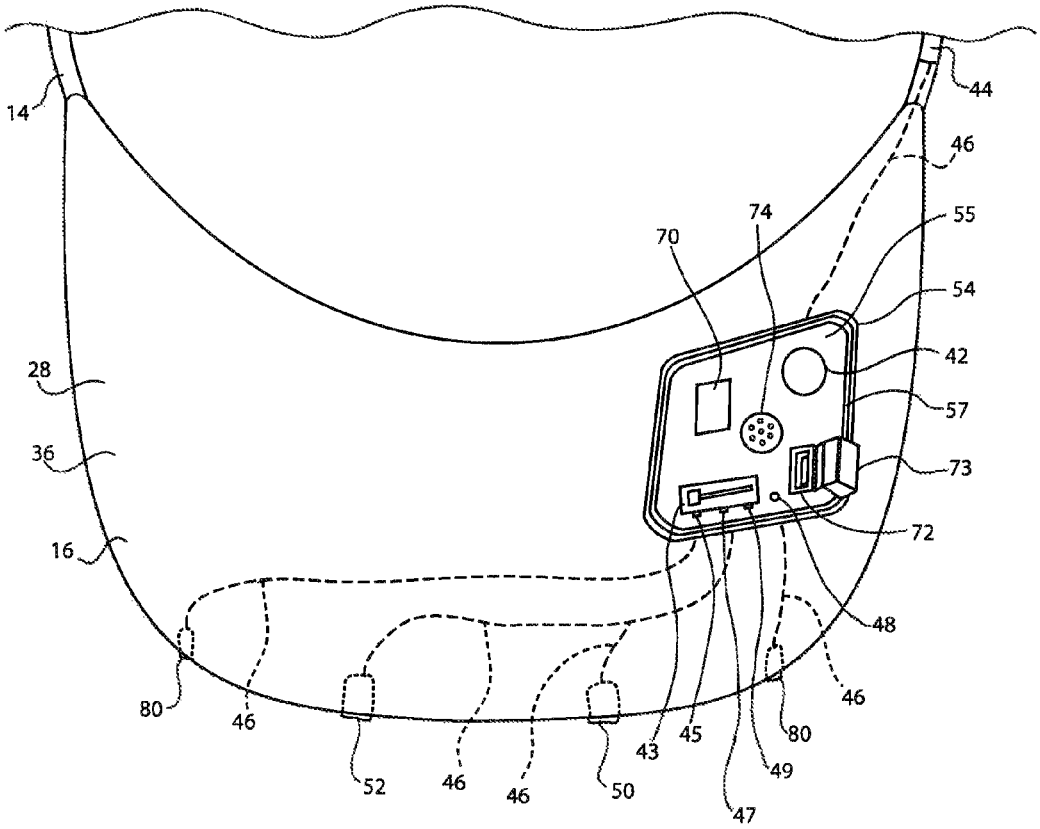
FIG.26
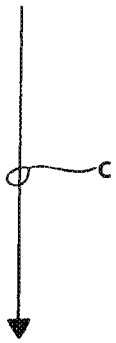

FIG. 30
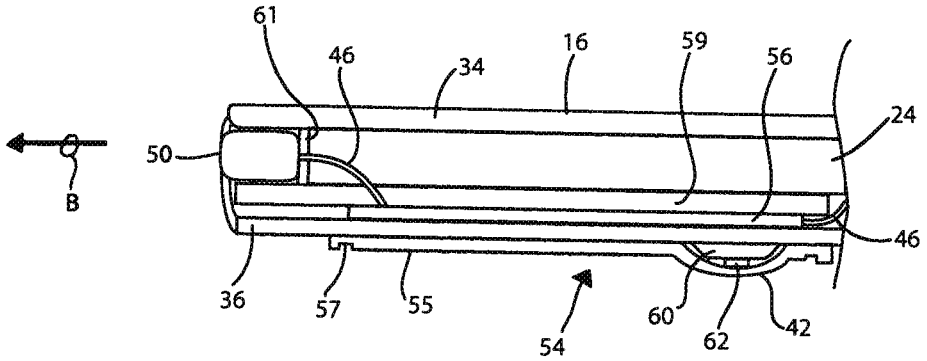
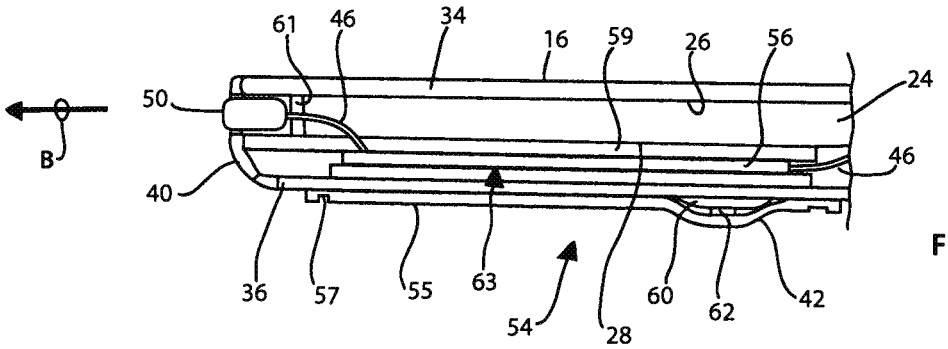
FIG. 31

FIG. 51B
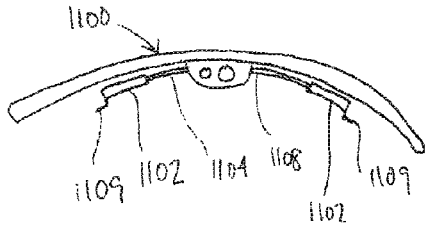
FIG. 51A
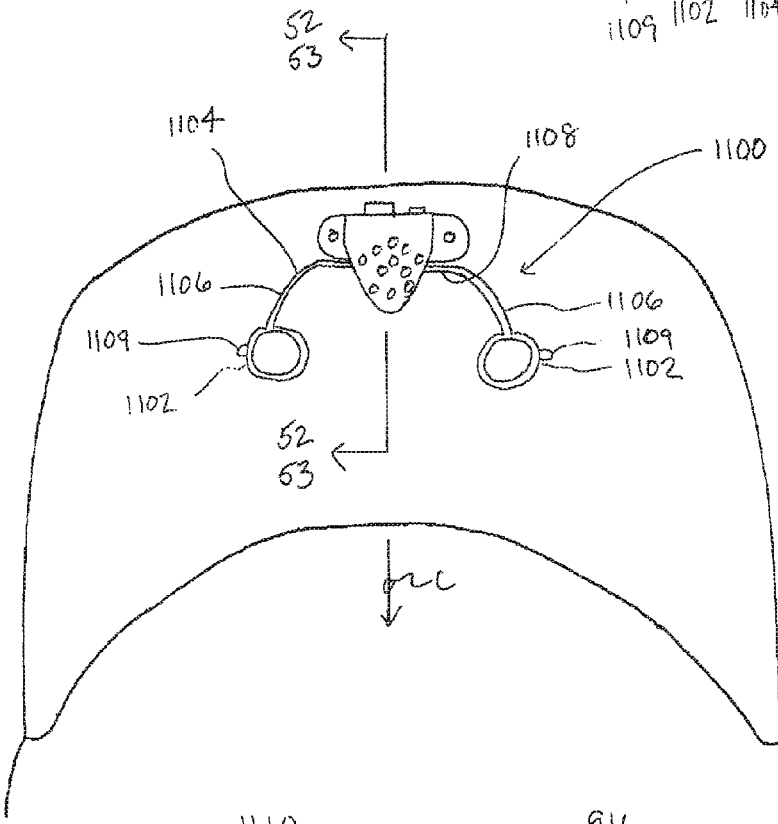
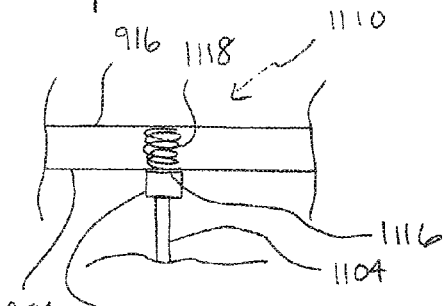
FIG 52
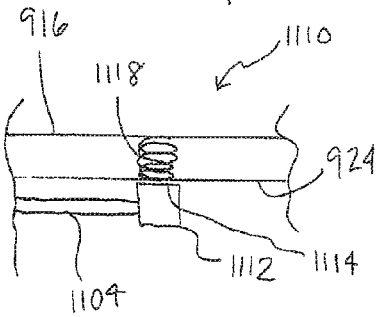
FIG. 53

FIG. 68
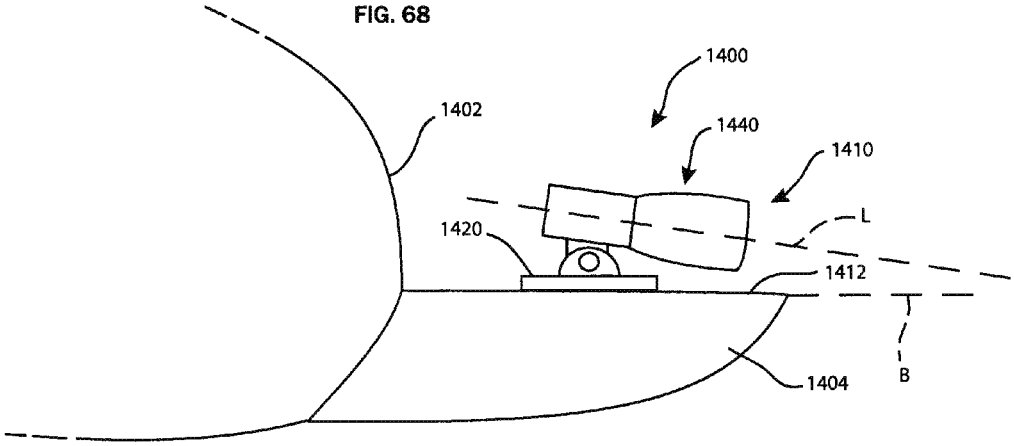
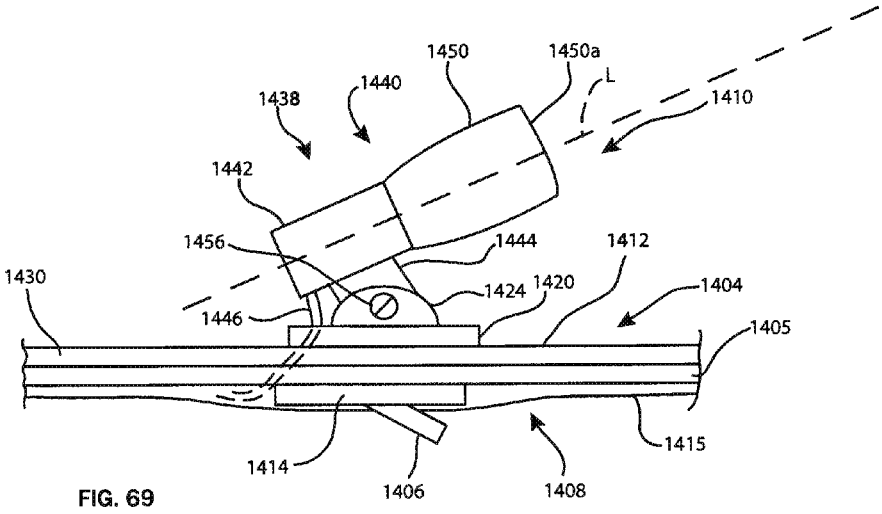
FIG. 69

FIG. 70A
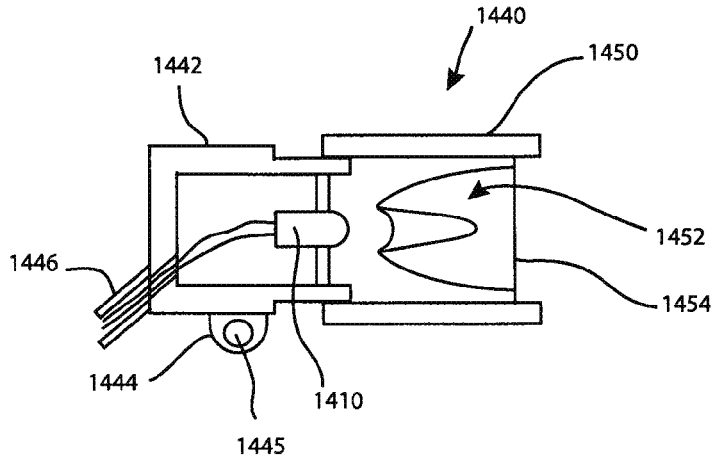
FIG. 71
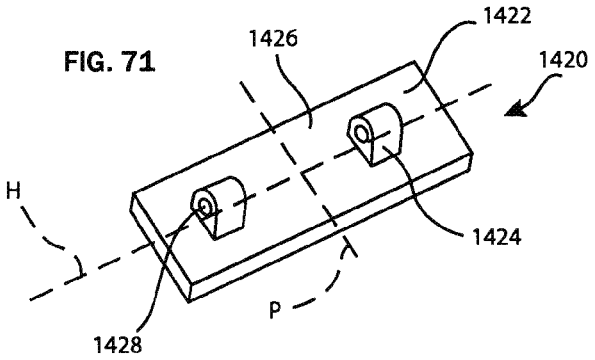
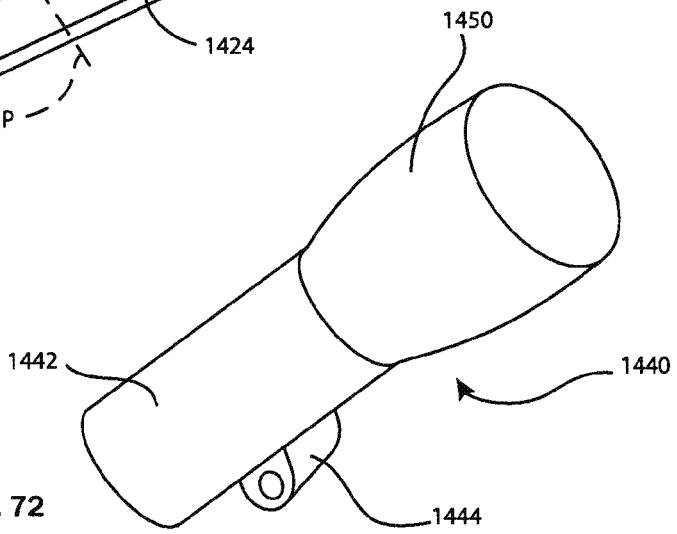
FIG. 72

FIG. 73
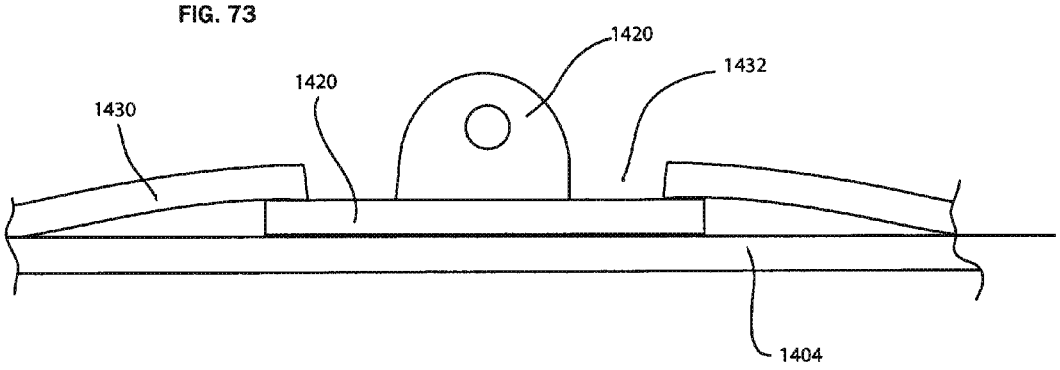
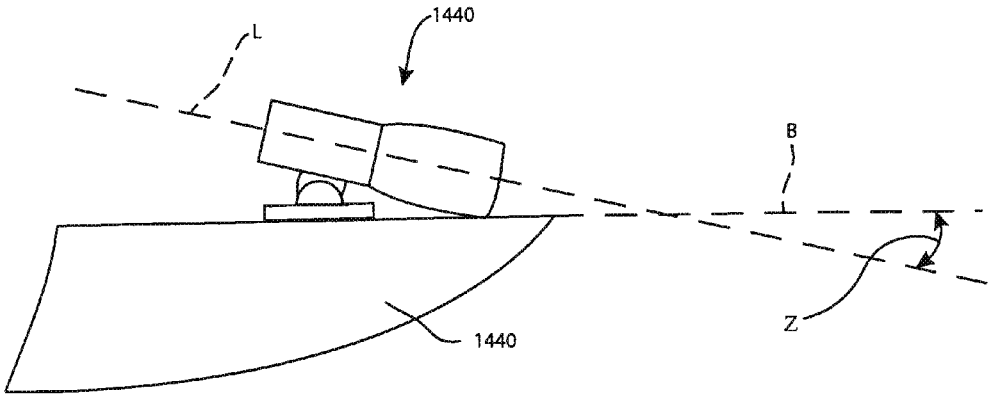
FIG. 74

FIG. 75
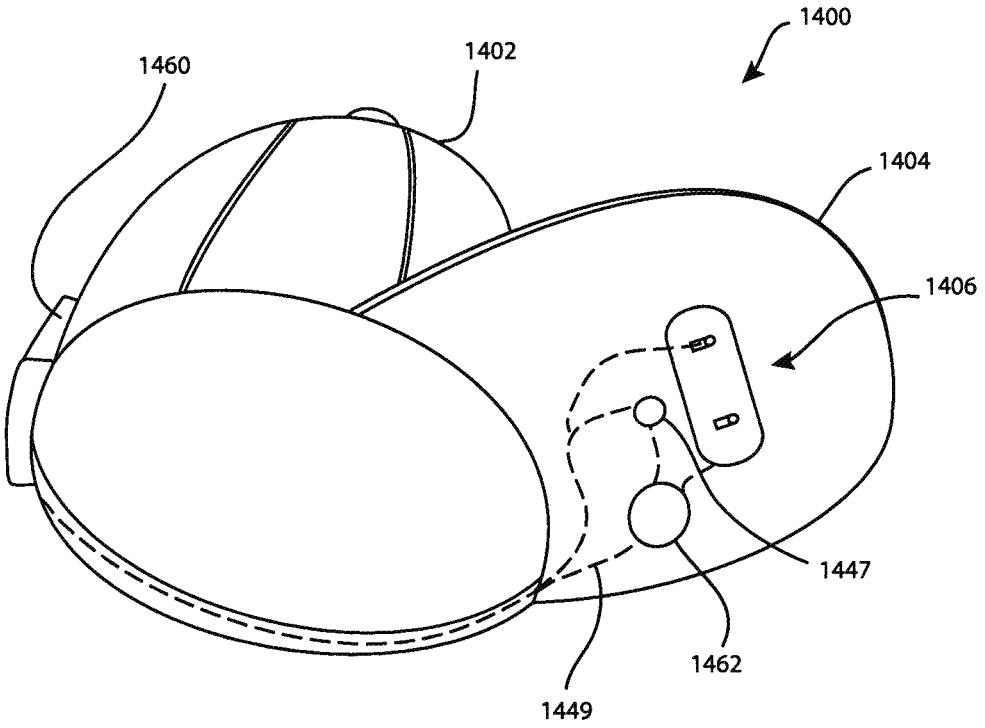
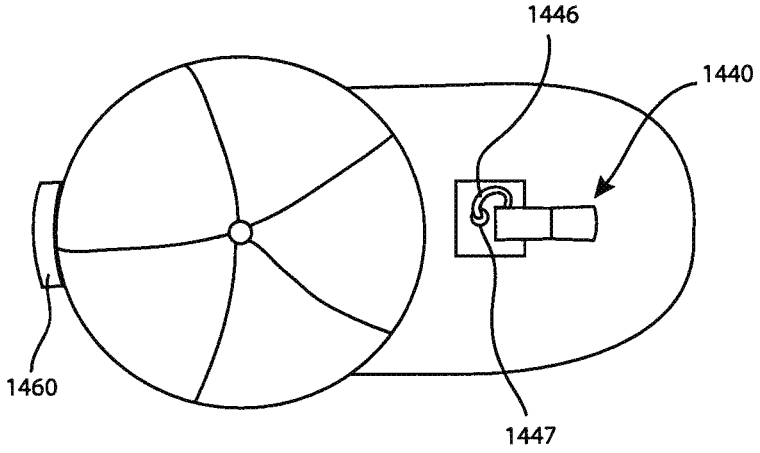
FIG. 76

HEADGEAR HAVING A CAMERA DEVICE

CROSS-REFERENCE TO RELATED APPLICATIONS

This application is a continuation in part of PCT/US12/71469, filed Dec. 21, 2012, which claims the benefit of U.S. Appl. No. 61/580,182, filed Dec. 23, 2011; this application also claims the benefit of U.S. Appl. No. 61/801,838, field Mar. 15, 2013, which are all hereby incorporated by reference herein in their entirety.

FIELD OF THE INVENTION

The field relates to headgear having a camera device mounted thereto and, in particular, to headgear having a camera device mounted to a brim portion thereof for capturing images and/or video forwardly of the headgear.

BACKGROUND OF THE INVENTION

Often an individual desires a light focused to illuminate an area while performing a task or a light directed in a general outward direction for visibility. Holding a flashlight is an option, but such lighting devices are often cumbersome and may detract from the task being completed because the flashlight needs to be hand-held to be able to direct the light at a work site where the user needs illumination. As a result, hands-free lighting is often used because the individual desiring illumination does not need to hold the light source.

Lighted headgear may include illumination sources mounted to various types of headgear and hats. The light can be directed in such a manner so that the wearer is illuminated to be seen by others or directed downward to provide light forwardly of the wearer illuminating an area in the wearer's field of view, such as for reading. Applicant's U.S. Pat. No. 6,659,618 provides examples of such lighted hats. The light source can be one or more LEDs. Such LED lighted headgear, which may include LEDs mounted to a typical baseball-style cap, are convenient for hands-free lighting in a number of recreational activities, such as camping, hunting, fishing, jogging, or the like. Lighted headgear may include separate components such as one housing or assembly to hold a power source and other electrical components and a separate housing or assembly to contain the illumination source. Other lighted hats may contain all electrical components within a crown and/or brim portion of the hat. In each case, the lighted headgear generally includes a user-activated power switch (to energize the light source) positioned on one of the housings or on a portion of the hat.

In many cases, the lighted headgear is displayed on a store shelf in a manner so that a potential purchaser can operate the switch to turn on the light source. To this end, the hat may be provided to the store with a power source already included so that the light source can be activated by the consumer. However, because the lighted headgear may be shipped in bulk to the store with the power source included, the power source can be unintentionally activated through contact of the activation switch with an adjacently packed hat. In particular, where the activation switch is positioned on the hat brim, the light source can be inadvertently turned on during the shipping process by the hat brim of one hat engaging or depressing the activation switch of another hat nested therewith. Such inadvertent activation can drain the power source prior to the hat's display on the store shelf.

Prior packaging arrangements have been configured to allow actuation of a switch to momentarily activate a power source while an item is encased with the packaging, but such prior packaging is generally a blister-type pack that completely encases the product so that it tends to be bulky and distracts from the appearance of the item within the package. Moreover, such prior blister-pack arrangements generally do not include sufficient structure on the packaging to block inadvertent actuation of the switch that might cause power to drain from the battery. Therefore, when these prior packaging designs are shipped in bulk, there is the risk that engagement between adjacent packages could energize the power source and drain the battery.

For example, U.S. Pat. No. 6,311,837 to Blaustein provides a bulky blister pak for an electric toothbrush that allows momentary activation of the toothbrush while within the packaging material by permitting a power switch to be depressed momentarily, but attempts to block continuous actuation of the power source by hindering the sliding of the switch to a permanently on position. To this end, Blaustein permits the momentary depressing of its power switch by relying on the flexibility of the blister pak material covering the switch that can easily deform to allow the switch to be depressed, but then includes a single and narrow rib adjacent one side of the momentary switch to prevent the sliding action of the switch to the continuously on position.

Blaustein's single rib is designed primarily to block the activation switch from shifting or sliding in a direction along the shaft of the toothbrush to prevent the switch from being shifted to the continuous on position. Although this packaging arrangement may be effective to prevent the switch from being slid to the continuously on-position, the blister pak has a relatively flexible material surrounding the switch in order to permit the momentary actuation of the switch. Therefore, inadvertent actuation may still occur when multiple items having this packaging arrangement are stacked atop one another. When sufficient items are tightly packed in a box or other shipping crate, a force between packed items may be sufficient to deform of the thin blister pak material covering the switch to depress the switch to the momentary on position. Therefore, Blaustein's switch can be inadvertently depressed to the momentary on position and the power source drained.

Other accessories have also been mounted to headgear to generally enable some aspect of hands-free operation of such accessories. In this regard, the individual's hands are free to complete other tasks while the accessory is being used. For example, cameras, binoculars, as well as other accessories have been mounted to headgear in order to allow the use of the accessory generally without requiring the use of ones hands. However, prior hat and accessory configurations tend to be bulky and also detract from the traditional style of the headgear.

In some instances, the lighted headgear may contain illumination sources, such as powerful LEDs, that release relatively large quantities of heat during operation. In order to protect the components of such an LED lighting system it is advantageous to dissipate the heat generated during light operation. Unfortunately, current heat sinks configured for use with compact light sources such as LEDs tend to be large and bulky and require relatively large flat surfaces to which the heat sink is mounted. In addition, prior heat sinks and LED configurations tend to be relatively thick and rigid which can limit their positioning on some headgear designs, such as baseball type hats or caps. Therefore, mounting a heat sink to an LED on a lighted hat tends to increase the thickness and bulk of the profile of the hat, and particularly the brim thereof from its normal more desired appearance.

Lighted headgear may include activation switches that are operable to establish electrical communication between the power source and the illumination source. The illumination source can be energized once the activation switch is depressed, slid, or otherwise shifted to an on position. For example, it is known to place a push button switch underneath the fabric covering the rigid brim material. However, many activation switches tend to be large and bulky and they do not allow the hat to maintain its normal more desired appearance because the switch provides bulges or other bumps in the profile of the hat.

Other headgear configurations include a power source contained in a rigid battery holder. In some cases, such rigid holder is placed within a lower sweatband area of the crown portion of the headgear that encircles a wearer's head. Because of the rigid configuration of the battery holder, the headgear can be uncomfortable for the wearer because the battery holder generally does not conform to the curved shape of the headgear. Alternatively, loose batteries can be placed in a pouch or other pocket contained within the headgear, but such loose configuration of the batteries can place strain on the wire connection to the battery that can eventually fail after repeated use of the hat due to repeated bending of the connection.

Additionally, an individual can use a camera to record pictures or video. In order to take a picture, a user often has to hold the camera in a position where the user can see what the camera is focused on, steady the camera, and record the desired pictures or video. Holding the camera in a steady forward position to obtain a clear and non-blurry image can be difficult for a user. In such cases, a user can position the camera on a tripod to hold the camera steady during use. This, however, requires that a user carry the bulky tripod around in addition to carrying the camera. Similarly, when recording video, a user must hold the camera in a position where the user can see the live feed and must hold the camera steady to obtain clear video.

Camera manufacturers have recently been developing and marketing 3-dimensional (3D) cameras with two lenses on a front face thereof. The two lenses are configured to capture images or video, which can be combined to produce a 3D end product. Such cameras suffer from the same disadvantages as discussed above because a user still carries the camera and must hold it steady in a forward position or position the camera on a tripod to capture good quality images. The illusion of depth provided by 3D images and videos is impacted by the spacing between the two lenses, which provides two different perspectives for the combination. Additionally, hand-held cameras have steadily decreased in size to increase the camera's mobility and ease of storage. Such small housings, however, would limit the amount of available spacing between the lenses and therefore limit the 3D effect of end product images and video.

SUMMARY OF THE INVENTION

There is provided headgear having a camera device mounted thereto. The headgear is preferably baseball-type caps or other hats or clothing items. The headgear may also include various accessories for use therewith, such as a flash for the camera device, different configurations to dissipate heat generated from the camera device or a high powered light source, switches that are concealed within the headgear to maintain the normal appearance of the hat, protective guards for an activation switch to prevent inadvertent activation thereof, and a battery module configured to power the lighted hat while maintaining its natural and streamlined appearance.

In one aspect, the headgear is a baseball-type hat where a plurality of LEDs are mounted on a brim thereof to provide outward illumination to at least two different distances from the hat. In one form, the LEDs are configured to project outward illumination to the different distances by using LEDs having two different predetermined light cones. In such form, one LED has a wider light cone for providing illumination at closer working distances to the hat while another LED has a narrower light cone for providing illumination at working distances further away from the hat. In another form, the LEDs can be mounted on the brim and disposed to provide outward illumination at varying angles. In this form, one or more LEDs can be mounted to direct illumination substantially parallel to the brim for providing illumination to areas that are at distances far away from the hat, and another LED can be mounted inclined to the brim to project illumination close to the hat. Such LED lighted hats provide for directed illumination either close working distances, such as a reading distance of about 24 to 30 inches in front of a wearer or a working distance much farther from the wearer without the need of a dimmer switch. To this end, the lighted hats herein also provide for illumination close to and far away from the wearer having generally the same intensity of light where the prior hats using dimmer switches have varying intensity depending on the position of the dimmer switch. A camera lens device can be mounted to the headgear in a similar fashion as discussed with respect to the various LED arrangements and configurations discussed herein.

In another aspect, the headgear includes a camera accessory mounted to the brim. In one form, the camera accessory can be configured so that the user can operate the camera while keeping their hands free to perform other tasks. The lighted headgear/camera accessory also includes one or more LEDs mounted along the brim at a predetermined distance from the camera and synchronized to energize with the camera to provide a flash for the camera. In order to eliminate the red eye effects that commonly occur when a photograph is taken, the LEDs are preferably mounted a predetermined distance is that relatively far away from a lens of the camera such as positioned on the outside edges of the hat brim at the arcuate portions of the hat brim. By one approach, the LEDs are mounted on opposite sides of the hat brim while the camera lens is mounted centrally on the brim. By positioning the LEDs on the edge of the hat brim with the camera lens centrally positioned on the brim, the effects of red eye can be minimized.

By another approach, the headgear with the camera accessory can further include a control panel. The control panel is disposed on the brim to provide controls for operation and use of the camera. For example, the control panel can include a switch to send control signals to the camera, a switch having different conditions for various operational states of the camera, a connection device to download images or pictures and/or video generated by the camera and charge a power source mounted to the headgear, a status indicator, or the like. The control panel can further include a circuit board in combination with the above components.

In another form, the lighted headgear/camera combination can also include a camera viewfinder that is in electrical communication with a lens of the camera to provide an image from the camera lens. Preferably, the viewfinder is pivotally mounted on an underside of the hat brim so that when the camera is not in use it can be rotated along a pivot axis adjacent to or flush with the under side of the brim. When in use, the viewfinder can be pivoted downwardly in the wearer's line of sight so the wearer can aim the camera and view an image of what the camera lens is focused on.

In another aspect, the lighted headgear includes a relatively thin and flexible heat sink in combination with a generally rigid or flexible circuit board. In one form, the heat sink and circuit board combination is preferably configured to be used with a surface mount LED and/or a camera device and the lens device thereof, mounted to an outboard edge, upper, and/or lower surfaces of the hat brim. The relatively thin and flexible heat sink is a thermally conductive material that is in contact with the light source and/or camera device in order to dissipate the heat that is generated by operation thereof. The relatively thin and flexible heat sink provides advantages over the large and thick prior heat sinks because it can conform to the curvature of the hat brim and/or be bent over an edge of the brim in order to be in direct contact with a surface mount LED mounted to the brim edge and still provide heat dissipation at the same time. Preferably, the circuit board is in electrical communication with a power source and the light source and/or camera device and can be disposed on the brim of the hat and connected to the relatively thin and flexible heat sink in a way that reduces the profile of the lighted hat. In one form, both the circuit board and heat sink are bent over the outboard edge of the hat brim. In this regard, both the heat sink and circuit board can be directly in engagement with the LED on the brim outboard edge, which avoids wiring other connections therebetween simplifying assembly of the hat.

In yet another aspect, the lighted headgear has a rotary switch located along a brim edge and positioned between upper and lower portions of the brim fabric used to cover the brim. Preferably, the rotary switch is disposed on the hat in a manner that maintains the natural streamlined appearance of the brim. The rotary switch can be configured to energize, de-energize, or change the illumination intensity of the light source by turning the switch about its rotary axis. The rotary switch can further be configured to changes modes of the lighted headgear. By one approach, the rotary switch can include a push button mechanism so that the switch can be turned and pushed and depressed. The rotary switch can also be utilized to operate the camera device, such as by be configured to operate the camera device upon depression thereof and/or operate a zoom function of the camera device by rotation thereof.

In another aspect, the headgear can be in the form of a sweatshirt or another garment that includes a hood portion and a hat portion with a brim. Preferably, the brim includes a light source and/or a camera device, a power source, and an activation switch all incorporated in a single removable module. The hat portion can be fixed to the hood portion or the hat portion and/or the brim can be removably mounted to the hood portion via a mount mechanism. By one approach, an attachment mechanism between the hat portion and the hood portion can be a zipper, Velcro, snaps, magnets, buttons, pins, adhesives, and other fasteners that provide a detachable connection between the hat and hood portions. By having the electrical components on a removable module or removable hat portion, the electrical components can be removed for washing of the hood portion of the garment.

In yet another aspect, the headgear includes a relatively flexible battery module or holder that includes at least one battery receptacle and a flexible portion for electrical wiring that is electrically connected to a battery held in the receptacle therefor. The battery module is disposed toward the side or back of the lighted hat in a manner that allows the hat to maintain its natural appearance without unsightly projections or bulges due to components of the lighting system mounted therein. Preferably, the flexible portion of the battery holder is a base portion having at least one elongate flexible portion to allow the module to conform to the curvature of the hat and at least one more rigid portion to provide stress relief at an electrical connection between the battery connections and the electrical wiring thereto. In a preferred form, the base portion is overmolded with resilient materials onto the receptacle so that the flexible and more rigid portions are one integral molded piece. The flexible portion is provided with greater flexibility than the rigid portion at which the wires connect to the battery by cut-outs formed in the annular body of the flexible portion. The battery holder, therefore, permits the module to bend in order to conform to the curvature of the hat via the flexible portion but, at the same time, has rigid sections to provide protection to the electrical connection between the battery and the wiring.

In yet another aspect, the headgear includes a removable brim sleeve that may be mounted to a brim portion of the lighted headgear so as to provide protection against inadvertent actuation of a light switch associated with the lighted headgear. Preferably, the brim sleeve will include a thin cardboard, paperboard, or other fiberboard packaging cover or body capable of being detachably mounted to a brim of the lighted headgear. An upper portion of the brim sleeve body is configured to extend across and substantially cover a top portion of the lighted hat brim and is connected to at least one lower portion of the brim sleeve body, which is configured to extend along a bottom surface of the lighted hat brim between opposite brim side edges thereof. Such a configuration provides a packaging cover that forms a sleeve about the brim that generally conforms to the upper and lower brim surfaces so as to maintain a thin profile having a curvature similar to that of the brim surfaces. This configuration of the brim sleeve provides a packaging surface for indicia or other cap identification, but is not bulky and generally does not distract from the hat's appearance because it configured to conform to the curvature of the upper and lower brim surfaces. In addition, such compact and conforming configuration of the brim sleeve relative to the hat brim also enables a consumer to try on the hat in the store because the brim sleeve does not interfere with the crown or other head wrapping portion of the hat.

The headgear also includes an actuation switch used to actuate the light source and/or the camera device mounted to the headgear. The actuation switch may include a variety of forms and be positioned in a variety of locations on the hat. In one example, the actuation switch is disposed on the lower brim surface and has a button or plunger actuator extending away from the brim surface that is configured to be depressible toward the brim such that the light source may be actuated to an "on" or "off" state by depressing the button or plunger actuator towards the brim. A user may depress the button or plunger actuator to actuate the lighted headgear to its on-state, which may include a number of alternative lighting modes (blinking, colors, varying number of light sources energized, etc.) selected by repeatedly depressing the button to select the modes of the on-state. The light source will remain in the on-state (or selected lighting mode) until the user again depresses the plunger actuator causing the switch to configure the lighted headgear to an off-state.

The brim sleeve may also include a protection or switch guard adjacent to or extending around the actuation switch. For example, at least one lower portion of the brim sleeve body may have the switch guard associated therewith that is configured to extend about the actuation switch so as to avoid inadvertent actuation thereof. The switch guard may be a portion of the cardboard body or be a separate plastic piece mounted to the cardboard or paperboard portion of the brim sleeve via a mounting flange and a mating surface. In a preferred form, the switch guard is a molded plastic material having an upstanding flange or wall portion that, when mounted to the hat brim, extends away from the brim surface beyond the plunger actuator to serve as a barrier for avoiding unintentional actuation of the actuation switch. The upstanding flange or wall portion may generally encircle the activation switch, but still has an access opening associated with the button or plunger actuator thereby providing direct and intentional access to the switch. In one form, the actuation switch is a push button switch, which may be provided in the form of the rotary switch, as described above.

Many hats may be manufactured at the same facility and transported from the facility to a retail store for consumer purchasing in a shipping box or other crate. A convenient way to transport such lighted hats is to place a plurality of lighted hats in a nested configuration where the individual hats within the plurality of lighted hats stack atop one another such that a crown of a lower lighted hat is inserted into a crown of an upper lighted hat while a brim of the lower lighted hat overlaps at least a portion of a brim of the upper lighted hat. This nested configuration allows for convenient and efficient transportation of the plurality of lighted hats. In order to prevent inadvertent actuation of an activation switch associated with any of the individual hats within the plurality of lighted hats, an insert spacer device is provided that is positioned between the nested brims of adjacent hats. For example, the insert spacer device may be positioned between the brim upper surface of the lower hat and the brim lower surface of the upper hat. The spacer device is then arranged and configured to maintain a space between the two hat brims so that the switch on the lower surface of the upper hat remains spaced from the upper brim surface of the lower hat when the hats are in a nested arrangement.

In one form, the insert spacer device may include the above described brim sleeve and switch guard to prevent the inadvertent actuation of the corresponding activation switches associated with each of the individual hats when in the nested arrangement. In particular, each hat will include an associated brim sleeve surrounding its brim with the associated switch guard extending about its activation switch. These switch guards will also preferably have an upstanding flange or wall portion that encircles the activation switch to avoid inadvertent actuation of the activation switch by any of the other individual hats within the plurality of lighted hats in the nested configuration.

3D camera headgear and accessories therefor is also provided. The 3D camera headgear provides a user with a camera device that captures media, such as videos and/or images, from two slightly different perspectives, which can subsequently be combined to create 3D media that provides an illusion of depth.

As such, the headgear can include a camera device mounted to a brim or crown portion thereof. In one form, the camera device is configured so that the user can capture media while keeping their hands free to perform other tasks. The hat can also include one or more light sources mounted thereto, such as along an edge of the brim, on upper or lower surfaces of the brim, or on a portion of the crown. The light sources can be configured to operate independently of the camera device to provide illumination for a wearer of the hat. Alternatively or in combination therewith, the light sources can be configured to energize upon operation of camera device, when needed or desired, to provide illumination for capturing media forwardly of the hat.

More specifically, a 3D camera device is mounted to the head-fitting portion or the brim portion and includes first and second lens devices. The first and second lens devices are preferably positioned on substantially the same horizontal axis, but spaced apart from one another. The headgear further includes a power source electrically coupled to the 3D camera device and configured to provide power to the 3D camera device for operation thereof. An actuation device, such as a switch device, is mounted to the headgear for operative control of the 3D camera device. More particularly, the actuation device operably couples to the 3D camera device such that actuation thereof causes the first and second lens devices to operate substantially simultaneously. The 3D camera device can operate to capture images and/or video, as desired.

By one approach, the first and second lens devices are disposed in a forward edge of the hat brim. In such a form, the lens devices are positioned at least partially within a brim insert to be capable of capturing media forwardly of the hat. In another approach, the first and second lens devices are mounted on the hat brim adjacent to upper or lower surfaces thereof, while also being positioned to capture media forwardly of the hat. With regard to the lens devices being mounted adjacent to the brim lower surface, the brim and the natural curvature thereof (if included) can protect the lens devices from physical damage when the hat is dropped, exposed to the elements, or the like.

Moreover, the hat can further include a control panel, such as the control panel described above, disposed on the brim or crown portion to provide controls for operation and use of the 3D camera device and other electronic hat components, if desired. The control panel can further include a circuit board in combination with the above components. Pursuant to this, the headgear can include a heat sink, which can be relatively thin and flexible, to dissipated heat generated by the circuit board, light sources, 3D camera device, and/or other powered components of the hat. The relatively thin and flexible heat sink is a thermally conductive material that is in contact with the camera device or other powered component in order to dissipate the heat that is generated by operation thereof.

The hat can further include a viewfinder or display, such as that discussed above, that is in electrical communication with one or both of the first and second lens devices of the camera device to provide an image from the camera lens. Preferably, the viewfinder includes a configuration so as to be viewable to a wearer of the headgear to allow the wearer to aim the camera device and view an image of what the camera lens is focused on or view an image or video that the camera device previously recorded.

In general, the various aspects of the invention herein relate to headgear having a 3D camera device mounted thereto, components thereof, and other accessories therefor. In addition, while the preferred headgear is a baseball-type cap, the camera device, components thereof, and accessories therefor may also be mounted to any suitable headgear, such as visors, helmets, caps, hats, headbands, sweatbands, hoods, clothing, or the like.

Camera devices for attachment to a brim of a hat are also described herein. In one form, the camera device includes a housing that has a forward surface, a rear surface, and top and bottom surfaces extending therebetween. A lens device is mounted to the forward surface so that the camera device is configured to capture media forwardly thereof, such as pictures and/or video. A clip device is mounted to the top or bottom surfaces of the housing so that the top or bottom surface respectively extends generally along the hat brim when the camera device is mounted to the hat brim. The housing surface mounted to the brim can advantageously have a concave curvature so that it can generally conform to a natural curvature of the hat brim to maintain the streamline appearance of the hat. The camera device can further include a display mounted thereto, such as to the top or bottom surface, whichever is opposite to the clip device so that a wearer of the hat can view media captured by the camera device. The display can be pivotable with respect to the camera device housing, such as about a hinge, so that the display can be pivoted into a line of sight of the wearer.

In another form, a camera device includes a housing with a front surface and a rear surface, with top, bottom, and side surfaces extending therebetween. A lens device is mounted to the front surface so that the camera device can capture media forwardly thereof. The camera device further includes tabs that project outwardly from the housing side surfaces adjacent to the top surface. The tabs can advantageously be inserted into prongs mounted to the hat brim to pivotably mount the camera device to the hat. As such, the camera device can be pivoted between a storage position with the housing extending generally along the brim and a use position extending generally transverse to the brim. The tabs can include radial flat portions thereon to keep the camera device from freely pivoting to hold the camera device in the desired position. Alternatively, the connection between the camera device and the hat brim can be spring loaded so that the camera is forced toward the hat brim to hold the camera device in the stored position until the camera device is manipulated a sufficient distance towards the use configuration that effectively disengages the spring force and allows the camera device to remain in the use position.

BRIEF DESCRIPTION OF THE DRAWINGS

FIG. 26 is a bottom plan view of a brim of a hat showing a camera device including first and second lens devices at a front edge thereof in electrical communication with a control panel and a power source;

FIG. 30 is a cross-sectional view of a brim of a hat showing a camera device in electrical communication with a control panel and a heat sink adjacent thereto;

FIG. 31 is a cross-sectional view of a brim of a hat showing a camera device in electrical communication with a control panel and two heat sinks on either side thereof;

FIG. 51A is a bottom plan view of a brim portion having a lens housing mounted thereto showing an alternative sighting mechanism having frames connected by an arm in a stored position adjacent to the brim portion;

FIG. 51B is a front elevational view of the brim portion of FIG. 51A showing the alternative sighting mechanism pivoted to the stored position;

FIG. 52 is a cross-sectional view of a pivoting mechanism for a sighting mechanism mounted to a brim portion of a hat showing a spring engaging a block portion to hold the block portion in a use position so that the sighting mechanism is in a hat wearer's field of view;

FIG. 53 is a cross-sectional view of the pivoting mechanism of FIG. 52 showing the spring engaging the block portion to hold the block portion in a stored position so that the sighting mechanism is pivoted out of the field of view of the hat wearer;

FIG. 68 is a side view of a lighted hat having a pivotably adjustable upper light device mounted to the brim and adjusted to direct light at a downward angle of inclination relative to a fore-and-aft axis of the brim;

FIG. 69 is side cross-sectional view of the lighted hat of FIG. 68 showing the upper light device mounted above the brim and a lower light source mounted below the brim, with the upper light device adjusted to direct light at an upward angle of inclination relative to brim axis;

FIG. 70A is a side cross-sectional view of a light housing assembly of the adjustable upper light device;

FIG. 71 is a perspective view of a hinge base that is a portion of the adjustable upper light source;

FIG. 72 is a perspective view of the light housing assembly of FIG. 70;

FIG. 73 is a side cross-sectional view of the hinge base of FIG. 71 mounted to the brim;

FIG. 74 is a side view of the adjustable light device of FIG. 68 pivoted downwardly so that the it contacts the brim of the hat;

FIG. 75 is a bottom perspective view of the hat of FIG. 68 showing electrical connections between the lower light source mounted to the brim, a switch mounted to the brim, a power source mounted to the crown portion of the hat, and a hole in the brim through which the electrical connections of the upper light source extend;

FIG. 76 is a top plan view of the hat of FIG. 75 showing an electrical wire extending through the hole and connected to the upper light source;

DETAILED DESCRIPTION OF THE PREFERRED EMBODIMENT

Figure 1:
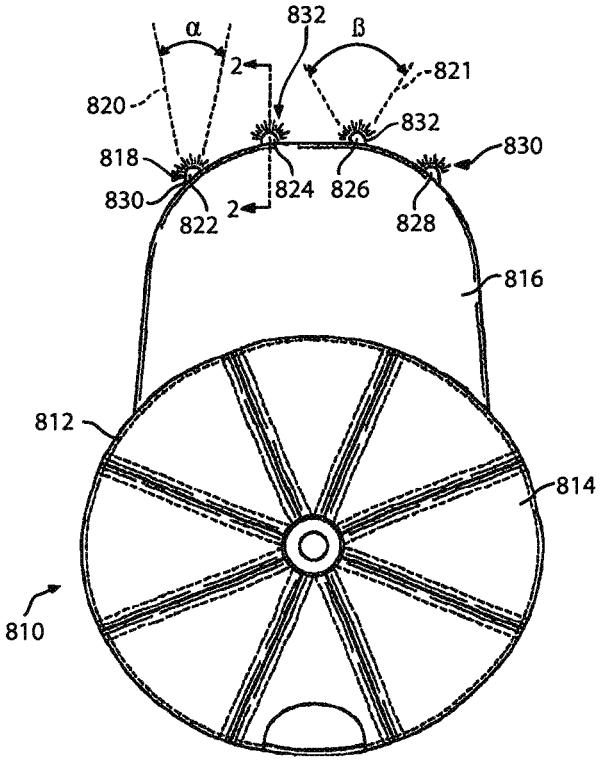
FIG. 1 is a plan view of a lighted baseball cap showing LEDs having a narrow light cone and LEDs having a wide light cone.

In general, the various aspects of the invention herein relate to hands-free lighting, components thereof, and other accessories therefor combined with the hands-free lighting. As further described below, the hands-free lighting may include lighted headgear such as hats, including baseball caps, hoods, and other lighted clothing items having the lights positioned thereon to provide lighting forwardly of the wearer. The hands-free lighting include configurations to provide illumination in multiple directions, streamlined configurations to dissipate heat generated by the light source, multi-functional switches concealed in the headgear, and robust power source holder configurations that generally reinforce connections to the battery yet still permit some flexibility of the power source holder. Other accessories associated with the lighted headgear include a camera mounted to headgear having a flash thereon configured to reduce the effects of red eye, removable packaging materials with a protective guard that limits inadvertent actuation of a switch to energize the lights of the lighted headgear, or a relatively flexible battery holder coupled to the lighted headgear in a streamlined manner.

A first embodiment of hands-free lighting having a light source configured to direct light in multiple directions is illustrated. In general, the lighted hat and other headgear described herein include a variety of different illumination sources, which are preferably LEDs, mounted at different locations on the hat. To energize these illumination sources, a variety of different power assemblies can also be used that employ varying mechanisms to generate energy. For instance, as disclosed in Applicant's U.S. application Ser. No. 11/941,558, which is incorporated herein in its entirety, the power sources may include power generators that use renewable energy, such as solar, wind, or kinetic energy, or various battery configurations in order to generate electrical power that ultimately energizes the variety of light sources that may be included on the disclosed hats. While the following description and illustrations may describe a conventional battery power source, renewable power generators as described in the '558 application may also be included in the hat embodiments. In addition, while the preferred headgear is a baseball-type hat or cap, the power assemblies and illumination sources may also be mounted to any suitable headgear, such as visors, helmets, headbands, hoods, or the like.

In addition, headgear with a camera device attached thereto is described which allows a user to operate the camera device without requiring the user to hold the camera device or have a separate structure, such as a tripod or the like, to hold the camera device steady while taking pictures and/or video. The headgear is conveniently mounted or secured to the headgear while substantially maintaining the streamlined appearance thereof.

By one approach, the camera device includes a pair of camera lens devices spaced from one another, such as along a horizontal axis extending in a lateral direction across a hat brim. The lens devices can be configured to operate substantially simultaneously to take pictures and/or video in the spaced apart configuration. This operation captures media of the substantially the same target from slightly spaced perspectives. The spaced perspectives of the pair of camera lens devices can then advantageously be utilized to provide 3-dimensional (3D) media.

For example, the media captured by the two lens devices can be superimposed over one another with differently colored filters applied to each perspective, preferably chromatically opposite colors, such as red and cyan. The user can then view the superimposed picture or video while wearing glasses with lenses corresponding to the differently colored filters to see the media in 3D. Another method utilizes superimposed media along with the use of polarized or shutter-type glasses. Yet another method for producing 3D pictures is placing the spaced perspectives in a side-by-side relation and viewing the pictures in a cross-eyed manner until the pictures can be viewed in an overlapped state, which gives the viewer a 3D perspective.

Figure 2:
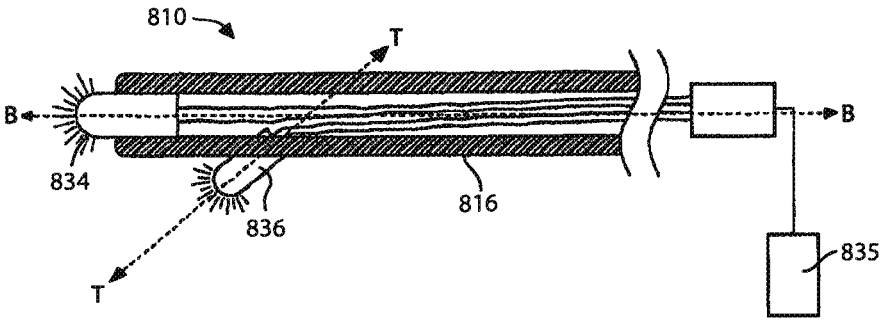
FIG. 2 is a cross-sectional view of a brim for a lighted baseball cap showing LEDs disposed on the brim to project light along different axes.
Figure 3:
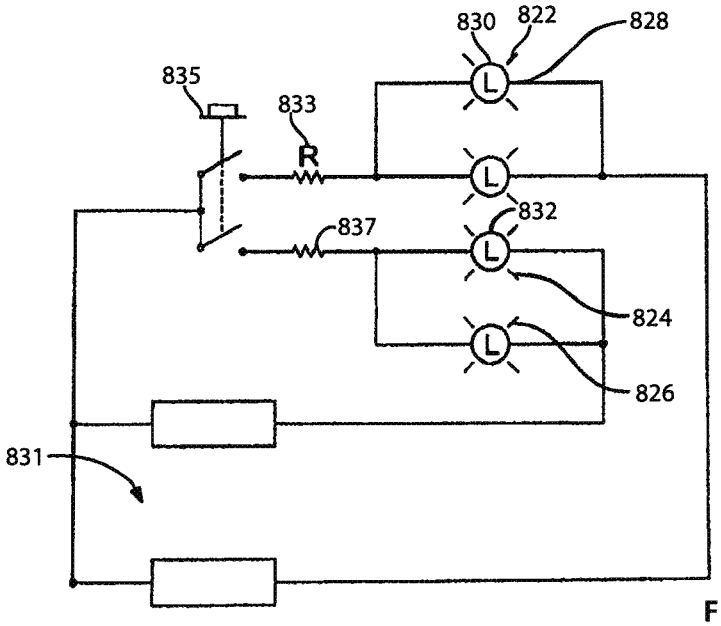
FIG. 3 is an exemplary circuit diagram of the electrical components for a lighted baseball hat including a switch that is in electrical communication with a power source and two sets of LEDs.

Referring to FIGS. 1-3, an exemplary lighted hat 10 is illustrated embodying light sources 18 configured to illuminate in multiple directions. The hat 10 is illustrated as a baseball-type cap having a crown 14 and a brim 16 projecting forwardly from a lower, forward edge portion of the crown 14. The cap can include fabric material that cooperates with shape-retentive members for maintaining a desired configuration of the crown 14 and brim 16. In this embodiment, the hat 10 is designed to provide illumination from the light sources 18, which are generally configured to focus illumination at a variety of different distances from the hat 10. Previous hat designs typically included dimmer switches that vary the intensity of the illumination; however, such dimmer switches do not vary the angle or direction of the illumination while maintaining the same degree of illumination intensity. As further described below, the lighted hat 10 can illuminate objects at various distances or positions while maintaining the same illumination intensity. By one approach, the hat 10 includes the light sources 18 configured to provide illumination with various light cone angles 20. In another approach, the hat 10 has the light sources 18 mounted on the brim 16 to project lights along different axes.

Referring to FIG. 1, the plurality of light sources 18, preferably LEDs, can be configured and disposed on the hat 10 to provide forward illumination. In this illustration, light sources 22, 24, 26, and 28 spaced from each other along the outer edge or perimeter 29 of the brim 16 exemplify this embodiment. Preferably, one or more of the light sources 18, such as the light sources 22 and 28, are configured for illumination to a working distance away from the wearer, such as high beam lights of an automobile. In this regard, LEDs 22 and 28 can be considered high beam light sources 30. In addition, one or more of the light sources 18, such as the light sources 24 and 26, are also configured for illumination a working distance close to the wearer, such as low beam lights of an automobile. In this regard, LEDs 22 and 28 can be considered low beam light sources 32. In one instance, the working distance of the low beam light sources 32 is within a wearer's reading distance, such as between 24 to 30 inches from the light source 32 on the hat. The working distance for the high beam light sources 30 is outside or beyond the reading distance, which in some cases can be four to six feet from the hat 10.

By one approach, the high beam light sources 30 can provide illumination a distance from the wearer through an LED having a light cone 20 of a relatively narrow angle $\alpha$ to provide a concentrated beam of light that can be projected a distance from hat 10. In one form, the angle $\alpha$ is approximately about 15 to about 25 degrees, and preferably about 20 degrees. In other cases, the light beam is about 40 degrees.

The low beam light sources 32 are configured to project illumination close to the wearer such as to provide illumination for reading by providing an LED having a relatively wide light cone 21 of angle β. In one form, angle β is about 30 degrees to about 60 degrees and preferably about 40 degrees to about 60 degrees. In this manner, the high beam of light 20 comprises a smaller width cone angle α to allow illumination upon objects located at distances further away from the wearer, and the low beam of light 21 comprises a larger width cone angle β to expand the close range field of light and allow illumination upon objects that are located closer to the wearer.

In one embodiment, both the high beam 30 and low beam 32 light sources can be configured with a switch or device that may allow the wearer to select either the high beam light source 30 or low beam light source 32, as generally shown in FIG. 3. The switch or device 35 may be used to establish electrical communication between a power source 31 and the high beam light source 30 and/or the low beam light source 32 light and can be used to control the various light sources 22, 24, 26, and 28 at once or each light source individually and independently from another. When the switch 35 is closed to a first position, the power source 31 electrically energizes the high beam light sources 30 via a resistive load 33. The resistive load 33 restricts the flow of electric current by producing a voltage drop that occurs across the resistor 33. In turn, the resistive load helps create the illumination of the light source through an increased voltage pursuant to Ohm's law of V=IR. When the switch 35 is closed to a second position, the low beam 32 light source is electrically connected to the power source 31 via a resistive load 37.

Referring to FIG. 2, an alternative form of a high beam/low beam lighted hat is illustrated. In this embodiment, the brim 16 of the lighted hat generally extends a fore-and-aft direction along a brim axis B, and the lighted hat 10 has at least one light source 34 positioned to direct light generally along the brim axis B and at least one light source 36 disposed on the brim 16 and configured to direct light transversely relative to the brim axis B such as along an axis T that extends transverse to the brim axis B. In this embodiment, the light sources 34 and 36 are configured to illuminate objects in areas that are different distances away from the hat. For example, the light source 34 along the brim axis B will provide illumination upon an object or a location at a distance relatively far away from the wearer (i.e., such as approximately four to six feet from the wearer), and the light source 36 inclined to the brim axis B along the transverse axis T will provide illumination upon an object or a location at a distance closer to the wearer (i.e., at a reading distance such as 24 to 30 inches) without requiring the wearer to shift his head in any given direction. The light sources 34 and 36 can have similar light cones, or can also have the narrow and wide light cones 20 and 21 as described above.

Figure 2A:
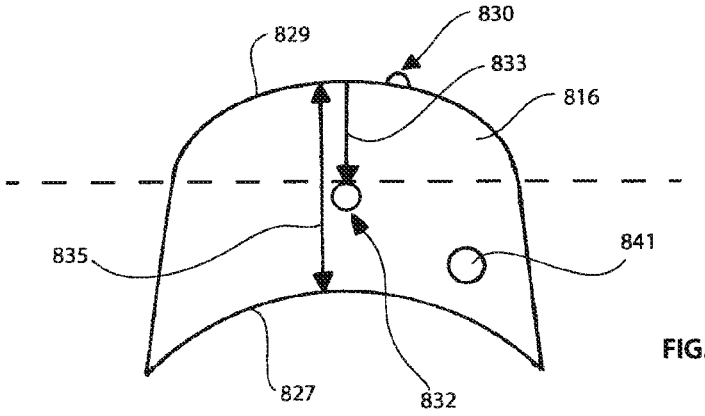
FIG. 2A is a schematic bottom plan view of a brim portion for a hat showing a first light source mounted at a forward edge of the brim portion and a second light source mounted to a lower surface of the brim portion spaced from the forward edge thereof.
Figure 2B:
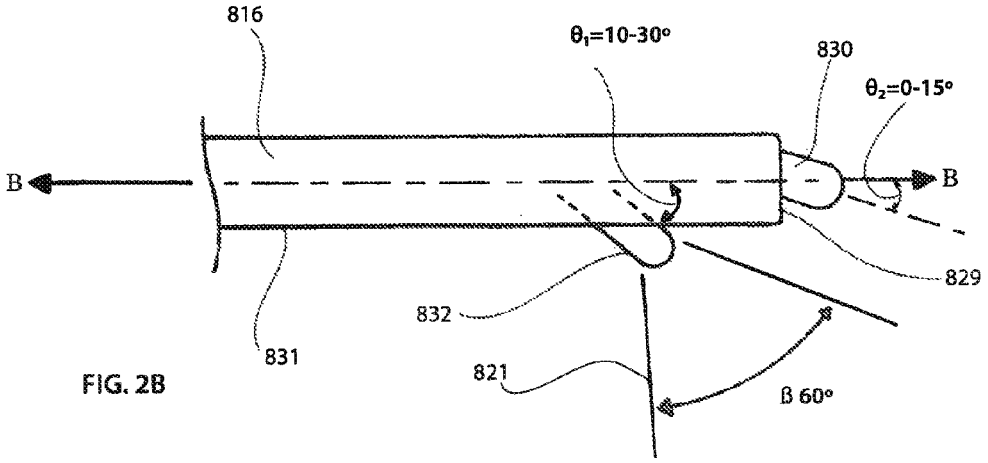
FIG. 2B is a side elevation view of the brim portion of FIG. 2A showing the first and second light sources oriented to project light long different axes.

Referring now to FIGS. 2A and 2B, another alternative form of the high beam/low beam lighted hat is shown. In this form, the hat includes at least one high beam light source 30 mounted to a perimeter edge 29 of the brim 16, which may include a relatively narrow cone of light 20 such as a 20 to 40 degree light cone. The hat also includes the second or low beam light source 32 (a so called "look down" light source) mounted on the hat brim 16 remote from the perimeter edge 29, such as on a lower major surface 31 of the brim 16 as best shown in FIG. 2A. To this end, the low beam light source 32 may be mounted on the lower major surface 31 of the hat brim 16 and spaced rearwardly from the brim front edge 29 a distance 33 approximately halfway, and preferably more than half the fore-and-aft distance 35 between the front edge 29 and rear edge 27 of the hat brim, as shown. This position of the low beam light source 32 is advantageous because it directs light within a wearer's field of view to illuminate within a reading distance but at the same time avoids directing light towards other near the hat wearer, which can disadvantageously shine into other's eyes causing irritation and temporary blindness.

By one approach, the low beam light source 32 mounted on the lower surface 31 is canted at an angle θ1 relative to an axis B extending through the hat brim 16 so that the low light beam 21 is directed forwardly of the hat brim 16 to illuminate an area relatively close to the hat brim. Preferably, the cant angle θ1 is about 15 to about 30 degrees, and most preferably about 20 degrees. More particularly, the low beam light source 32 is a 50,000 MCD light emitting diode having a 60 degree light cone, and as discussed above, has the cant angle θ1 from the brim axis B of about 20 degrees. As mentioned, by mounting the low beam light source 32 away from the brim perimeter edge 29 and canting the light forwardly, the direction of the low light beam 21 does not shine in the direction of others near the person wearing the light hat. Advantageously, such canting of the low beam lights 32 illuminates areas adjacent the wearer in their field of view (i.e., reading distance), but does not blind others near the hat wearer.

The high beam light source 30 is positioned to extend from the perimeter edge 29 of the hat brim 16 to direct light forwardly of the wearer. By one approach, the high beam light source 30 may also be canted relative to the brim axis B at a cant angle θ2, but is canted over a smaller angle θ2 than the low beam light 32. For example, the high beam light may be canted 0 to about 15 degrees downwardly from the axis B. More specifically, the high beam light 30 may be a 20,000 MCD light emitting diode having a 40 degree light cone that is canted downwardly from an axis B extending through the hat brim 14 about 15 degrees.

The hat may include multiple high beam or low beam light sources on the hat brim. By one approach, the lighted hats may have at least two LEDs spaced from each other on opposite sides of a centerline of the hat brim, such as provided in Applicant's U.S. Pat. No. 6,659,618, which is incorporated herein in its entirety. By having two spaced LEDs on either side of the brim center line, the lighted hats may provide enhanced illumination with sufficient lighting of an area to be illuminated. By positioning the light source away from the hat's centerline and maintaining the spacing of the LEDs from each other on the brim, the hats herein offer enhanced depth perception of an area to be illuminated because the illumination from the spaced LEDs provide well defined shadows and texture to the object being illuminated.

The high beam light source 30 and low beam light source 32 are spaced from each other. To this end, the lights 30 and 32 are mounted on different portions of the hat brim. For example and as mentioned above, the high beam light source 30 is mounted to extend from the brim's outer perimeter edge 29, and the low beam light source 32 is mounted to extend downwardly from the major surface 31 forming the brim's lower or underside. As a result of this configuration and positioning of the lights 30 and 32, the low beam light cone 21 and the high beam light cone 20 preferably do not intersect or overlap each other and provide separate and discrete cones of illumination for differing purposes (i.e., far illumination and close-in illumination). When both sets of lights are energized, the wearer will not need to redirect their head to focus light on close and far objects, the wearer simply needs to move their eyes without head movement as the hat already directs illumination in two different directions and orientations.

The form of the lighted hat may also include a single or multi-function switch 41 positioned on the lower brim surface 31. In one aspect, the switch 41 may be a multi-position switch that includes one or more positions or modes, such as at least a 4-position switch to select varying modes of illumination. For example, the switch 41 can select either one of the high beam or low beam illumination or both at the same time, vary intensity of one or both light sources, vary color, and the like.

For energizing the light source, the lighted hat may include two battery packs mounted in the hat. In one configuration, both battery packs are electrically connected to both the low beam and high beam lights, but in another configuration, one battery pack is electrically connected to the low beam lights and the other battery pack is connected to the high beam lights. In this situation, the battery configuration can be optimized for each set of lights. For instance, additional battery power can be provided for either the low or high beam lights as the case may be to provide additional illumination.

Optionally, rather than fixed angles of illumination, the light sources 34 and 36 can be configured to pivot via a pivot shaft (not shown). The pivoting mechanism can be electrically controlled by a switch 35 which is operable to rotate the pivot shaft and the light sources 34 and 36 secured to the shaft to illuminate along axes parallel or transverse to brim axis B.

Figure 4:
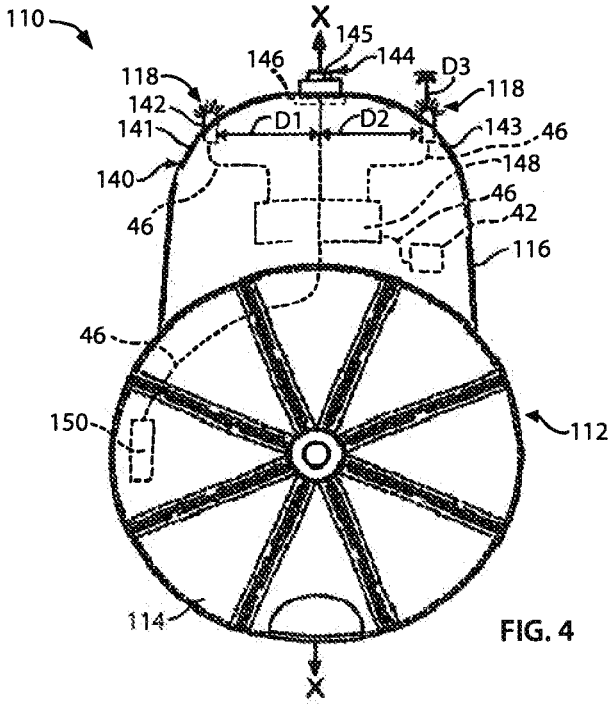
FIG. 4 is a plan view of a lighted baseball cap showing a camera including a lens and white LEDs mounted to the cap brim in electrical communication with a flexible printed circuit board and a power source shown in phantom.
Figure 5A:
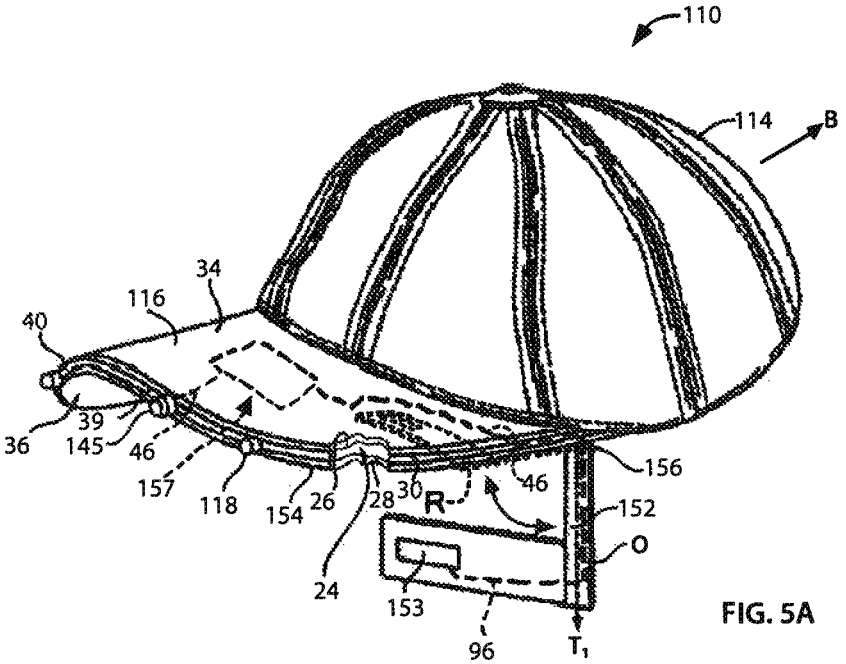
FIG. 5A is an perspective view of a lighted baseball cap showing a camera, lens, flash LEDs, and a viewfinder capable of rotating about a pivot shaft mounted on the cap so that the viewfinder can pivot from a retracted position extending along an underside of the hat brim and an operative position to extend transversely to the brim in the line of sight of a wearer.

Referring to FIGS. 4 and 5, a lighted hat 110 is illustrated in the form of a camera hat. The camera hat 110 is illustrated as a baseball-type cap 112 having a crown 114 and a brim 116 projecting forwardly from a lower, forward edge portion of the crown 114; however other headgear can also be utilized as described herein. As such, the crown 114 can include one or more fabric portions stitched or otherwise secured together to form a dome-shape. Semi-rigid members may be sewed or attached to the connections between the fabric portions or the fabric portions themselves to provide structure for the crown 114. In this embodiment, the camera hat 110 includes a camera 144, which can be combined with one or more light sources 118 that allow the wearer to operate the camera 144 without having to steady and aim the camera with the wearer's hands. The light source 118 can be energized to provide illumination or can be energized automatically as a flash 142 for the camera 144 when a picture is taken therewith.

Referring now to more details of an exemplary hat, the brim 116 includes an upper major surface 26, a lower major surface 28 and a brim insert 24 having side edges 30 and a front edge 39. An upper and lower covering 34, 36, such as a fabric or plastic covering, may be disposed across the upper and lower major surfaces 26, 28 of the brim insert. The upper and lower coverings 34, 36 may be joined together, such as by stitching, adhesive, or the like, at a perimeter edge 38 of the brim 116 with narrow piping material or other fabric material 40. The hat 110 may further include a switch 42, including, for example, a pushbutton switch, a slide switch, a rotary switch, or the like, disposed on a portion of the hat 110, such as one of the upper or lower major surfaces 26, 28, upper or lower covering portions 34, 36, the perimeter edge 38, or on other portions of the crown 114. The hat 110 may also include a power source 44, which is illustrated as a battery pack stored in the hat band 20 of the crown 114. The power source 44 may also be located in other portions of the hat. Electrical connections 46 are provided between the power source 44, the switch 42, and other lighted hat components, such as light sources, in the form of leads and the like to provide power thereto.

More specifically and referring to FIG. 4, the camera hat 110 has the LEDs 118 and camera 144 positioned on an outboard edge 140 of the brim 116. Preferably, the camera 144, such as a digital camera, has a lens 145 positioned along a centerline axis X of the hat 110 so that a photograph of an object directly in front of the wearer can be easily taken by the wearer simply looking directly at the object. Preferably, the outboard edge 140 curves from the crown 114 so that the centerline axis intersects with the outboard edge 140 at its furthermost point from the crown 114. In one form, the lens 145 is received within a notch or recess 146 formed in the brim 116, and more specifically, the brim insert 24, so that the lens 145 is at least partially received within the brim 116. The LEDs 118 are preferably spaced a predetermined distance D1 and D2 from the hat centerline X. Most preferably, the LEDs 118 are positioned adjacent opposite arcuate side portions 141 and 143 of the brim outboard edge 140. In this manner, the LEDs are also disposed rearwardly of the camera by a distance D3 along the brim fore and aft axis X. By way of example and not limitation, distances D1 and D2 can each be approximately 2.5 inches to 3 inches and the distance D3 can be approximately 0.75 inches to 1.5 inches. As a result, the distances D1 and D2 of the LEDs 118 are sufficiently spaced from the lens 145 so that when the LEDs are energized as a flash for the camera 144, red eye effects can be reduced because the flash source (i.e., the LEDs 118) are off-angle to the center of the eyes. Red eye is generally the result of the light from a camera's flash reflecting off a person's retina; as a result, by positioning LEDs 118 the distances D1 and D2 away from the lens 145, red eye can be reduced and, preferably, eliminated. In one form, the lens 144 and LEDs 118 can be in electrical communication with a printed circuit board 148 that is connected to a power source 150. In addition, by having the lens 144 and the LEDs 118 disposed along the brim outboard edge 140, the hat 110 maintains the more natural and streamlined appearance of a traditional baseball hat.

The camera 144 can be a digital camera capable of taking individual photos, groups of photos, and/or video. By one approach, the camera 144 can operate at less than 30 frames per second, and preferably about 25 frames per second. By another approach, the camera 144 can operate at least at 30 frames per second to generate high definition images therewith.

The camera 144 has been described as being mounted to an edge 140 of the brim 116, however, the camera 144 can also be mounted to or adjacent to the upper or lower major surfaces 26, 28 of the brim 116. For example, the camera 144 can be mounted to the brim upper major surface 26 so that the camera 144 or the leads or wiring 46 extends through the upper covering portion 34. By another approach, the camera 144 can be mounted to or adjacent to the brim lower major surface 28, such as within an internal or external mounting base. Co-pending U.S. application Ser. No. 12/714,403, filed Feb. 26, 2010, describes in part various methods and apparatus for mounting light sources to the brim lower major surface, which is hereby incorporated by reference herein in its entirety. The various methods and apparatus for mounting light sources as described in U.S. application Ser. No. 12/714,403 are equally applicable to the camera lens 144 or can have a camera lens added thereto, so that the camera is secured beneath the brim. This advantageously protects the camera 144 from exposure to the elements, such as sunlight and precipitation. It can further protect the camera 144 from physical damage if the headgear is inadvertently dropped.

Referring to FIGS. 4 and 5, the camera hat 110 may include a viewfinder 152. The viewfinder 152 allows the wearer to see the image that the lens 145 is focused on without requiring the wearer to use his hands position the camera in front of his/her eyes. In one form, the viewfinder 152 is pivotally mounted at the underside 154 of the brim 116 for pivoting from a retracted position R extending along the underside 154 of the brim 116 (dashed lines) to an operative position O pivoted away from the underside 154. In the operative position O, the viewfinder 152 is positioned in front of the eye of a person wearing the hat. To this end, the viewfinder 152 is configured to pivot about an axis P via a pivot shaft 156 between the refracted position R and the operative position O. Preferably, when the viewfinder 152 is in use, it will be disposed along an axis T, which extends transversely and preferably orthogonally to the brim axis B to position the viewfinder 152 to allow the wearer to optimally see the image. Preferably, the viewfinder 152 provides the user with a real time visual image of what the lens 145 is focused on at that given time. To this end, the viewfinder 152 may include a small display 153, such as an LCD screen or equivalent, that projects an image being seen through the lens 145 for viewing by the wearer. An image transfer mechanism 147 conveys the image being viewed by the lens 145 and transfers the image for being viewed on the LCD screen of the viewfinder 152.

Figure 5B:
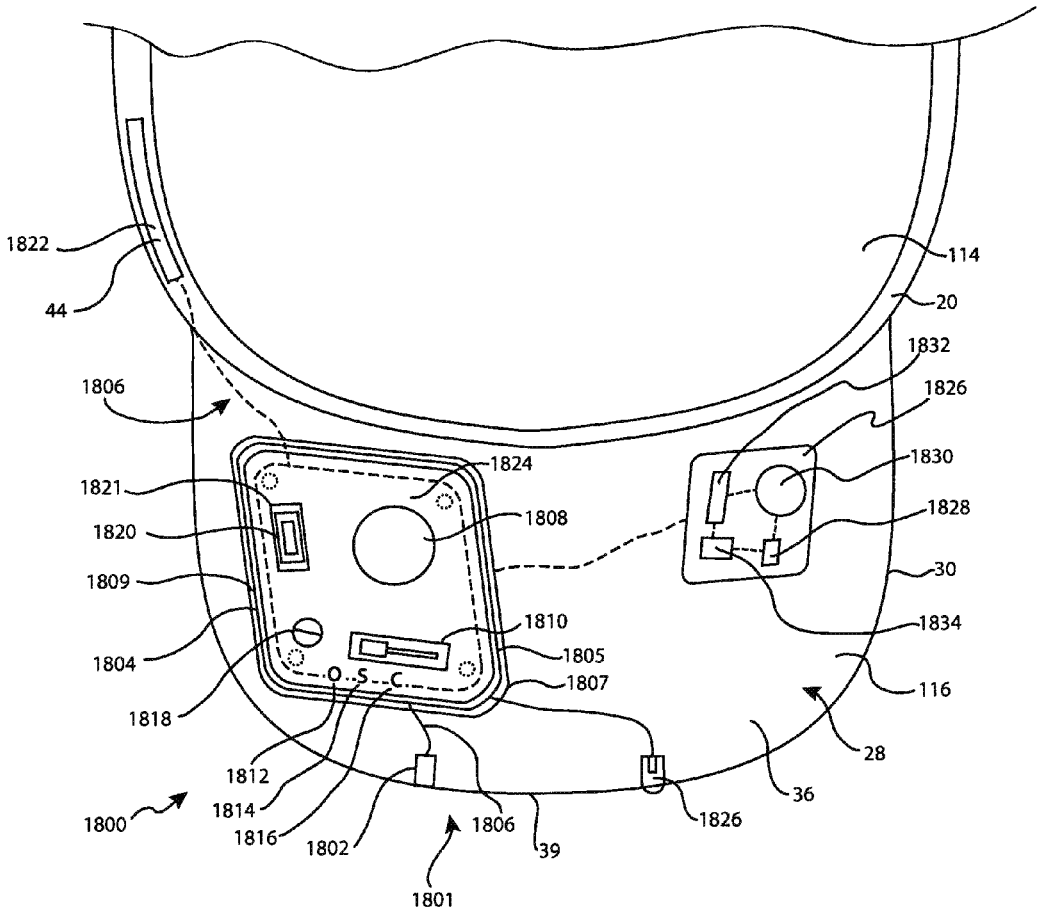
FIG. 5B is a bottom plan view of a camera hat having a control panel mounted to a lower surface of a brim and a camera mounted to an edge of the brim.

Another exemplary camera hat 1800 is shown in FIG. 5B. The camera hat 1800 has a camera device 1801 including a camera lens 1802 disposed or mounted thereto. In the illustrated form, the camera lens 1802 is mounted to an edge 30, 39 of the brim 116 and connected to a control panel 1804 by electrical connections 1806, such as wiring, traces, sockets, ports, and/or circuit boards. The camera lens 1802 could alternatively be mounted adjacent to the upper or lower major surfaces 26, 28 of the brim 116, or the crown 114, as desired. For example, the camera lens can be mounted to the hat brim lower surface to project forwardly and downwardly therefrom, such as described in U.S. application Ser. No. 12/714,403, filed Feb. 26, 2010, with respect to light sources, which is hereby incorporated herein by reference in its entirety. As shown, the control panel 1804 is mounted to the lower major surface 26 or the lower covering 36 of the brim 116, but could also be mounted to the upper major surface 28 of the brim 116, or the crown 114, as desired. In the illustrated form, the control panel 1804 includes a cover portion 1809 attached to the lower covering 36 of the brim 116, such as by stitching, staples, adhesive, welding, or the like. To this end, the control panel cover portion 1809 may include a groove or channel 1805 adjacent a perimeter edge 1807 thereof to receive and at least partially conceal the attachment device. The groove 1805 advantageously provides a thinner cross section through which a needle or staple may pass to secure the holder to the brim or, alternatively, substantially conceals threading, staples, or other mechanical fastening element from view because such fastener is received within the groove 1805.

In the illustrated form, the control panel 1804 includes a control member, such as a switch 1808, which can be a push button switch, slide switch, or the like, configured to send a control signal to the camera 1802. The control panel 1804 further includes a setting switch 1810 configured to set the operation settings of the camera device 1801 and allow a user to select the desired operational setting. As illustrated, the setting switch 1810 allows a user to select between a first position 1812 to turn off the camera device 1801, a second position 1814 to take single snapshots or photos with the camera device 1801 upon actuation of the switch 1808, and a third position 1816 to take a continuous video with the camera device 1801 upon actuation of the switch 1808. The control panel 1804 can also include a status indicator 1818, in this form an LED. The LED 1818 can utilize color, blinking, or the like to indicate whether the camera device 1801 is on, recording video, taking a photo, or the like. The control panel 1804 can also include a USB port 1820 or other connection device, such as utilizing other connecting plug types, or wireless connection methods such as Bluetooth, infrared, Wi-Fi or the like. The USB port 1820 can be utilized by a user to download images, such as photo images, video images, or still images from video images, such as from a memory 1823, which can take any suitable form and may be removable or permanently mounted to the brim 116.

By another approach, the port 1820, or other connection method as discussed above, can also be utilized to charge a rechargeable power source 1822 configured to provide power to the camera device 1801, and specifically the control panel 1804 and the camera lens 1802 thereof. Alternatively, the power source 1822 can be single use or a removable rechargeable battery removably mounted to the brim portion or the crown. The port 1820 may further include a cover 1821 configured to tightly fit thereon to protect the port 1820, as well as prevent foreign matter from entering the port 1820. By one approach, the cover 1821 may be formed from a flexible material, such as rubber, flexible plastic, or the like. By another approach, the cover 1821 may be hingedly attached to the control panel 1804, such as to pivot or flip off of the port 1820, so that the cover 1821 can be removed from the port 1820 without being removed from the control panel 1804 because such completely removable covers are easily lost. As shown, the control panel 1804 includes a circuit board 1824 attached to the cover member 1809, such as by snap-fit, hardware, threaded members, ultrasonic welding, adhesive, or the like. The circuit board 1824 can also be attached to the brim 116 by a clamping mechanism, stitching, adhesive, hardware, threaded members, or the like. Preferably, the circuit board 1824 is a printed circuit board and is positioned between the lower major covering 36 of the brim 116 and the brim insert. The control panel cover portion 1809 can then be provided below the lower major covering 36 of the brim 116 and attached to the circuit board 1824 to sandwich the lower major covering 36 therebetween.

By another approach, the camera device 1801, and specifically the control panel 1804 thereof, can include a sound system 1826, including various sound system components, such as a microphone 1828, one or more speakers 1830, volume control 1832 in the form of push buttons, a rotary switch, or other suitable actuating mechanisms, or the like. The sound system 1826 can include a separate a memory 1834 configured to record sound, or can utilize the memory 1823. The recorded sound can advantageously be utilized in conjunction with the video recording feature of the camera device 1801. As shown, the sound system 1826 is entirely disposed on the brim 116, such as to the upper or lower major surfaces 26, 28 thereof; however, the components can be separated and/or distributed to other portions of the hat 1800.

The camera hat 1800 may further include a light source 1826, such as disposed in the front edge 39 of the brim 116 as shown, mounted to one of the upper or lower major surfaces 26, 28 thereof, or mounted elsewhere on the hat 1800 as described herein. The light source 1826 can provide a flash for a photograph or a continuous stream of light for a video. So configured, controls and components for the camera device 1801 are provided on the control panel 1804 that is substantially concealed on the lower major surface 36 of the brim 116. The control panel 1804 as described above, can further be used in combination with the below described switches, switch guards, and/or heat sinks. This preserves the aesthetics of the hat 110, as well as provides an apparatus to take stealthy video and photos.

Figure 6:
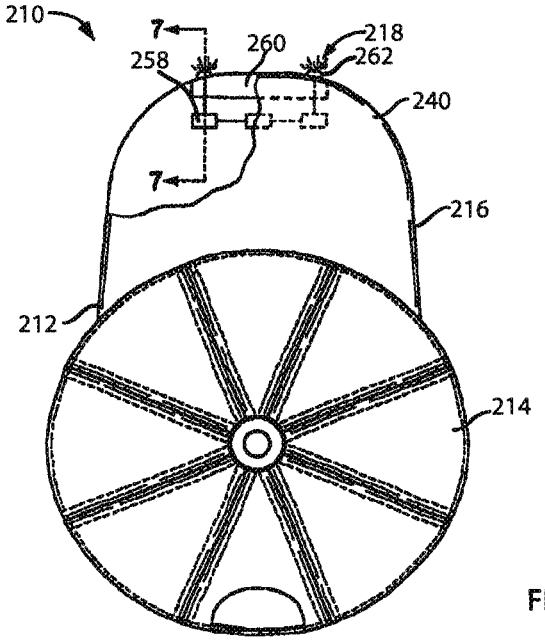
FIG. 6 is a fragmentary, plan view of a lighted baseball cap showing a flexible printed circuit board, a relatively thin and flexible heat sink, and an LED that is configured to provide illumination outward from the hat.

Referring to FIGS. 6 and 7, a hands-free lighted hat 210 that includes high intensity LEDs 118 is shown together with a flexible printed circuit board (PCB) 258 and a heat sink 260. The lighted hat 210 is illustrated as a baseball-type cap 212 having a crown 214 and a brim 216 projecting forwardly from a lower, forward edge portion of the crown 214; however other types of headgear may also be used with this embodiment. In this embodiment, the hat 210 is configured to provide illumination outwardly and forwardly therefrom via relatively high intensity LEDs 262, such as high intensity surface mount LEDs 262, where the heat sink 260 is positioned to dissipate heat generated from these high intensity LEDs 262.

Referring to FIG. 6, the hat 210 includes at least one light source 262 disposed on the hat brim 216 to provide forwardly directed illumination. As discussed above, the light source 262 is preferably at least one and, preferably, two spaced surface mount LEDs disposed at or adjacent to an outer edge 240 of the brim 216. The surface mount LED provides a low profile light source, but also generates a relatively high amount of heat, especially when provided in the higher intensities needed to direct illumination to an area forwardly of a wearer sufficient to provide illumination for reading. For efficient operation of the light source, the heat is dissipated by the heat sink 260 therein.

The hat 210 also preferably includes the flexible PCB 258, which can be used to provide electrical communication between at least one of the light sources 262 and a power source (not shown in this view). The flexible PCB 258 may also be connected to the heat sink 260, preferably in a manner that avoids sufficiently increasing the profile of the lighted hat 10, and particularly the brim 216 thereof.

In one aspect, the flexible PCB 258 may be formed from about 0.5 to about 5 mil thick film or include multiple layers of such films. The flexible PCB 258 should have sufficient flexibility to bend or curve to be fixed to the curved brim, such as either along one of its main curved surfaces 230, 232 or about the outboard, curved edge 234 thereof. That is, the flexible PCB 258 should be capable of being curved to have a radius of curvature about 3 to about 7 inches for being mounted flush to one of the brim main surfaces 230, 232 or 234; however, greater or less flexibility may also be acceptable depending on the particular design of the lighted hat 10 or other headgear. Alternatively, as mentioned, the flexible PCB 258 should be sufficiently flexible to curve or bend around the outer edge 240 of the brim 216.

Figure 7A:
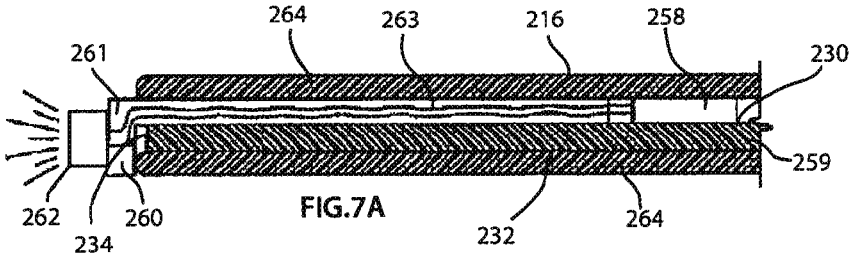
FIG. 7A is a cross-sectional view of the brim of a baseball hat showing an LED mounted on the relatively thin and flexible heat sink and the flexible printed circuit board spaced from the heat sink.
Figure 7B:
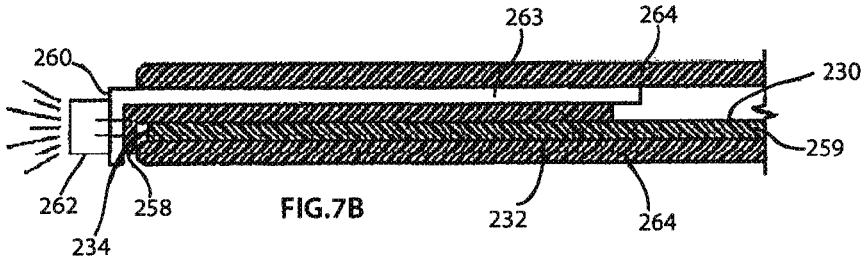
FIG. 7B is a cross-sectional view of the brim of a baseball hat showing an LED mounted on the relatively thin and flexible heat sink with the flexible printed circuit board and heat sink sandwiched between fabric material of the brim covering the hat brim.

Referring to FIGS. 7A and 7B, the flexible PCB 258 can be positioned at different locations on the lighted hat 10 with respect to the heat sink 260. As shown in FIGS. 6 and 7A, one position of the flexible PCB 258 is on the shape-retentive brim insert 259 spaced from the heat sink 260 also mounted to the brim 216 and between the upper and lower fabric panels or panel portions 264 covering the brim 216 such as to minimize any bulky outward appearance of the additional components in the hat 210. To this end, the thickness of the PCB 258 and the thickness of the heat sink 260 are substantially the same to form a uniformly thick hat brim 216.

Figure 7C:
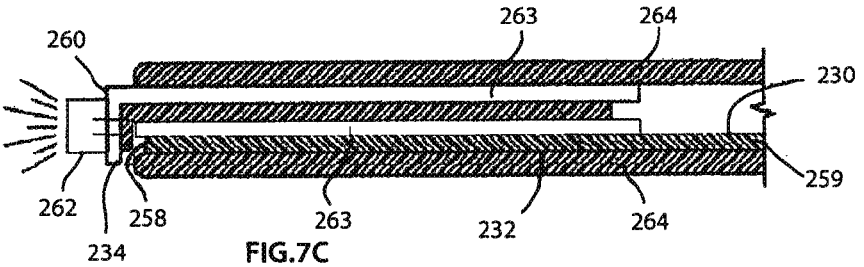
FIG. 7C is a cross-sectional view of the brim of the a baseball hat showing an LED mounted on the relatively thin and flexible heat sink and a second heat sink with the flexible printed circuit board sandwiched therebetween with the heat sinks and the circuit board between fabric material of the brim covering the hat brim.

Alternatively, as shown in FIG. 7B, the flexible PCB 258 extends along a major surface 230 of the shape-retentive brim material 259 and is bent over the brim outboard edge 240. In this configuration, the heat sink 260 may also be in contact with the PCB 2580 and bent over the brim outboard edge 240. If necessary, optional insulation or other protective material may be provided between the heat sink and circuit board if necessary to maintain conductivity with the light source 262. FIG. 7B shows the heat sink 260 extending between the PCB 258 and the brim upper panel 264. By another approach, the heat sink 260 extends below the PCB 258, as illustrated in FIG. 7C. The upper and lower heat sinks 260 can further be combined, as illustrated in FIG. 5C to advantageously dissipate heat from both sides of the PCB 258.

As described above, the camera 144, 1802 is in electrical communication with the printed circuit board 148, 1824 that is connected to a power source 150. Accordingly, the heat sink(s) 260 as described above can further be utilized to dissipate heat generated by operation of the camera 144, 1802 and its associated board 148, 1824 and/or electronics. For example, the heat sink 260 can extend along the circuit board 148, 1824 and include a bend to be positioned adjacent to the camera 144, 1802 positioned at the brim outboard edge 140, such as shown with the light source in FIG. 7B. The headgear can further include the heat sink 260*a* below the circuit board 148, 1824, as discussed above. The head sink 260*a* can be made of a variety of materials including aluminum, tin or any other conductive type metal. Alternatively, the heat sink 260, 260*a* positioned above and/or below the circuit board 148, 1824 can be in communication with the camera 144, 1802 mounted to the upper or lower major surfaces 26, 28 of the brim 116. For some uses, it is desirable to block emissions generated by operation of the camera 144, 1802, such as utilizing a digital camera operating at 30 frames per second or more. For such uses, the heat sinks 260, 260*a* positioned above and below the circuit board 148 advantageously can be configured to block radio frequency emissions, such as to comply with any applicable rules or regulations.

In this regard, for instance when used with control panel 1804, the heat sink 260, 260*a* can be configured to have the same footprint as the panel so that they are congruent with each other, e.g. rectangular, so as to cover the electronic components presented therein and block RF emissions therefrom.

As best shown in FIGS. 7A and 7B, it is preferred that light sources 262 are surface mount LEDs. However, surface mount LEDs sized to generate sufficient illumination also can generate a relatively large amount of heat. In order to properly keep the surface mount LED functioning properly, the heat sink 260 is used to absorb and dissipate the heat that is given off from the LED. This will in turn protect the LED and its components from being damaged by the heat.

The heat sink 260 can be made of a variety of materials including aluminum, tin, or any other conductive type metal. In a preferred embodiment, in order to reduce the thickness and profile of the hat brim 216, the heat sink 260 is formed from a relatively thin and flexible sheet of thermally conductive material. To this end, the flexible heat sink 260 may be curved to conform to the curved brim portion 216 and also include a bent portion 261 extending over the outboard edge 240 of the brim as shown in FIGS. 7A and 7B. In this manner, the surface mount LED 262 may be directed mounted to the heat sink bent portion 261 on the hat outboard edge 240 and the heat sink has a sufficiently large surface area via the bent portion 261 and a major portion 263 extending across the brim surface in order to dissipate heat.

Referring to FIGS. 8-10A, one embodiment of a brim mounted activation switch in the form of a rotary switch 366 is illustrated. The rotary switch 366 can be used to energize, de-energize, or change the illumination intensity of the at least one light source on the hat. Preferably, the rotary switch 366 is located on brim 316 and is disposed in a way to substantially maintain the natural streamlined appearance of the brim 316. The wearer will be able to energize a light source by rotating the switch 366 a predetermined rotary distance in one rotary direction and similarly de-energize the light source by rotating the switch 366 in an opposite rotary direction.

Figure 8:
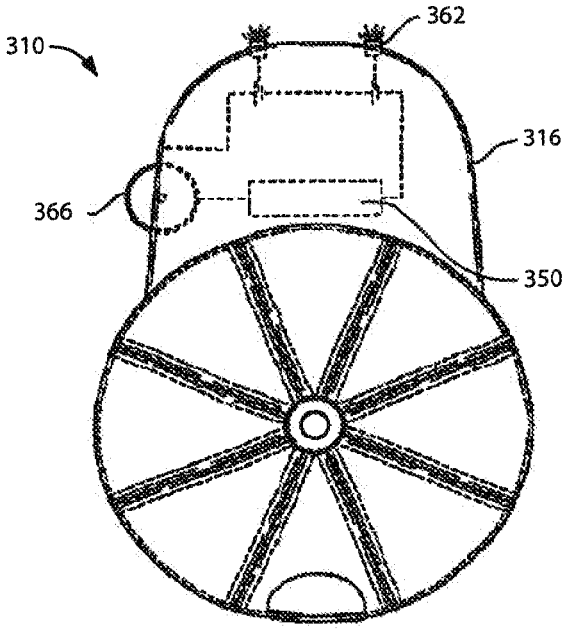
FIG. 8 is a plan view of a lighted baseball cap showing a rotary activation switch that is operable to establish electrical communication between a power source and LEDs configured to provide illumination outward away from the hat.
Figure 9:
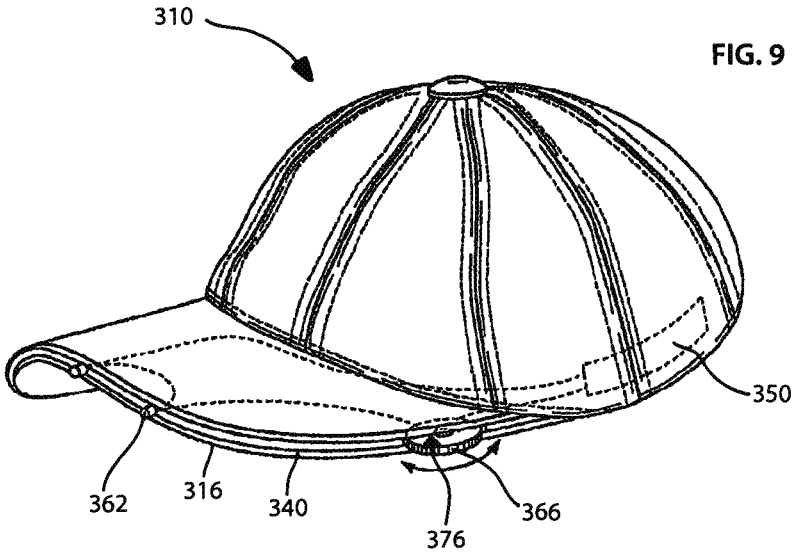
FIG. 9 is a perspective view of a lighted baseball cap showing the rotary switch projecting outwardly from an opening in an outboard edge of the brim.
Figure 10A:
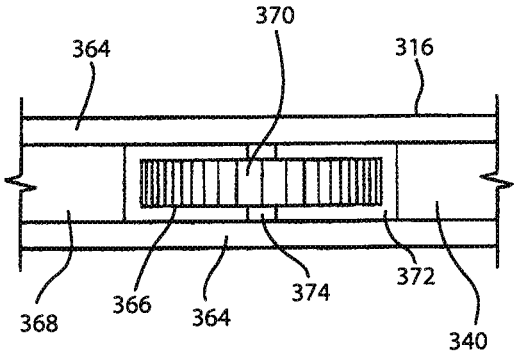
FIG. 10A is a side elevational view of the brim showing the rotary switch mounted on a shaft for rotation thereabout.

More specifically, the rotary switch 366 is mounted to the hat brim 316 so that it projects outwardly from an outboard edge 340 of the brim as illustrated in FIGS. 8 and 9. In this configuration, the rotary switch 366 is disposed along the brim edge 340 between the upper and lower brim covering fabric 364 and 365 so as to minimize the profile of the hat brim 316. In one embodiment, the rotary switch 366 has an annular, wheel actuator 370 for being turned in a rotary direction about a vertical shaft 374 extending between the upper and lower fabric panels 364 so that a portion 376 of the wheel action for 370 projects through an elongated slot 372 formed in the brim edge 340 adjacent the shaft 374 (FIG. 10A). The actuator 370 is configured such that a wearer's thumb, finger, or other appendage can quickly and easily engage the actuator 370 to turn it in a rotary direction in order to activate the light source 362. Alternatively, the switch 366 can also include a push-button-type function where the switch 366 can be depressed to energize other electronic cap features, e.g., the camera 144 and/or flash LEDs 118. For example, depression of the push-button switch 366 could take a picture, turn video recording on and off, or the like.

By a further approach, rotation of the rotary switch 366 can operate a zoom function for the camera 144, 1802, including for photos and video. For example, clockwise rotation can zoom in the camera 144, 1802 out and counterclockwise rotation can zoom out the camera 144, 1802. Alternatively, the rotary switch 366 can include a first momentary radial position that zooms the camera in and a second momentary radial position that zooms the camera out. In this configuration, the switch 366 can further include a biasing mechanism, including a spring or the like, to urge the switch 366 back to a base or neutral position.

Figure 10B:
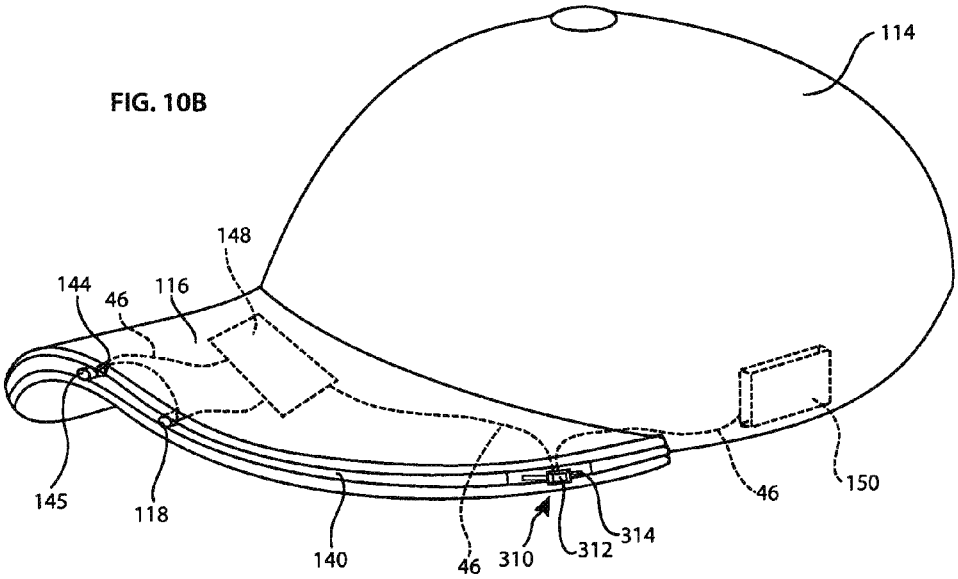
FIG. 10B is a perspective view of a baseball cap showing a momentary slide switch including a pushbutton mechanism with the switch being mounted to a side edge of the cap brim portion and connected to a camera and lights.
Figure 10C:
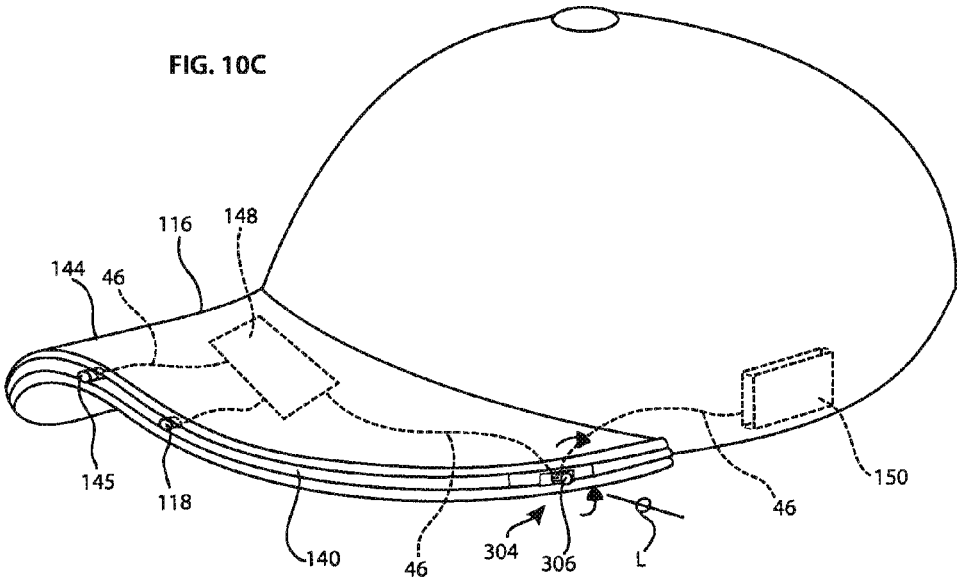
FIG. 10C is a perspective view of a baseball cap showing an alternative rotary switch having a pushbutton mechanism that rotates about a longitudinal axis thereof.

An alternative rotary switch 404 is illustrated in FIG. 10C as mounted to the hat brim 116, such as to the outboard edge 140 thereof. In this form, the rotary switch 404 is electrically connected to the camera 144 and one or more light sources 118 by the wires 46 for selective operation thereof. The rotary switch 404 can further be connected to the circuit board 148 and the power source 150. In this form, the rotary switch 404 includes a generally cylindrical shaft 406 and includes a longitudinal axis L. The rotary switch 404 can be rotated about the longitudinal axis L to operate the light sources 118 and/or the camera, such as has been described above, including energizing the light sources 118 or operating a zoom function for the camera 144. By one approach, the rotary function of the switch 404 operates as a momentary switch so that the camera 144 only zooms in and out or the lights 118 stay energized when the rotary switch 404 is turned and held in a rotated position. In this configuration, the switch 404 can further include a biasing mechanism, including a spring or the like, to force the switch 404 back to a base position without rotational displacement. Advantageously, the rotary switch shaft 406 can further be depressed to function as a pushbutton switch. The pushbutton mechanism can be utilized as a power switch for the camera 144 or to send a control signal to the camera 144 that, for example, takes a picture or toggles between on and off modes for video recording.

Alternatively, the headgear can include a slide switch 410 having a push button mechanism including a plunger 416 depending from a switch actuator 412 as illustrated in FIG. 10B, such as mounted to the outboard edge 140 thereof. In this form, the switch 410 is electrically connected to the camera 144 and one or more light sources 118 by the wires 46 for selective operation thereof. The switch 410 can further be connected to the circuit board 148 and the power source 150. In this form, the switch 410 includes the actuator 412 that can be slid or translated laterally along a track or elongated slot 414 formed in the brim 116. This dual function switch can be utilized, as described above, to operate the light sources 118 and/or the camera 144. For example, translating the actuator 412 laterally operates the zoom function of the camera 144 or energizes the lights 118. In this form, the switch 410 includes a first lateral momentary position to zoom the camera in and a second lateral momentary position to zoom the camera out. In this configuration, the switch 410 can further include a biasing mechanism, including a spring or the like, to force the actuator 412 back to a base position without lateral displacement. The pushbutton of the switch 410 can be utilized to operate as a power switch for the camera 144 or to send a control signal to the camera 144 that, for example, takes a picture or toggles between on and off modes for video recording.

Referring again to FIG. 8, the rotary switch 366 is illustrated in electrical communication with a power source 350 and the light sources 362 within the brim 316. By turning or pushing the rotary switch 366, the rotary switch 366 causes the power source 350 to energize the light sources 362 or other hat accessories. The rotary switch 366 and the other components can be completely located within a self-contained lighted brim 316 and disposed to maintain a thin and low profile or streamline appearance of the brim 316.

As described in U.S. application Ser. No. 11/941,558, the light sources 362 may operate in different illumination modes. For example, the light sources 362 may illuminate at the same time, may be illuminated separately, may blink, or illuminate in different patterns. In that regard, the rotary switch 366 may have multiple stops or energizing points to allow a user to select each of the modes. Similarly, the rotary switch 366 may be configured to select each of the above modes by being pushed or depressed.

Referring to FIGS. 11, 11*a*, and 12-14, a guarding or covering device 402 preferably in the form of a brim sleeve is illustrated for use in combination with a lighted hat 404 for providing a packaging cover for the hat and for providing a barrier to hinder or prevent inadvertent activation of a power switch 406 on the lighted hat 404. The brim sleeve 402 is advantageous because it provides both a packaging cover for the hat to provide information about the hat and, at the same time, protects against unintended power source activation, which enables a power source or other battery to be installed in the hat during manufacture so that the hat can be shipped to a retail store without the risk of the installed power source being inadvertently drained.

In general, the brim sleeve 402 is provided with a detachable covering 408, which is detachably securable to the hat 404, and a barrier wall or shielding member/portion 410 for protection against accidental actuation of the switch 406. The shield portion 410 protects the switch 406 from unintended actuation but, at the same time, still permits direct and intentional actuation of the switch 406 by a potential purchaser or other user. That is, the shield member 410 is configured as a protective barrier that is adjacent to and, preferably partially or completely surrounding the switch 406 so that an adjacent surface (such as a table, wall, or other nested hat 404*a* shown in FIG. 12) will not cause the switch 406 to be inadvertently depressed because the shield 410 keeps the adjacent surface spaced a predetermined distance from the switch 406 and, thus, restricts the adjacent surface from contacting the activation switch 406. At the same time, the shield member 410 also has an access opening sized to provide direct and intentional access to the switch 406 by the user for intentional actuation. In this manner, the hat 404 can be shipped to a store having a power source 411 installed without the risk of the unintentional activation of the power switch when the hat is contacted by an adjacent surface (such as with multiple hats nested together) that could drain the battery prior to the store shelf. At the same time, the shielding member 410 also permits the activation switch 406 to be intentionally activated through the access opening to allow a consumer to test the hat while it is on the store's display shelf.

Figure 11A:
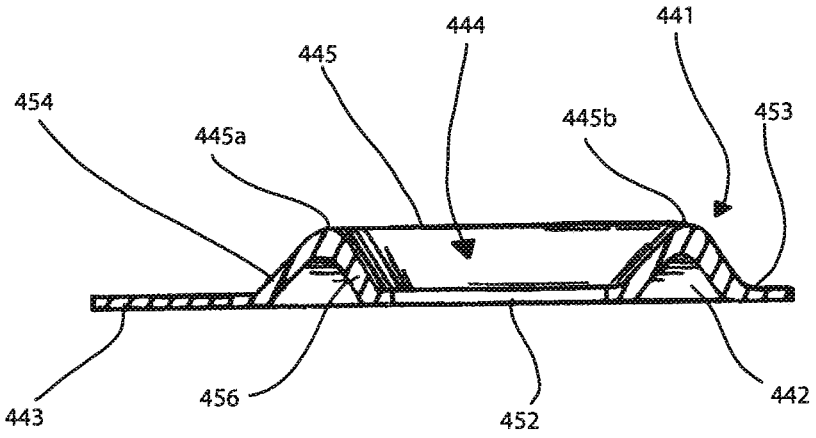
FIG. 11A is a cross-sectional view of a wall portion of the protective guard of the packaging material having an inner and outer flange portion configured to prevent inadvertent actuation of the activation switch.
Figure 11:
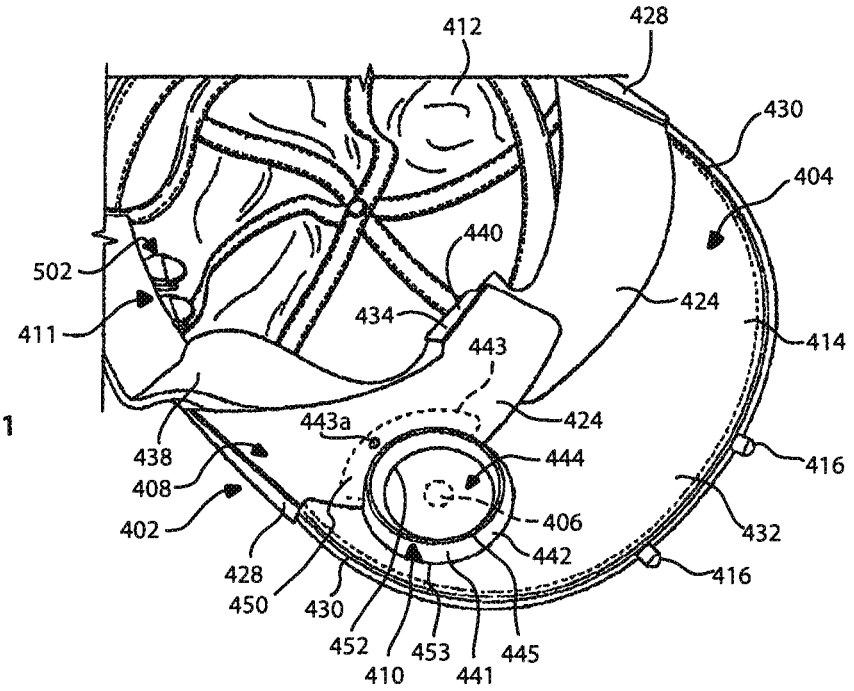
FIG. 11 is a bottom plan view of a lighted baseball hat showing packaging material that includes a protective guard for an activation switch.
Figure 13:
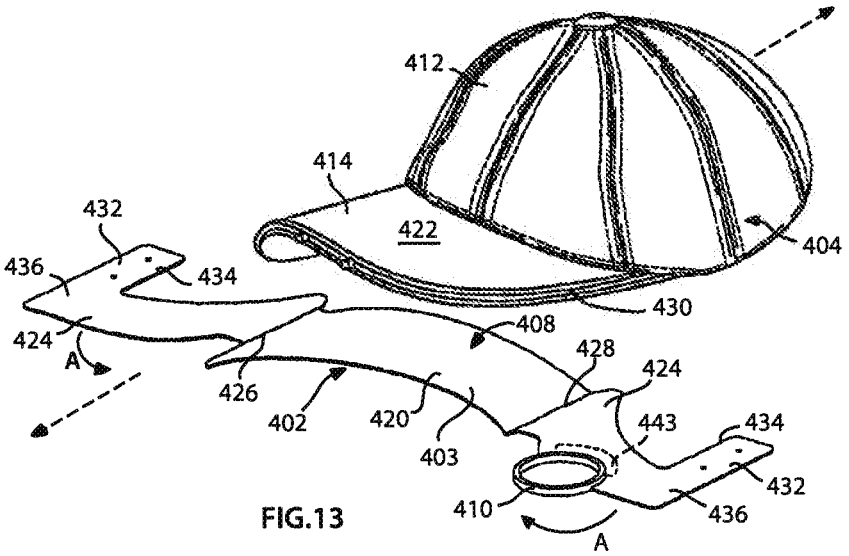
FIG. 13 is a perspective view of the lighted baseball hat showing the packaging material including the protective guard in an unwrapped configuration.
Figure 14:
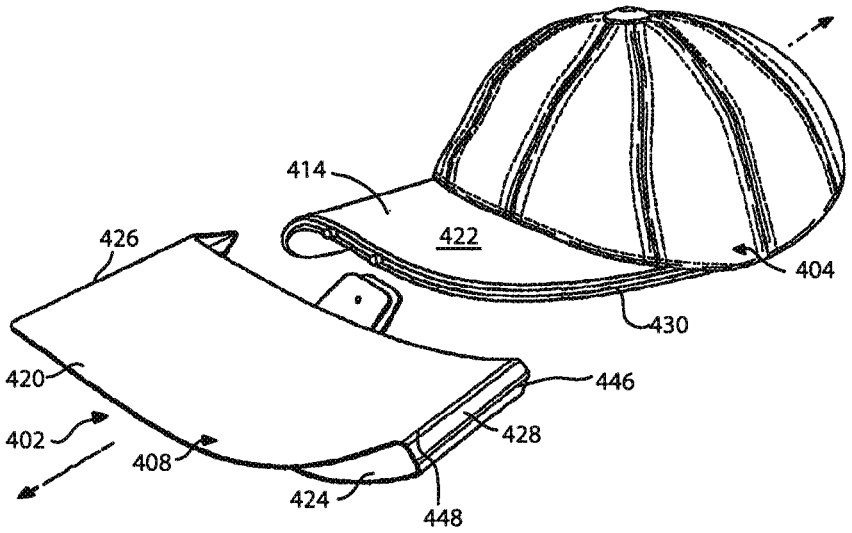
FIG. 14 is a perspective view of the lighted baseball hat showing the packaging material including the protective guard in a wrapped, sleeve configuration.

As shown in the drawings, the hat 404 may be a traditional baseball style hat having a crown portion 412 and a brim portion 414 extending from a forward, lower edge of the crown portion 412 as shown in FIGS. 11, 13, and 14. The hat 404 also preferably includes one or more illumination sources 416, which can be any of the previously described light sources herein or described in related U.S. application Ser. No. 11/941,558, which is incorporated herein in its entirety. While the guarding device 402 is particularly useful in a configuration designed for the baseball-style hat, it will be appreciated that the guarding device 402 may also be configured for other types of headgear in a similar fashion. In addition, while the shielding member/portion 410 of the guarding device 402 is preferably intended to avoid unintended activation of the illumination sources 416, the shielding member 410 may also be used to prevent inadvertent actuation of other switches configured to operate additional accessories mounted to headgear, such as cameras, speakers, radios, MP3 players to suggest a few examples.

Figure 12:
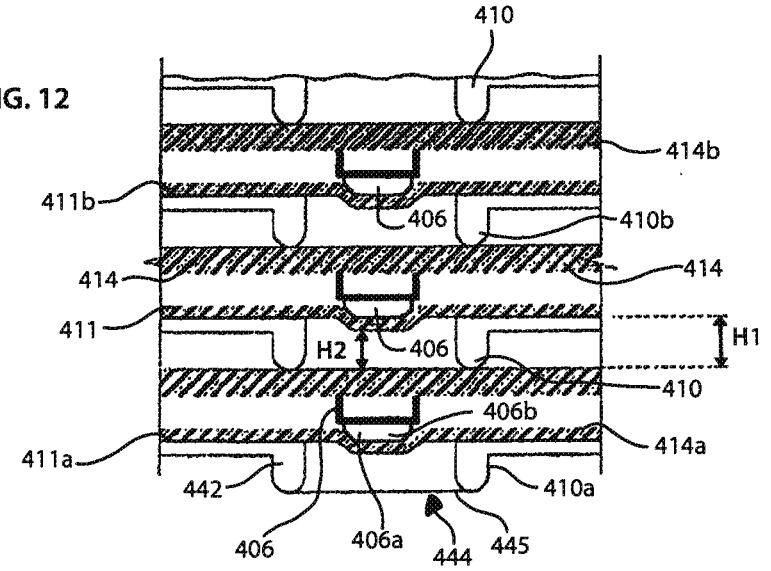
FIG. 12 is a cross-sectional view of the brims of a plurality of nested hats showing the protective guards keeping the adjacent brims spaced to avoid accidentally actuating the brim switches.

In one form, the shielding member/portion 410 of the guarding device may be particularly effective in preventing the inadvertent actuation of an illumination activation switch 406 having a depressible button or plunger actuator 406*a* for actuating the illumination source as generally shown in FIG. 12. The plunger actuator 406*a* of the switch 406 includes an outer button 406*b* that extends away from the brim and is depressible towards the brim to energize the light source on the lighted hat between an "on" or "off" state. To this end, if the button is depressed a first time, the light on the lighted hat is energized to its "on" state where the light will remain continuously in the on-state until the user again depresses the button or plunger a second time causing the switch to configure the lighted hat to its "off" state. As described more below, the shield member/portion 410 effectively prevents inadvertent actuation of the lighted hat by surrounding the activation switch and plunger thereof and extends farther beyond the surface of the hat than the plunger actuator. This additional distance the shield extends past the plunger is effective at preventing inadvertent depressing of the button or plunger actuator because the shield blocks or hinders access to the plunger actuator.

Turning to more of the details, the detachable covering 408 of the guarding device 402 effectively forms a sleeve that encircles the hat brim and includes a thin cardboard or paperboard body 403 (FIG. 13.) having a top or major surface portion 420 configured to conform to an upper curvature of a top surface 422 of the hat brim 414 and is sized to extend across the top surface 422 of the brim 414 (FIG. 13). The brim sleeve body 403 also includes a pair of flap arms or side portions 424 extending from opposite side ends 426 and 428 of the body top portion 420. The flap arms or side portions 424 are configured so as to fold under the top portion 420 as generally illustrated in FIGS. 11 and 14 (see Arrows A in FIG. 13). Preferably, the flaps 424 have a length sufficient so that they overlap each other when in the folded configuration under the hat brim as best shown in FIG. 11. In this manner, when mounted to the hat 404, the brim sleeve top portion 420 extends across the upper surface 422 of the hat brim 414, and the brim sleeve arm side portions 426 are configured to fold under the brim 414 at the brim edge 430 and extend across a lower surface 432 of the hat brim 414 as best shown in FIG. 11. To this end, the packaging cover body 408 may include various folds, creases, or bends as needed to permit the arm flaps 242 to easily bend or fold around the brim edges 430.

The opposite side ends 426 and 428 of the brim sleeve are generally of the same thickness as the hat brim 414 (FIG. 14) and connect/extend between the brim sleeve top portion 420 and the flap arms or side portions 424 such that the detachable covering 408 may maintain a profile similar to the hat brim 414 when mounted thereto. To this end, the opposite side ends 426 and 428 each may have a lower edge 446 and an upper edge 448 (FIG. 14), which connect between the side portion 424 and the top portion 420, respectively. Both the lower edge 446 and the upper edge 448 may contain score lines, folds, creases, perforations or other indents therealong that facilitate bending of the cardboard or paperboard material of the brim sleeve body 403, which allow the opposite side ends 426 and 428 to maintain a similar profile and thickness as the brim edge 430.

Each of the flaps 424 permits the covering 408 to be detachably mounted to the hat 404. By one approach, each flap 424 also includes a fastening member 432 in the form of a rearwardly extending strip 434 located adjacent the distal ends 436 of the flaps 424 (FIG. 11 and FIG. 13). As best shown in FIG. 11, each of the strips 434 are configured to overlap each other and be wrapped or folded into a headband material 438 formed within the hat crown 412. The strips 434 are either inserted in the headband and/or fastened thereto via a fastener 440, such as a staple, pin, snap, strap, adhesive and the like extending through both strips 434 and the fabric material forming the headband. By overlapping the strips 434 and fastening them to the headband 438, the guarding device 402 can be removably mounted to the brim 414 because the guarding device 402 can be removed from the hat simply by removing the fastener 440 and unfolding the strips 434 and flaps 424 from around the brim 414. In this manner, the covering 408 and guarding device 402 thereof can be secured to the hat 404 without detracting from the hat's appearance by forming a sleeve encasing the hat's brim only. To this end, by securing the covering 408 to the hat as provided herein, the hat can be tried on by a consumer in the store because the brim sleeve 402 conforms to the hat's profile and does not hinder or block the hat's crown portion 412.

The body 403 of the brim sleeve 402 is preferably a paper, cardboard, fiberboard, laminate or other conformable packaging-type material that is sufficiently flexible and can be folded at the ends 426 and 428 rending it capable of conforming to the curvature of the hat brim 414. To this end, the covering 408 may include score lines, folds, creases, perforations or other indents 448, 446 to permit easier folding and to define intersections between the adjacent cover sections. The top surface 420 of the detachable covering 408 may also include a decorative outer layer to be used for various markings and other indicia such as labels, logos, and other instructions so that the brim sleeve 402 also functions as a product identifier or marketing label. For instance, the top surface may indicate that the light source may be tested by suggesting the hat includes a "try me feature".

The shield member or portion 410 of the brim sleeve may be a portion of the paperboard body or, preferably, include a separate structure formed from a molded plastic that is attached to a portion of the paperboard body 403 of the brim sleeve. By one approach, the shield member 410 includes a wall 442 formed from upstanding flanges 441 (FIGS. 11 and 11A) that can be positioned adjacent to and, preferably, partially or completely surround the hat switch 406. At the same time, the upstanding flanges 441 of the wall 442 also form a switch access opening 444 on a distal end 445 of the wall 442 to provide an opening for direct and intentional access to the switch 406 as generally illustrated in FIGS. 11 and 12. To this end, the plunger actuator 406*a* of the switch 406 is not covered by either the material forming the body 403 of the brim sleeve 402 or the plastic of the shield member 410, but still has the upstanding flange 441 of the wall 442 adjacent thereto to act as a barrier to prevent inadvertent actuation of the switch 406. Preferably, the shield 410 is formed from a plastic material and molded into the preferred annular shape. However, while the shield 410 is illustrated in the drawings as having an annular configuration, it will be appreciated that the guard 410 may be any shape so that as it is adjacent to and/or surrounds the switch and is capable of preventing unintended activation of the switch.

In one form, the shield wall 442 is formed from the upstanding flanges 441 and, in particular, a pair of upstanding flanges that form an annular structure arranged and configured to encircle the switch 406 when mounted to the hat. Turning again to FIG. 11A, the wall 442 includes the pair of upstanding wall flanges 454 and 456 generally extending toward each other to form a tapered wall configuration where the base of the wall 442 has a wider width than a distal end of the wall. The tapered configuration includes an outer wall flange 454 and an inner wall flange 456 that are on either side of the access opening 444 of the shielding member 410. This tapered configuration is advantageous because it provides enhanced strength to the shield wall 442.

When the shield 410 is a separate piece from the paperboard body of the detachable covering 408, it also includes a mounting flange 443 thereof so that it can be mounted by a fastener 443*a* (such as staples, pins, adhesive, and the like) to a corresponding mating surface 450 located on one of the brim sleeve body flaps 424 in a position so that when the body 403 is mounted to the brim 414 as described above, the wall 442 of the shield member 410 surrounds the brim mounted switch 406 as best illustrated in FIG. 11. To this end, the mounting flange 443 preferably extends generally orthogonal or approximately transverse to the wall 442 and extends from one side of the shield 410 as best shown in FIG. 11. This permits the shield 410 to extend away from one edge of the brim sleeve flap arms 424.

The shield member 410 also preferably includes seating flanges for providing a flush engagement with the brim surface when mounted thereto. Turning to FIG. 11A, the shield member 410 includes an outer seating flange 453 adjacent the outer wall flange 454 and an inner seating flange 452 adjacent the inner wall flange 456. Each seating flange 453 and 452 is configured to sit flush with the brim surface so that the shielding member 410 can be mounted flush to the brim when the brim sleeve is secured thereto. More particularly, the outer seating flange 453 generally extends outwardly away from wall flange 454 and the inner seating flange 452 extends inwardly to the access opening 444 adjacent the inner flange wall 456.

Still referring to FIG. 11A, the inner and outer seating flanges 453 and 452 are spaced apart from one another at the base of the wall 442, which help provide enhanced stability of the shield member 410 while attached to the lighted hat 404 so as to keep the shielding device adjacent to and/or surrounding the hat switch 406. The inner seated flange 452 is connected to the inner vertical flange 456 and extends annularly and in a generally parallel direction to the hat brim 414 about an inner, lower edge of the access opening adjacent the hat brim. The inner seated flange 452 may rest generally flush against the lower surface of the hat brim 414 and generally encircle the activation switch 406. The outer seated flange 453 is connected to the outer vertical flange 454 and extends annularly and in a generally parallel direction to the hat brim 414. The outer seated flange 453 may also rest generally flush against the lower surface of the hat brim 414. Moreover, at least a portion of the outer seated flange 453 may be connected to the mounting flange 443 to connect the shield member 410 to the detachable covering 408.

The preferred annular shape of the shielding member 410 and upstanding flange 441 having the distal end 445 thereof spaced beyond the switch prevent inadvertent actuation of the activation switch 406 by providing barrier wall that surrounds the switch 406 and provides an blocking surface at multiple contact locations along the annular distal end 445 against an intruding object. For example, an object having a size larger than the access opening 444 and coming in contact with the shield member/portion 410 may contact various locations along the annular distal end 445 at the same time. In one form, the intruding object may contact two opposite locations (i.e., 445*a* and 445*b* in FIG. 11A) on opposite sides of the annular distal end 445 allowing the distal end 445 to support the intruding object at the two opposite locations above the activation switch 406 thereby preventing inadvertent activation of the switch 406 by the intruding object. By providing at least two points of contact, the wall 442 provides enhanced resistance from being crushed or deformed upon engaging a surface.

The guarding device 402 is advantageous because it keeps adjacent surfaces away from the power switch 406. One useful application is when a plurality of hats 404 are nested together for packaging and shipping to a store. Turning to FIG. 12, a plurality of lighted hats each having a crown 412 (not shown in FIG. 12) and a brim 414 are disposed in a nested configuration. In this example, this nested configuration includes a lower one of the lighted hats (414*a*) being nested together with an upper one of the lighted hats (411) such that the crown of the lower lighted hat is inserted into the crown of the upper light hat and the brim 414*a* of the lower lighted hat overlaps at least a portion of the brim 414 of the upper lighted hat (i.e., lower brim 414*a* overlays middle brim 414, which in turn overlays upper brim 414*b*). Each of the plurality of nested lighted hats has a spacer device in the form of the guarding device 402 mounted thereto to prevent inadvertent actuation of the activation switch 406 on each of the hat brims. As disclosed above, the guarding device 402 preferably includes the shield member 410. To provide guarding, the shield member wall 442 has a height H1 thereof that is greater than a distance the switch 406 extends beyond a surface of the brim 414 so that the distal end 445 of the shield 410 is spaced a distance H2 from the switch 406. In this manner, the guard 410 and in particular the wall 442 thereof keeps the brim 414*a* of the adjacent, lower nested hat 404*a* spaced from the activation switch 406 of the middle hat brim 411 because the shield wall 442 keeps the adjacent, nested brim 414*a* from contacting the middle hat switch 406. The height H1 of the guard wall 442 is also sufficiently high so that even if a fabric 411 covering the brim is pulled tight over the switch 406, the switch is still spaced from the top 445 of the guard wall 442.

Lighted hats may be displayed on a store shelf prior to purchasing by a consumer. Many times, a consumer may wish to test a lighted hat to evaluate how well the illumination source on the hat works. While on display, the switch access opening 444 associated with the shield member 410 provides a user with intentional and direct access to the activation switch 406. A user may therefore use a finger to directly enter the switch access opening 444 and intentionally activate the switch 406 so that the illumination or other accessory devices can be tested while the hat is displayed on the store shelf. As described above, this configuration still prevents against unintentional actuation of the activation switch while allowing a user direct access to intentionally actuate the switch. In this manner, the hat 404 can be shipped to the store with the power source 411 already installed without the concern that the activation switch be inadvertently turned on during shipment which can drain the power source thereof.

Figure 15:
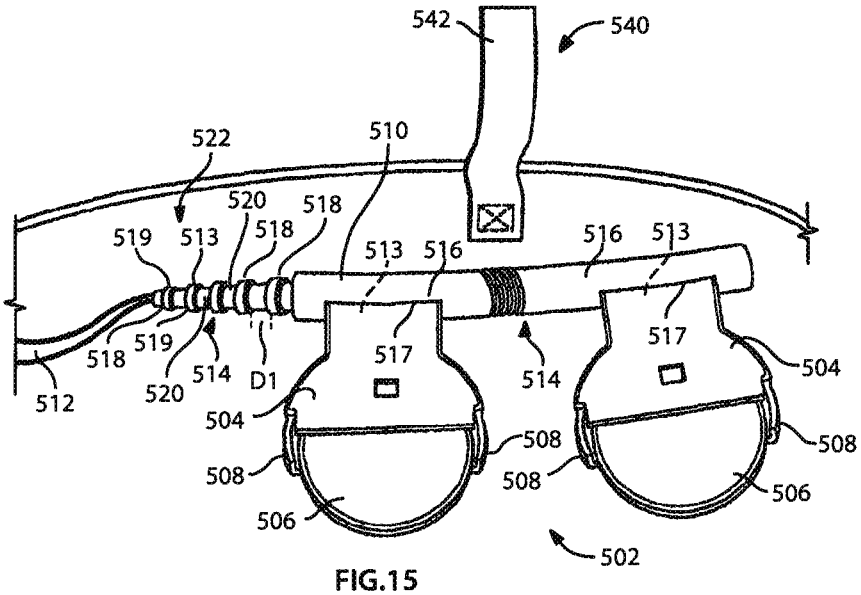
FIG. 15 is a perspective view of a battery holder configured to be attached to a lighted hat via a flexible strip and showing an elongate, resilient base member having a relatively flexible portion and a relatively rigid portion.
Figure 16:
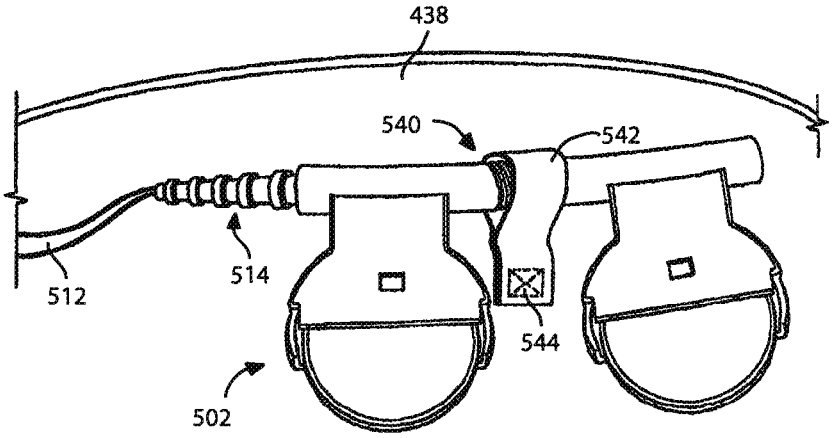
FIG. 16 is an elevational view of the battery holder showing the flexible strip fastening the base of the holder to the lighted hat.

Referring to FIGS. 11, 15, and 16, a flexible battery module 502 for use in the lighted headgear described herein is illustrated. As shown in FIG. 11, the battery module 502 is configured for insertion in the headband material 438 formed on the lower, inner portion of the hat crown 412. That is, on a typical baseball-style cap, the headband material 438 is folded inwardly to an interior space formed by the crown 412 to form a generally annular space between the headband 438 and the inner surface of the crown 412. The flexible battery module 502 is preferably inserted in this space and fastened to the hat band or crown. The module 502 is configured to be flexible to permit portions of the battery module 502 to flex and bend. In this regard, the module 502 may generally conform to the curvature of the hat crown 412 and provide a more comfortable wearing experience for an individual because the battery module 502 is capable to better conform to the curvature of the wearer's head with fewer rigid portions that can create a protrusion that may abut into the wearer's head. At the same time, the module 502 also includes more rigid portions that are configured to protect a connection with the battery.

Figure 17:
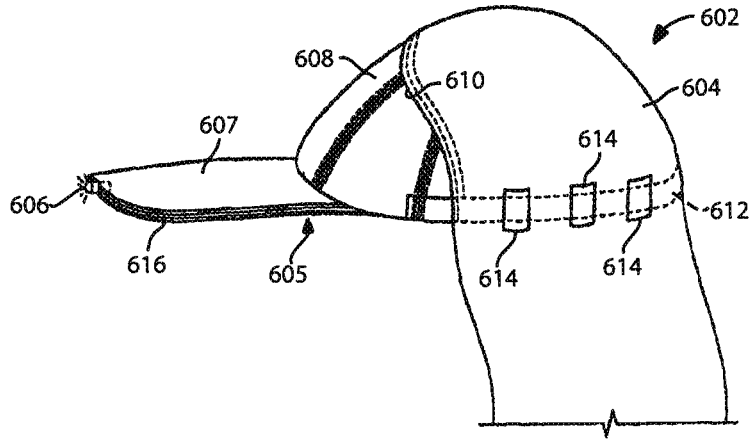
FIG. 17 is an elevational view of lighted headgear of a garment showing a brim portion with LEDs attached to a hood portion of the garment by a sweatband of a partial crown portion extending through interior loops the hood.

Turning to FIG. 17, one form of the module 502 is illustrated in more detail. As illustrated, the module 502 includes two battery receiving pockets 504, which are configured to each received a single battery 506, such as a thin, coin-cell type battery, in a generally snap-fit connection. For example, the battery 506 is preferably snapped into the pocket 504 by being snuggly received therein by spaced gripping fingers 508 on either side of the pocket 504. As described in more detail below, each pocket 504 is mounted to a base member 510 that encloses electrical wiring 512 and provides a rigid mounting portion for connection to the pockets 504 and also includes flexible bending portions for providing the ability of the module 502 to conform to the curvature of the hat.

The wiring 512 extends through the base to each of the batteries and out a distal end of the base where it can be connected to a circuit board, illumination source, switch, or other accessory (not shown). The base 510 provides rigid protection to an electrical connection 513 between the wires and each battery 506 that limits the amount of bending or flexing that can occur at this connection. While the module 502 is shown with two battery pockets 504, it will be appreciated that additional or fewer pockets may be included as needed to provide the desired power level to the hat and associated accessories.

In one form, the base 510 is an elongate tubular structure having an annular wall 512 forming a plastic tube through which the wiring 512 extends. The tube wall 512 includes multiple portions that include at least two relatively flexible portions 514 configured to permit the module 502 to bend or flex and also at least two relatively rigid portions 516 which form a rigid connection 517 to the battery pockets 504. The flexible portions 514 are formed from a series of annular bands 518 axially spaced along the length of the tubing with narrower tubing sections 520 in between the annular bands 518. The narrow tube sections 520 have a relatively thinner wall thickness compared to the rigid tube portions 516 and, therefore, permit the tubing portions 514 to flex or bend. The annular bands 518 have a relatively thicker wall dimension and can provide hard stops to limit the amount of bending of the flexible portions 514. To this end, as the portion 514 is flexed, upon sufficient bending, the outer edges 519 of the annular bands 518 will abut each other to limit the amount of bending. To control the amount of flexing of the tube, a spacing D1 between the annular bands 518 can be varied. For instance, greater spacing D1 will permit more bending of the flexible portion and narrower spacing D1 will permit less bending of the flexible portion.

Preferably, the base 510 includes two flexible portions 514. One flexible portion 514 is positioned between the two battery pockets 504 and rigid portions 516 to permit each battery pocket 504 to flex or bend relative to each other. The other flexible portion 514 is provided at the distal end 522 of the base 510 to provide flexibility at the location where the wiring enters the base 510.

Referring to FIG. 16, the module 502 is mounted to the headgear via a fastener 540. In one form, the fastener 540 is a loop of fabric material 542 that encircles the base 510 between each of the pockets 504 and is stitched 544 to the inside headband 438 of the hat. In this manner, the module 502 is conveniently attached to the hat, but permits ease of battery replacement because there is no other pocket, module, cover, or other material that needs to be unscrewed, removed, or opened in order to reach the battery. The user can unfold the headband 438 to access the batteries 506. While the fabric loop 542 is illustrated as one mounting method for the module 502, it will be appreciated that other type of mountings may be used to secure the module to the hat, such as but not limited to, snaps, Velcro, glue, fabric pockets, and other common fastening methods.

Referring to FIGS. 17-23, various embodiments of illuminated clothing 602 are illustrated. In general, the illuminated clothing 602 includes a hood portion 604, such as from a hood from a jacket or sweatshirt, combined with a hat portion 605 having an illumination source 606 thereon to provide illumination forwardly of a wearer when the hood is up around the wearer's head. The hat portion 605, which is coupled with the hood, includes a crown or partial crown 608 such as a visor portion and a brim portion 607 extending outward from a lower portion of the crown 608. As described in more detail below, the hat portion 605 preferably includes the illumination source 606 and other electrical components needed to energize the illumination source, but the electrical components may also be in the hood or other portions of the clothing. In this configuration, the hat and hood combination mimics the appearance of a separate hat covered by a hooded sweatshirt or jacket, but provides the advantage of the hat being mounted to the hood for stability. As further described below, the hat portion 605 may be fixed to the hood portion 604 or the hat portion 605 (i.e., crown or brim) may be removably mounted to the hood portion 604.

Referring more specifically to FIG. 17, one embodiment of the illuminated clothing 602 includes the hat portion 605 fixed to the hood 604. In this form of the illuminated clothing, the hat portion 605 is secured to the hood 604 by having the crown portion 608 fixed to the hood 604 and, in particular, fixed to an outer edge 610 of the hood 604. The crown 608 may be attached by stitching, gluing, and other fastening methods. Optionally, the crown 608 may be an extension of the hood fabric with or without a more rigid backing material (not shown) positioned on an inside surface of the hood fabric to form the curvature of the crown portion.

In one embodiment, the hat and hood combination also includes a headband 612 extending around the side and rear outer portions of the hood 604. The headband helps to position the hat portion 605 in a desired position on a wearer's head. By one approach, the headband 612 may be formed from an elastic material and extends around the sides and rear of the hood from one side of the hat portion 605 to the other. The headband 612 may be stitched to the hood or, as shown in FIG. 17, extend through one or more spaced loops 614 positioned on the inner surface of the hood 604.

The hat portion 605 includes the illumination source 606 and the necessary electrical components for energizing the illumination source 606. For example, the hat portion 605 may include any of or any portion of the previously described illuminated hats herein or described in related U.S. application Ser. No. 11/941,558. Preferably, the hat portion 605 has the illumination source 606 on an outboard edge 616 of the hat brim 607 and configured to provide illumination forwardly of the wearer. The embodiment shown in FIG. 17 including an assembly of the hat portion 605 fixed to the hood portion 604 provides a sturdy construction where the hat portion 605 and hood portion 604 are generally a single clothing piece.

Figure 18:
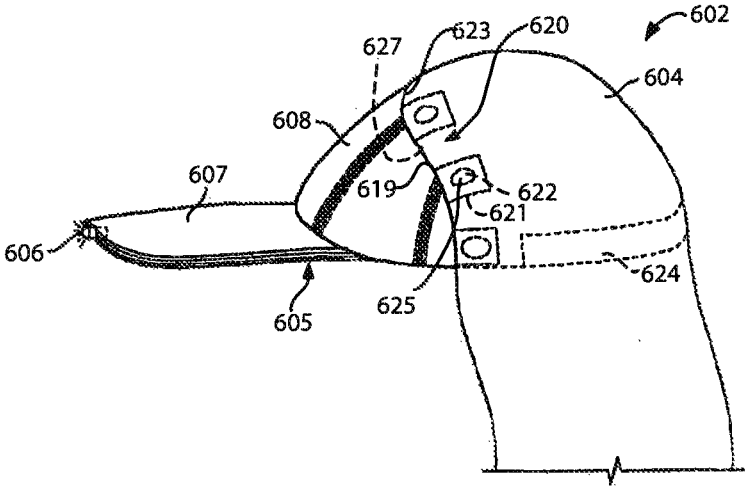
FIG. 18 is an elevational view of another form of lighted headgear for a garment showing a brim portion with LEDs and a crown portion that is removably mounted to the hood portion.

Referring now to FIG. 18, another embodiment of the illuminated clothing 602 is illustrated. In this embodiment, the hat portion 605 is removably mounted to the hood portion 604 by a fastener mechanism 620. In this manner, the hat portion 605 may be removed from the hood portion 604 so that the hood may be washed without needing to protect the electrical components in the hat portion 605 from water.

By one approach, the fastener mechanism 620 includes Velcro, snaps, pins, buttons, zippers, and other fastening methods. As shown, an outer edge 619 of the crown portion 608 includes a plurality of spaced fabric flaps 621 having a snap 622 thereon. Each of the snaps 622 is configured to be received in corresponding receiving snap members 625 secured to an inner surface 627 of the hood 604 such as adjacent an outer edge 623 of the hood 604. Optionally, the hood 604 may include an integral or separate headband 624, which may be part of the removable hat portion 605 or may be provided in inner portions of the hood 604 similar to the headband 612 described above.

Figure 19:
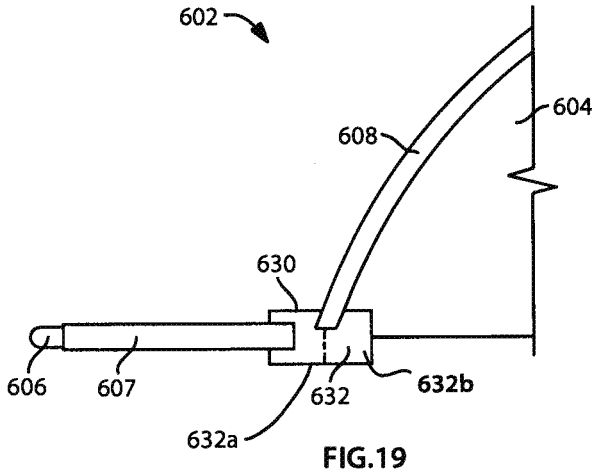
FIG. 19 is an elevational view of a lighted brim including LEDs that are detachably mounted to a crown portion.

Rather than having the crown portion 608 removably attached to the hood 604, the lighted clothing 602 may also include a removable hat brim 607. For example, as shown in FIG. 19, the hat brim 607 may be removably mounted to the hood 604 or to the crown portion 608 via a detachable fastener 632 including cooperating fastener portions 632*a* and 632*b* on both the brim and the hood 604 or crown portion 608. Similar to the previous embodiment, the removable brim 607 permits the electrical components housed therein to be separated from the hood 604 so that the hood 604 can be washed without damaging any of the electrical components. The fastener 632 may include any common fastening mechanism such as, but not limited to, snaps, Velcro, adhesive, zippers, buttons, tabs, pins, and other detachable fastening devices that allow for easy detachment and reattachment of the brim 607 relative to the hood 604 or crown portion 608 without damage thereto.

Figure 20:
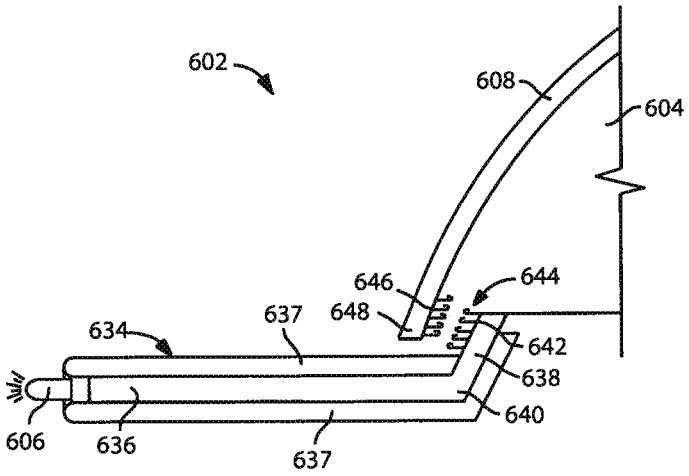
FIG. 20 is an elevational view of a lighted brim including LEDs that is removably mounted to a crown portion via a Velcro fastening system.

Turning to FIG. 20, one example a removable brim 634 is illustrated. In this embodiment, the brim includes a relatively rigid, shape retentive portion 636 covered by fabric upper and lower overlays 637. The shape retentive portion 636 includes an upwardly extending flange 638 along an inner edge 640 thereof. An outer surface 642 of the flange includes a fastener 644, such as Velcro, that is configured to removably mate with a corresponding fastener 646, such as Velcro, on a lower inner surface 648 of the hat crown 608 or lower inner surface of the hood 604. In this embodiment, the removable brim 605 includes the fabric 637 stretched across upper and lower surfaces of the shape retentive portion 636 similar to a traditional baseball-style cap so that when mounted to the crown and hood, the assembly appears to be a typical baseball cap.

Figure 21:
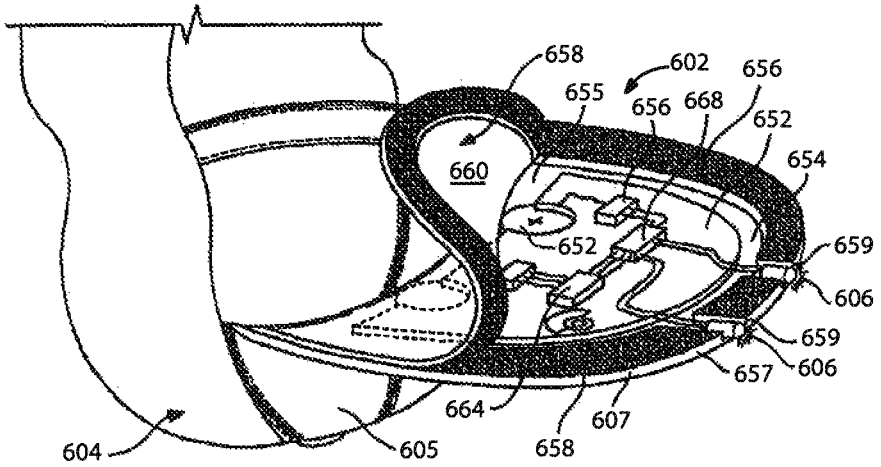
FIG. 21 is a perspective view of a self-contained lighted brim showing LEDs, a power source and a circuit board mounted to a removable light module accessible by a flap of fabric, detachably connected to the brim.

Turning now to FIG. 21, an alternative lighted clothing assembly 602 is illustrated. In this embodiment, the hat portion 605 includes a removable electronic module 652 that can be removed from the hat brim 607. In this embodiment, all electrical components (switches, circuit boards, batteries, and illumination sources) are mounted to the electrical module 652. In this manner, the electrical module 652 may be removed from the clothing so that the hood and hat combination can be easily washed without the electrical components.

More specifically, the brim 607 includes an inner cavity 654 defined by a brim outer wall 655 and an brim edge wall 656 extending along the brim outboard edge 657. The cavity 654 is sized to receive the module 652 therein. In order to position the illumination source 606 for outward projection of illumination, the edge wall 656 preferably includes slots 659 extending from the cavity 654 through the outer wall 656. To this end, the module 652 is inserted into the cavity 654 with the illumination sources placed in the slots 659.

Figure 23:
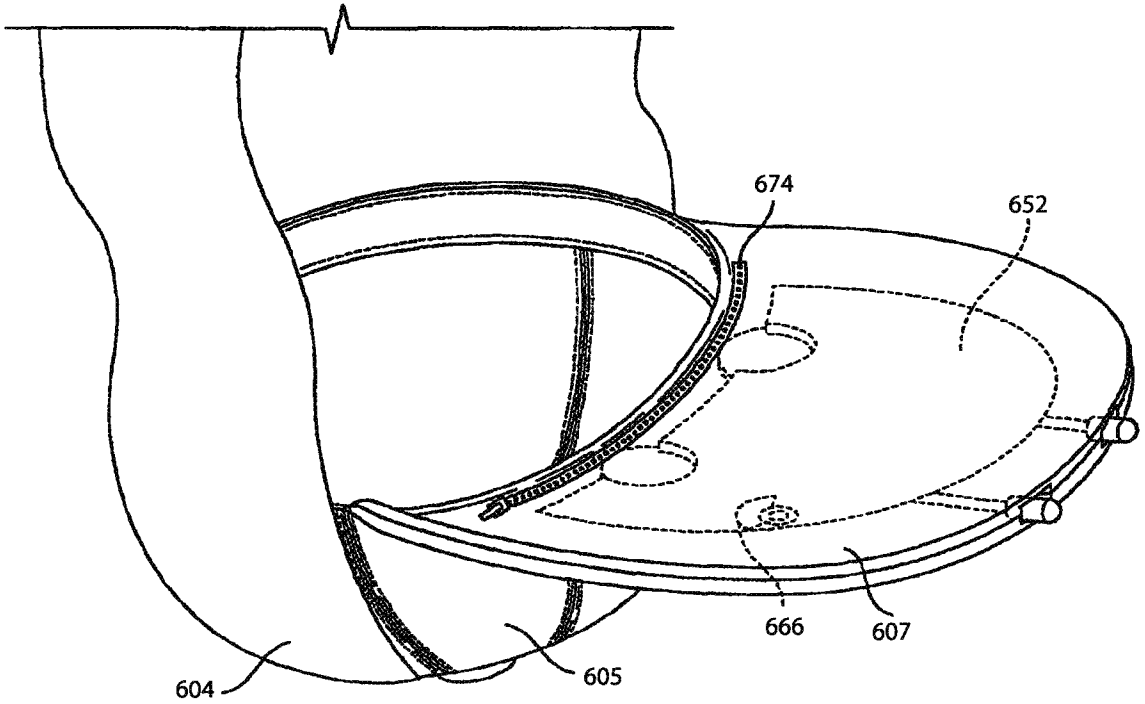
FIG. 23 is a perspective view of a self-contained lighted brim similar to FIG. 21 showing the removable light module in the brim and which is in phantom accessible through a zipper opening in the brim fabric.

To access the cavity 654, a lower fabric surface 658 of the brim 607 includes a flap 660 that may be peeled back to expose the cavity 654. The flap 660 is secured to the brim edge wall 656 by a fastener 658, shown here as Velcro but the fastener 658 may be any removable fastening mechanism like buttons, snaps, adhesive, and the like. In an alternative embodiment, as shown in FIG. 23, the electrical module 652 may be accessed via a zipper slot 674 provided in the lower surface 658 of the brim 607.

Figure 22:
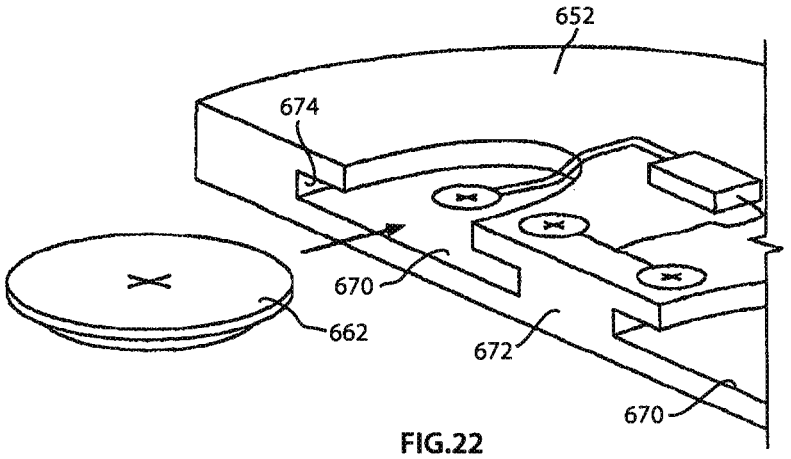
FIG. 22 is a partial, perspective view of the removable module of FIG. 21 showing a power source that can be received in a slot at the outer edge of the module.

Preferably, the module 652 includes all the components necessary to illuminate the power source 606. As shown, the module 652 includes a power source 662, a circuit board 664, an activation switch 666, and other electrical connections 668. It will be appreciated that the various electrical components shown on the module 652 are only exemplary and other electrical connections and components may be provided as needed for each particular circumstance. As shown in FIG. 22, the power source 662 is preferably received in slots 670 provided on an outer edge 672 of the module 652. In this manner, the power source 662, such as coin-type batteries may be conveniently slid into the slots 670. In order to provide a secure attachment, the slots may have an undercut groove 674 configured to receive the battery 662 in a snug fit.

Figure 24:
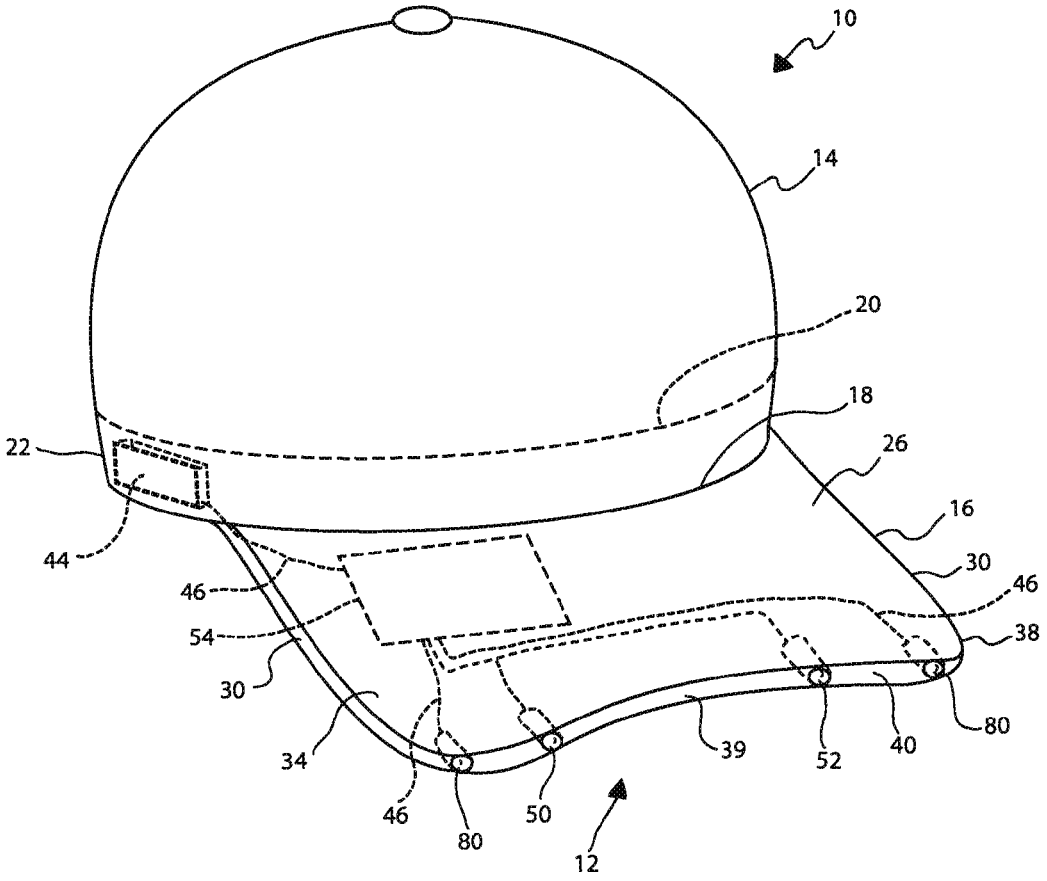
FIG. 24 is a perspective view of a hat with a brim showing a camera device including first and second lens devices at a front edge of the brim in electrical communication with a control panel and a power source.
Figure 25:
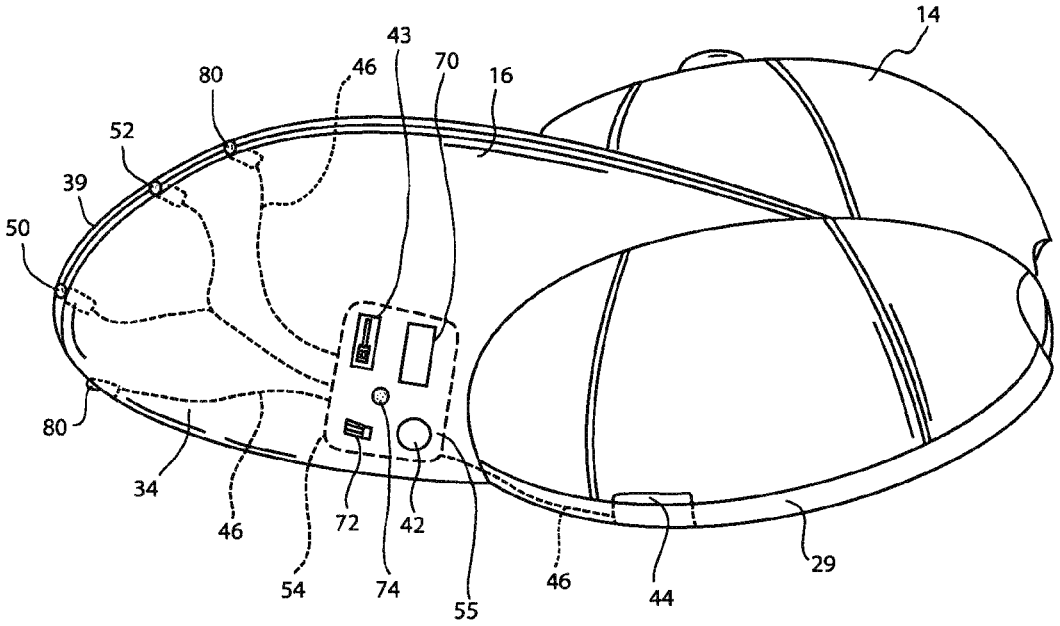
FIG. 25 is a bottom perspective view of the hat of FIG. 24.

Referring now to FIGS. 24-26, in this approach the hat 10 includes a camera device 12 mounted to the hat brim 16 and/or the hat crown 14 positioned to capture images and/or video forwardly of a wearer of the hat 10. The camera device 12 includes first and second camera lens devices 50, 52 both capable of separately capturing images and/or video upon operation thereof. By another approach, the hat 10 can include first and second camera devices capable of being operated substantially simultaneously. As shown, the first and second camera lens devices 50, 52 are spaced from one another, and preferably generally equally spaced from a center fore-and-aft axis of the brim, to provide slightly different perspectives when capturing images, such as pictures and/or video. When the first and second camera lens devices capture images substantially simultaneously, this configuration provides images of substantially the same subject matter, but from slightly different perspectives. The images captured from slightly different perspectives can then advantageously be utilized to create 3D images and/or video. 3D images as described herein provide the effect of 3D from a 2D image by manipulating images captured from slightly spaced perspectives.

The camera device 12 can include two digital camera lens devices capable of taking individual photos, groups of photos, and/or video. By one approach, the camera device 12 can operate at less than 30 frames per minute, and preferably about 25 frames per minute. By another approach, the camera device 12 can operate at least at 30 frames per minute.

Turning now to more of the details of the hat 10 as shown in FIGS. 24-26, the camera device 12 includes a control panel 54, such as the control panel 1804 discussed above, mounted to the brim lower surface 28 or the lower covering material 36. This configuration advantageously utilizes a curvature of the brim 16 to protect the control panel 54 from damage as a result of dropping the hat 10, exposure to the elements, and the like. By another approach, the control panel 54 can be mounted on the brim upper surface 26, upper covering material 34, or a portion of the crown 14, such as a forward, rear, side, or top portion of the crown 14.

The control panel 54 can include an outer covering panel 55 and a circuit board or printed circuit board 56 positioned between the covering panel and the brim 16. By one approach, the covering panel 55 is positioned outwardly of the lower covering material 36 and the circuit board 56 is positioned between the lower covering material 36 and the brim insert 24. By another approach, the covering panel 55 attaches to the circuit board 56 outwardly of the lower covering material 36 and then the covering panel 55 and circuit board 56 are secured to the brim insert 24 or the lower covering material 36. These attachment configurations can also apply to the upper covering material 34 or the crown 14, as desired. The covering panel 55 and the circuit board 56 can secure to the brim 16, and specifically the lower covering material 36 and/or the brim insert 24 thereof, by any suitable method, including hardware, such as screws, pins, etc., adhesive, stitching, staples, or the like. Pursuant to this, the covering panel 55 can include a groove or grooves 57 that extend at least partially around a perimeter thereof, so that the attachment devices as set forth above are at least partially concealed within the groove or grooves 57. Additionally, the covering panel 55 can secure to the circuit board 56 by similar suitable attachment methods so that the covering panel 55 stays aligned over associated components on the circuit board 56.

The control panel 54 can further include one or more control members, such as switches 42, which can include, for example, a pushbutton switch, a slide switch, a rotary switch, or the like. Alternatively, switches 42 can be disposed on a portion of the hat 10 other than the control panel 54, such as one of the upper or lower major surfaces 26, 28, upper or lower covering portions 34, 36, the perimeter edge 38, or on portions of the crown 14, including the switches discussed above. Preferably, the switch 42 is a pushbutton switch having a base 60 and an actuator 62 configured to be depressed with respect to the base 60 to activate and deactivate the electronic components of the hat 10. The covering panel 55 can be made of a flexible material, such as plastic, rubber, or the like, so that the pushbutton switch can be positioned underneath the covering panel 55, but still be capable of being actuated. In another form, the covering panel 55 can be a generally rigid material and include one or more openings therein to provide access to components, such as the switches 42, or the like.

In another aspect, the control panel 54 also includes a setting selection switch 43, such as the switch 1810 discussed above, configured to allow a user to select a operational setting of the camera device 12. As illustrated, the setting switch 43 allows a user to select between a first position 45 to turn off the camera device 12, a second position 47 to take photos or snapshots with one or both of the lens devices 50, 52 upon actuation of the switch 42, and a third position 49 to take video with the lens devices 50, 52 upon actuation of the switch 42. The control panel 54 can also include a status indicator 48, such as an LED. The LED 48 can utilize color, blinking, or the like to indicate whether the camera device 12 is on, recording video, taking a photo, or the like.

The hat 10 may also include a power source 44, which is illustrated as a battery pack, but can also include power generation modules, such as solar energy cells, kinetic devices, wind turbine devices, or the like. Examples of power generators may be those described in U.S. application Ser. No. 11/941,558, which is incorporated herein by reference in its entirety. The battery pack can have removable batteries therein, such as coin-cell batteries, or can be rechargeable. As illustrated, the power source 44 is stored in or mounted to the hat band 20 of the crown 14. The power source 44 may also be located in other portions of the hat, such as a part of the control panel 54. The power source 44 can then be coupled to electronic components mounted to the hat 10, such as the camera device 12, the circuit board 56, light sources, switches, or the like, as explained in more detail below.

Electrical connections 46, such as wires, traces, ports, sockets, circuit boards, or the like, connect the various camera device components, and specifically span between the power source 44, the one or more switches 42, the control panel 54, the camera device 12, and other electrical hat components, such as light sources, to provide power thereto. As such, the electrical connections 46 can also form electrical pathways that span between the control panel 54 and/or the switch 42 and the first and second camera lens devices 50, 52 so that the control panel 54 can provide control signals to the first and second camera lens devices 50, 52.

A heat sink 59 can also be secured or mounted to the hat brim 16 adjacent to and in communication with the camera device 12. The heat sink 59 is formed of a conductive material, such as aluminum, tin, or the like, so that heat generated by the camera device 12, the circuit board 56, and/or the other electronic components on the hat 10 can be dissipated across the relatively larger area of the heat sink 59.

Referring to FIGS. 30 and 31, the heat sink 59 can be positioned at different locations on the camera hat 10 with respect to the circuit board 56 and the camera device 12. As described above, the camera device 12 is in electrical communication with the circuit board 56 that is connected to the power source 44. For example, the heat sink 59 can extend along the circuit board 56 between the circuit board 56 and the brim insert 24. The heat sink 59 can further extend to a position adjacent to the brim front edge 39 to be in communication with the camera device 12. By one approach, the heat sink 59 can include a bend or projection 61 therein to be positioned adjacent to the camera device 12 positioned at the brim front edge 39 as shown in FIGS. 30 and 31. By another approach, the hat 10 can include a second heat sink 63 on a side of the circuit board 56 opposite of the brim insert 24, so that the heat sinks 59, 63 sandwich some or all of the circuit board 56 therebetween.

For some uses, it is desirable to block emissions generated by operation of the camera device 12, such as utilizing a digital camera operating at 30 frames per second or more. For such uses, the heat sinks 59, 63 positioned above and below the circuit board 56 advantageously can be configured to block radio frequency emissions, such as to comply with any applicable rules or regulations. In this regard, when used with control panel 54, the heat sinks 59, 63 can be configured to have the same footprint as the panel so that they are congruent with each other, e.g. rectangular, so as to cover the electronic components presented therein and block RF emissions therefrom.

In the form illustrated in FIG. 26, the first and second lens devices are positioned on the front edge 39 of the brim 16 with the first and second lens devices positioned on opposite sides of a brim fore-and-aft centerline C so that the first and second lens devices are spaced from one another. With this configuration, the lens devices are horizontally spaced from one another, but substantially on the same horizontal plane. This provides a similar vertical frame of reference with slightly different horizontal frames of reference. As stated above, these differing perspectives can be utilized when the media from each lens device is combined to create an illusion of depth in the image or video. Preferably, the lens devices 50, 52 are spaced apart between about 1 inch (~2.5 cm) and about 8 inches (~21 cm), and preferably between about 2 inches (~5 cm) and 4 inches (~10 cm), and more preferably about 2.5 inches (~6.5 cm).

Preferably, with this approach the lens devices 50, 52 are each received within a notch 58 cut into forward edge 39 of the brim insert 24, so that the lens devices 50, 52 are at least partially positioned between the upper and lower major brim surfaces 26, 28. Due to the lens devices 50, 52 being spaced from one another, the devices can be slightly inwardly canted toward the brim centerline C so that the sight line of the lens devices intersect at a focal point forwardly of a wearer of the hat 10. By one approach, the notches 58 can be cut into the brim insert 24 so that the lens devices 50, 52 are directed to the desired cant. By another approach, the lens devices 50, 52 can be held at the desired angle by adhesive, tape, or the like. So positioned, the lens devices 50, 52 can project through openings or holes 68 in the piping material 40 extending about the brim perimeter edge 38.

Figure 27:
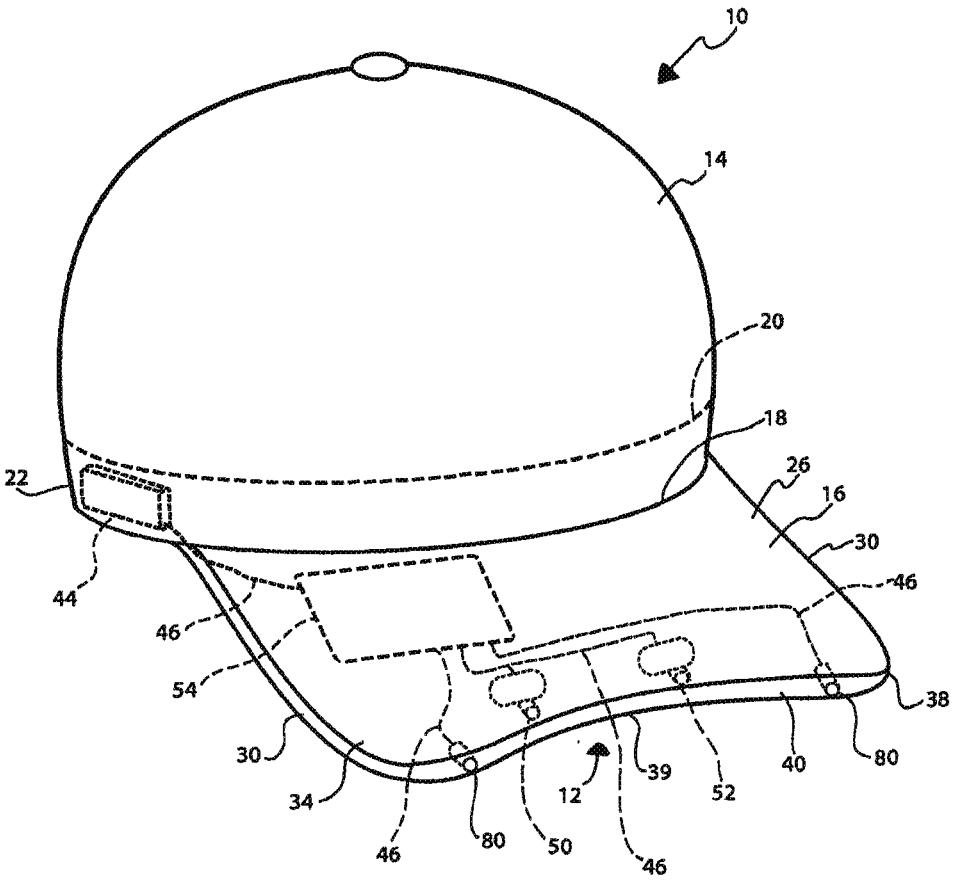
FIG. 27 is a perspective view of a hat with a brim showing a camera device including first and second lens devices mounted adjacent to a lower surface of the brim in electrical communication with a control panel and a power source.
Figure 28:
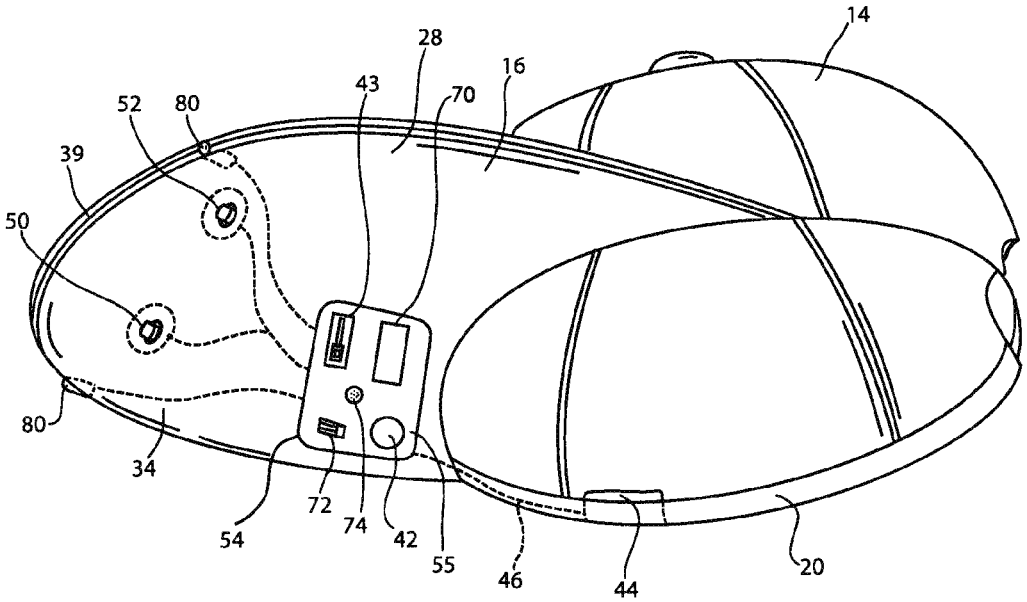
FIG. 28 is a bottom perspective view of the hat of FIG. 27.
Figure 29:
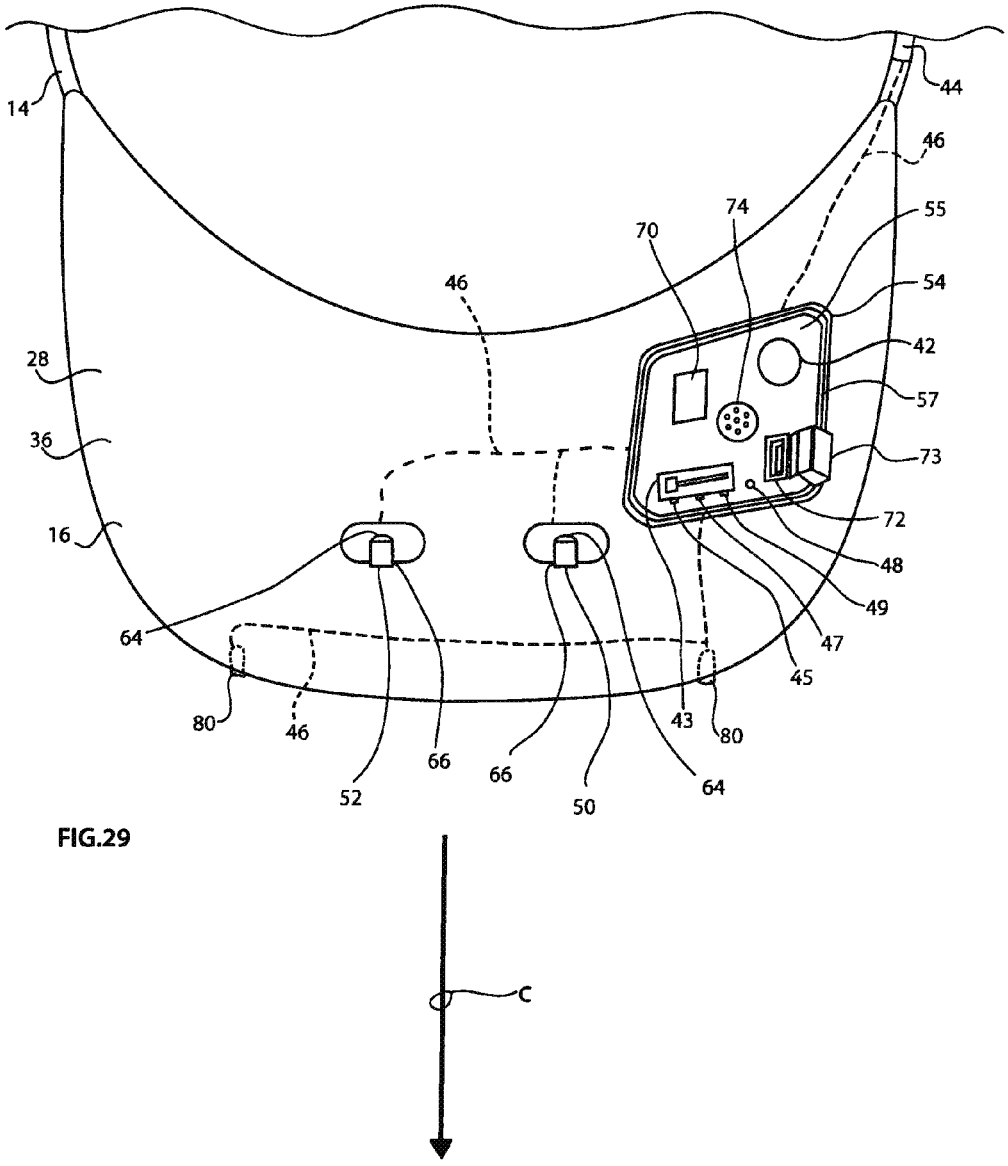
FIG. 29 is a bottom plan view of a brim of a hat showing a camera device including first and second lens devices mounted adjacent to a lower surface thereof in electrical communication with a control panel and a power source.

By another approach shown in FIGS. 27-29, the first and second lens devices 50, 52 are mounted to the brim adjacent to the brim lower major surface 28. With this configuration, the lens devices 50, 52 are also protected by the curvature of the brim 16. The lens devices should project downwardly and forwardly so that the lens devices are positioned to capture media forwardly of the hat 10. Specifically, the lens devices of this form include a base portion 64 that mounts adjacent to the brim insert 24 and a forward portion 66 that extends substantially parallel with the brim 16 so that the lens devices are positioned to capture media generally along the line of sight of a wearer of the hat 10. Additionally, the lens forward portions 66 can include a cant, as discussed above, so that the lens devices are directed generally inward.

U.S. application Ser. No. 12/714,403, filed Feb. 26, 2010, describes in part various methods and apparatus for mounting light sources to the brim lower surface, which is hereby incorporated by reference herein in its entirety. The various methods and apparatus for mounting light sources as described in U.S. application Ser. No. 12/714,403 are equally applicable to each of the lens devices 50, 52 so that the camera lens devices are secured beneath the brim. This advantageously protects the camera components from exposure to the elements, such as sunlight and precipitation, and can protect the camera components from damage if the headgear is inadvertently dropped. Preferably, the lens devices 50, 52 are spaced apart between about 1 inch (~2.5 cm) and about 8 inches (~21 cm), and preferably between about 2 inches (~5 cm) and 4 inches (~10 cm), and more preferably about 2.5 inches (~6.5 cm).

The hat 10 may further include one or more light sources 80 mounted to the brim 16 and/or the crown 14 to provide illumination either to assist in capturing images with the camera device 12, such as a flash, or to simply provide hands-free illumination for a wearer of the hat 10. In one form, the light sources 80 can be mounted to the brim front edge 39 to project light forwardly of the hat 10. In another form, the light sources 80 can be positioned adjacent to the lower or upper surfaces 26, 28 of the brim 16 and directed to project light forwardly of the hat 10.

The hat 10 may further include an electronic storage medium 70, which can be a component of the control panel 54, and can be mounted to the hat 10 or be removable. The storage medium 70 is operably coupled to the camera device 12 to store media captured by the first and second lens devices 50, 52 therein. By one approach, the electronic storage medium 70 is a hard drive mounted to the brim 16, such as the lower or upper surfaces 34, 36 thereof as shown in FIGS. 26 and 29. In such a form, a port 72 can provide access to download images or audio from the electronic storage medium 70. The port 72 can be a USB, mini-USB, a wireless download link, or the like. If desired, the port 72 can include a cover 73 to prevent foreign material from entering the port. By one approach, the cover 73 is formed from a flexible material, such as rubber, flexible plastic, or the like. By another approach, the cover 73 is hingedly attached to the covering panel 55 so that the cover 73 can be pivoted off of the port 70 by a user of the hat 10 while still remaining attached, which prevents the cover 73 from being lost. In another form, the electronic storage medium 70 can be removable, such as a SD card, micro-chip, mini-chip, etc. In this case, the port 72 is sized to receive the removable storage medium 70 therein. In either case, the storage medium 70 is operably coupled to the circuit board 56 to be operated thereby and to the power source 44 to be powered thereby.

The circuit board 56 can further include a processing device, such as a microchip or the like, to process media captured by the camera device 12. The processing device can be configured to automatically process pictures and/or video captured by the first and second lens devices 50, 52. Processing can include storing the media in the storage device, merging the media captured by the lens devices 50, 52 into a single image by superimposing the separate images over one another, or the like.

The hat 10 can include additional electronic components to support or complement the camera device 12. For example, the hat 10 can include the viewfinder or display 152 described above, a microphone 74 to record audio, either in conjunction with the camera device 12 recording of video/images or without associated media. The microphone 74 can be incorporated into the control panel 54 or can be mounted to the brim 16 or the crown 14. Preferably, the microphone 72 is provided on the control panel 54 and electrically coupled to the circuit board 56. The hat 10 can further include a sound system with audio components, including a microphone, speakers, volume control, and memory as described in U.S. application Ser. No. 12/819,067, filed Jun. 18, 2010, which is hereby incorporated by reference herein in its entirety.

Figure 32:
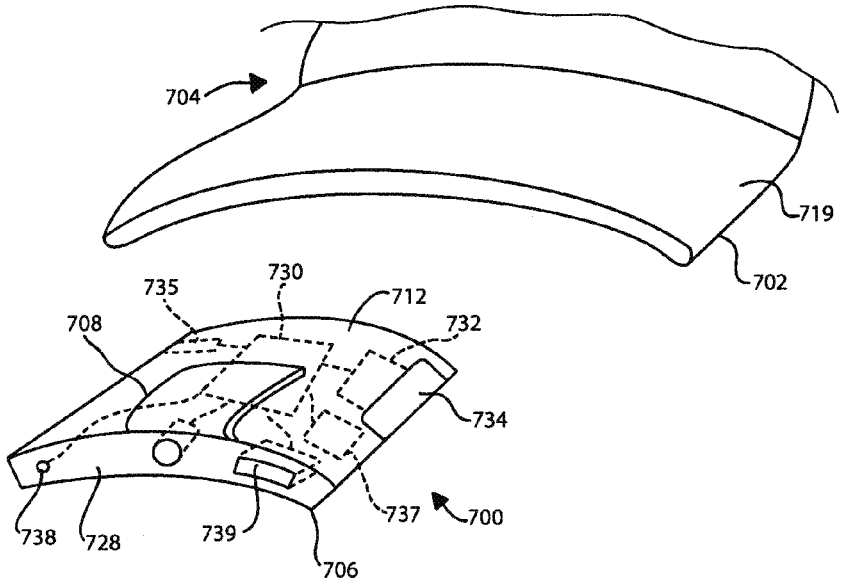
FIG. 32 is a perspective view of a clip-on camera device configured to fit on a brim of a hat.

Another camera device is shown in FIG. 32. As illustrated, a clip-on camera device 700 couples to a brim 702 of a hat 704. A baseball-type cap is shown, but other types of headgear with outwardly projecting brims or brim-shaped structure can be similarly used to mount the camera device 700. The clip-on camera device 700 advantageously mounts to any standard headgear to convert the headgear into a head mounted camera device. The clip-on camera device 700 includes a housing 706 with a clip device 708 mounted thereto. In a preferred form, the housing 706 has a curved concave form so as to generally conform with a curvature of the hat brim 702, which allows the camera device 700 to extend closely along the brim 702 and minimize obstruction of a wearer's field of view. The clip device 708 includes a forward wall 710 that extends from a top or bottom surface 712, 714 of the camera device 700 depending on whether a wearer of the hat 704 wants the camera device 700 to be positioned above or below the brim 702. A rearward wall 716 extends from the forward wall 710 along the camera device 700 to secure the hat brim 702 between the rearward wall 716 and the hat brim 702 when the camera device 700 is mounted to the hat 704. In the illustrated form, the forward wall 710 has an inner surface 717 that closely conforms to the height of the hat brim 702 so that the hat brim 702 is frictionally held by the clip 708. As discussed above with respect to the camera device housing 706, the outwardly extending wall 710 and the rearward wall 716 can conform to a curvature of the hat brim 702, such that the outwardly extending wall 710 has a curved forward surface 718 and the rearward wall 716 has a curved concave form similar to the housing 706. In a preferred form, the rearward wall 716 slants generally towards the camera device housing 706 so that clipping the camera device 700 to the hat brim 702 deforms the clip device 708 and increases the friction holding force therebetween. Alternatively, the rearward wall 716 can be pivotable with respect to the outwardly extending wall 710 or a projection therefrom at a pivot or hinge 720. As such, a spring or the like can bias the rearward wall 716 toward the camera device housing 706 or a protrusion 722 can project from the rearward wall 716 towards the camera device housing 706 adjacent the pivot to pinch the hat brim 702 between the protrusion and the camera device housing 706 when the rearward wall 716 is pivoted. The clip device 708 can also be removable from the camera device housing 706, using suitable structure such as a snap fit, threaded members, or the like, so that a wearer of the hat 702 can choose whether to mount the camera device 700 to upper or lower surfaces 719, 721 of the hat brim 702.

Figure 33:
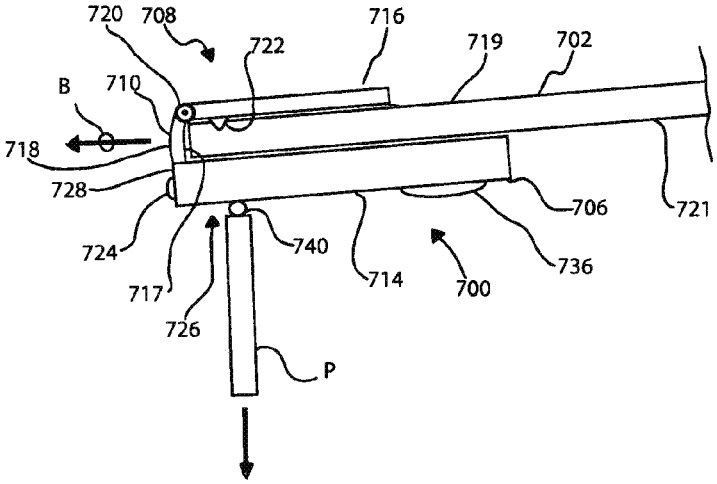
FIG. 33 is a cross-sectional view of the clip-on camera device of FIG. 32 mounted to a brim of a hat.
Figure 34:
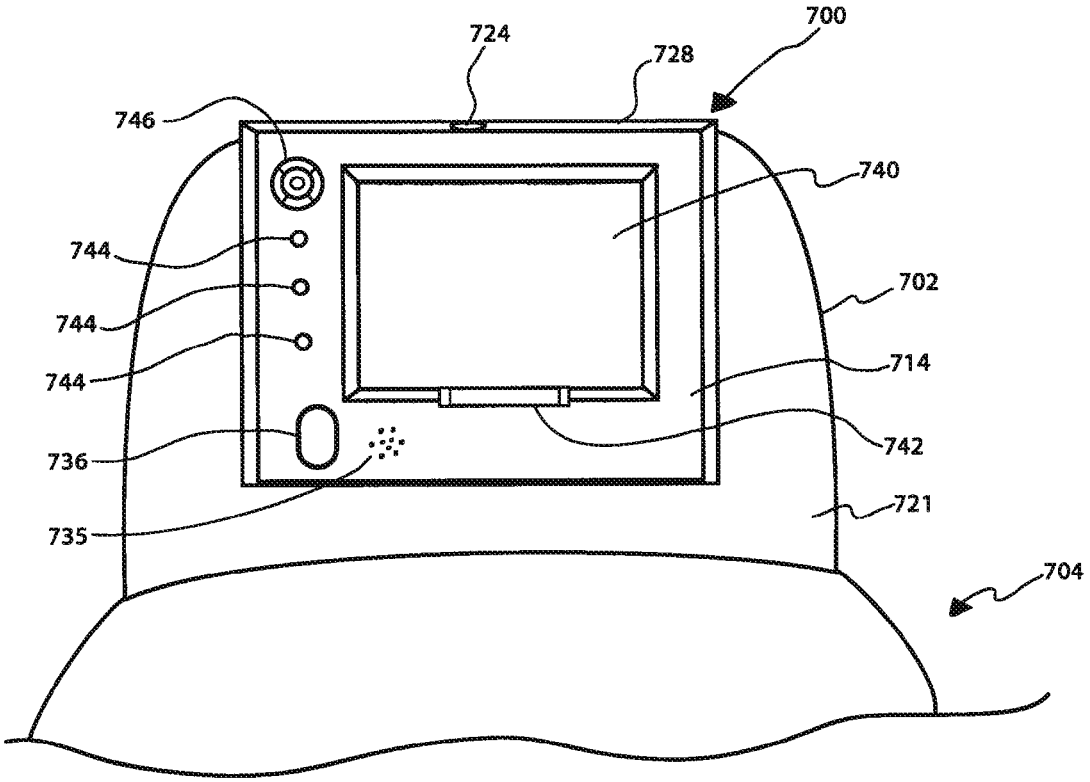
FIG. 34 is a bottom plan view of the clip-on camera device of FIG. 32 mounted to a brim of a hat.

Turning now to details of the camera device 700 and specifically the camera housing 723 as shown in FIGS. 32-34. The camera device 700 includes a camera lens 724 mounted to a forward portion 726 thereof. The camera device 700 can alternatively include two camera lenses as discussed above. Additionally, the lens 724 can be configured so that the camera device 700 has zoom capabilities. The lens 724 can be recessed with respect to a forward surface 728 of the forward portion 726 to protect the lens 724 from damage if the clip-on camera device 700 is dropped. As shown, the forward surface 718 of the clip device is preferably flush with the forward surface 728 of the camera housing 723 so that the clip device does not interfere with operation of the camera device, such as by obstructing the view from the lens 724. The lens 724 can also project beyond the forward surface 728. The lens 724 couples to a circuit board or controller device 730 which is configured to control operation of the camera device 700. The circuit board 730 can be a printed circuit board or the like so that the circuit board 730 can have a curved concave configuration similar to the housing 706, as discussed above. A power source 732 received in the housing 706 is electrically coupled to the circuit board 730 and the lens 724 to provide power to the camera device 700. The power source 732 can be removable from the housing, including, for example, AA, AAA, coin cell, or removable rechargeable batteries. Such batteries can be accessed, removed, and inserted through a door 734 that is pivotable with respect to or removable from the housing 706. Alternatively, the power source 732 can be rechargeable permanently received in the housing 706 and the camera device 700 can include a port or socket 735 to receive a plug that provides recharging power to the device 700, such as from a conventional socket, car socket, or the like.

The camera device 700 further includes a switch device 736 coupled to the circuit board 730 and through the circuit board to the power source 732 and the lens 724. The switch device 736 is configured to operate the lens 724 upon actuation thereof to operate the camera device 700 to take pictures or video therewith. Pursuant to this, the camera device 700 can further include a memory or storage device 737, which can be removable, to store media captured with the lens 724 and/or a microphone 738, including video, audio, and pictures. The microphone 738 is illustrated on the housing forward surface 728, but can be positioned on other portions of the housing 706 as desired. The camera device can also include a speaker 735 to play back the audio recorded by the microphone 738. Additionally, the camera device 700 can include a light source or flash 739 mounted to the housing forward portion 726 to be positioned on the forward surface 728. So positioned, the flash 739 can illuminate generally forwardly of the lighted hat so that media captured by the lens 724 in low light environments is well illuminated.

As shown in FIG. 34, the camera device 700 can further include a display 740 so that an operator of the camera device 700 can view media captured by the lens 724. By a preferred approach, the display 740 can be pivotable with respect to the housing 706 about a hinge or pivot 742. The display 740 can pivot from a stored position extending generally along the brim axis B to a viewing position generally transverse thereto along a pivot axis P. Additionally, the hinge 742 can further be configured to allow the display 740 to be rotated about the pivot axis P generally transverse to the brim axis B. As such, the hinge 742 can be positioned adjacent to the housing forward portion 726 or on a rear portion of the housing 706 and the display can be pivoted or pivoted and rotated to be viewed by a wearer of the hat 704. The display 740 can also be utilized to actively display the image generated by the lens 724 so that an operator of the camera device can see the contents of a prospective picture of video prior to capturing such media. Further, the display 740 can be a touch screen to provide the switch device 736 and/or allow a user to manage the media captured by the camera device 700 or configure settings thereof. Alternatively, physical switches 744 can be provided, which can include a directional pad 746 to cycle through the tables, settings, menus, or the like of the camera device 700.

Figure 35A:
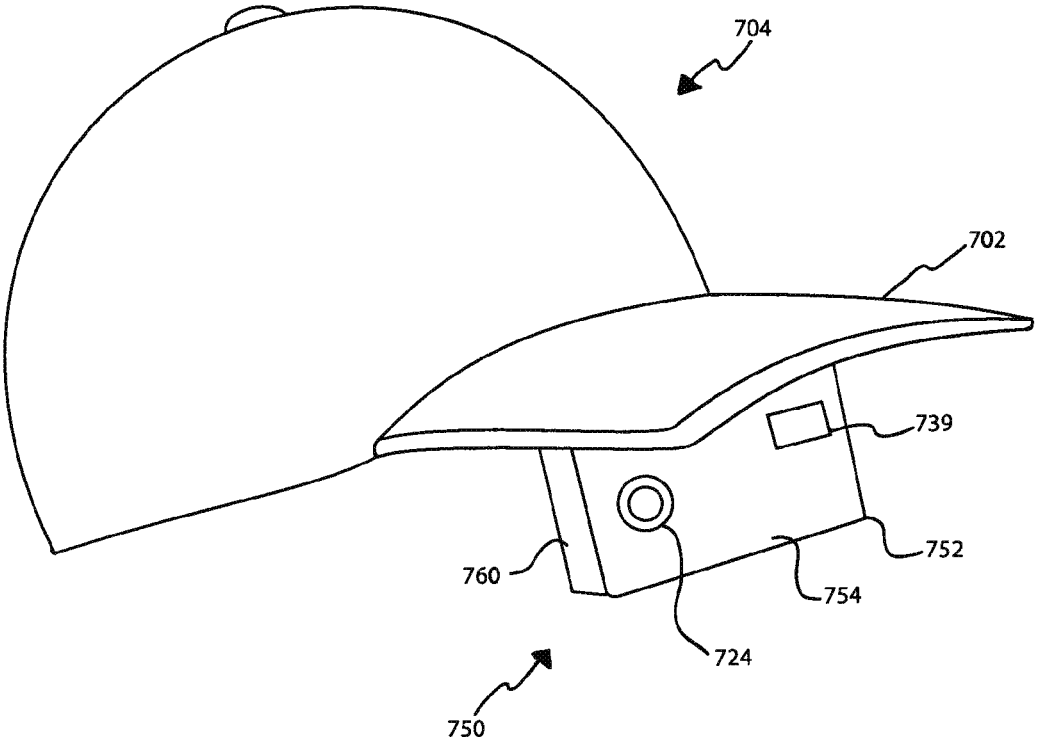
FIG. 35A is a perspective view of a hat with a pivotable camera device mounted to a brim thereof.
Figure 35B:
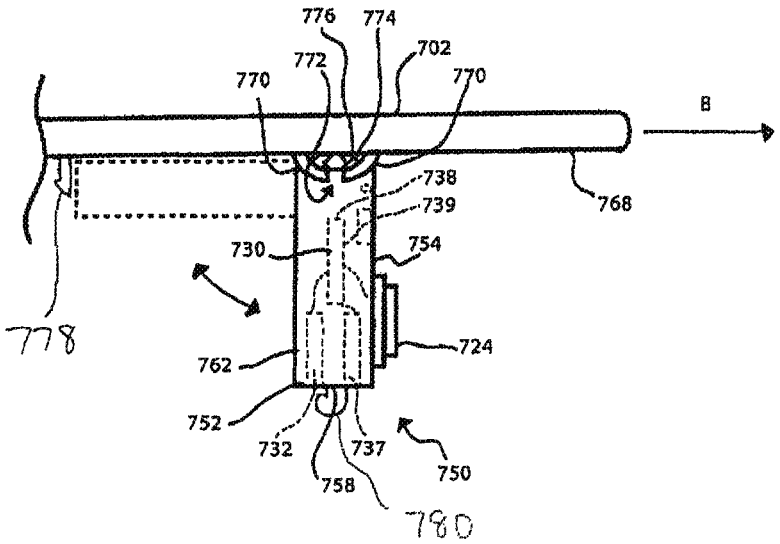
FIG. 35B is a side elevational view of the hat with the pivotable camera device mounted thereto of FIG. 35A showing the camera device in a pivoted use position and a phantom camera device in a stored position extending along the brim.
Figure 37:
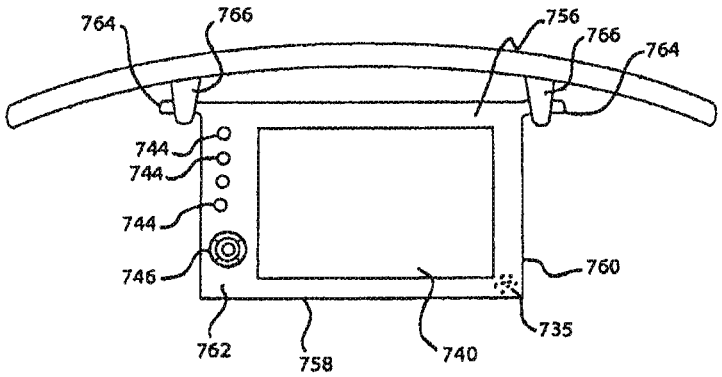
FIG. 37 is a cross-sectional view of the hat with the pivotable camera device mounted thereto of FIG. 35 showing a view of a display of the camera device from a view of a wearer of the hat.

Pivoting camera devices 750, 1200 are shown in FIGS. 35-37. In a first form shown in FIGS. 35A and 35B, the camera device 750 includes many of the same features to the camera device 700 discussed above, so the differences will be described hereinafter. The camera device 750 of this form, pivotably couples to the brim 702 to be entirely pivotable with respect thereto between a stored position, shown in phantom in FIG. 36, extending generally along the brim 702, and a use position, shown in solid in FIG. 36, extending generally transverse to the brim 702 to be within a wearer's line of sight. The camera device 750 includes a housing 752 with a front surface 754, upper and lower surfaces 756, 758, side surfaces 760, and a rear surface 762. If desired, the upper surface 756 can be convex so that the upper surface 756 can be positioned closely to the brim 702 to minimize obstruction of a wearer's field of view when the camera device is in the stored position, while still being able to be pivoted with respect to the brim 702. Similar to the above camera device 700, the camera device 750 includes the circuit board 730, the power source 732, and the storage device 737 for operation thereof. The lens 724, the microphone 738, the speaker 735, and the flash device 739 are disposed in the front surface 754 so that the devices face forwardly of the hat 704 when the camera device 750 is pivoted to the use position. Additionally, the camera device 750 includes the display 740 on the rear surface 762 thereof. As discussed above, the display 740 can be a touch screen, or the camera device can include the switches 744, including the directional pad 746 if desired.

Furthermore, the camera device 750 includes protrusions or tabs 764 that extend outward from each side surface 760 thereof closely adjacent to the upper surface 756. The tabs 764 preferably project generally orthogonal to the side surfaces 760. Cooperating structure is mounted to the brim 702 to receive the tabs 764 to pivotably mount the camera device 750 to the hat 704. Specifically, a pair of prongs 766 are mounted to a lower surface 768 the brim 702, such as an insert or covering material thereof, to receive one the camera device tabs 764 therein respectively. Each of the prongs 766 include convex members 770 extending away from the brim lower surface 768 toward each other such that a gap 772 is left therebetween. The convex shape of the members 770 creates a generally half-circle pocket 774 between the members 768 and the brim lower surface 768. The gap 772 is sized to be slightly smaller than a width of the tabs 764 so that the tabs 764 at least slightly deform the members 768 when the tabs 764 are forced therebetween. Preferably, the members 770 are resilient so that after the tabs 764 are forced therebetween, the members 770 resiliently return toward their original positions. As such, the tabs 764 can be rotated in the pocket 774 to pivot the camera device 750 between the storage and use positions.

The coupling between the camera device 750 and the hat brim 702 preferably includes structure to lock or keep the camera device 750 in the stored and use positions as desired. In one form, the pocket 774 is sized to tightly receive the tabs 764 therein and the tabs 764 include radially facing flat portions 776 that abut and frictionally engage the prong members 770 to hold the camera device 750 in a desired position. So configured, the camera device 750 can be forced to disengage the flat portions 776 to pivot the camera device. In another form, the prongs can include biasing mechanism, such a spring device, that urges the camera device towards the brim 702 to hold the camera device 750 in the stored position. The biasing mechanism can be further configured so that the camera device can be pivoted against the force of the spring to an intermediate position between the stored and use positions. Continuing beyond the intermediate position disengages the biasing mechanism such that the spring force biasing the camera towards the brim 702 is removed and the camera device is allowed to be freely pivoted to the use position. By another approach, the brim 702 can include a downwardly projecting hook member 778 and the camera device 750 includes a catch mechanism 780 on a bottom surface 758 thereof. When the camera device 750 is pivoted to the stored position, the catch mechanism 780 releasably receives the hook member 778 therein to releasably hold the camera device 750 in the stored position. Then, when a user wants to use the camera device 750, the user can tilt or pivot the catch mechanism 780 so that it releases the hook member 778 and the camera device 750 is allowed to pivot.

Figure 36A:
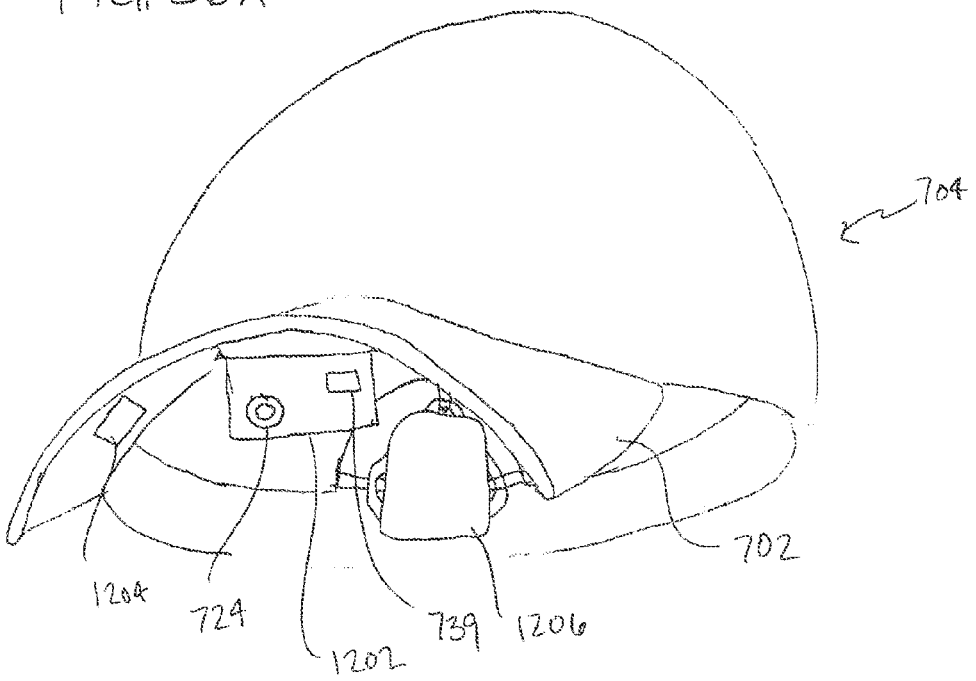
FIG. 36A is a perspective view of a hat with a camera assembly mounted thereto showing a pivotable camera device mounted to a brim portion of the hat and operably coupled to a control panel and battery pack.
Figure 36B:
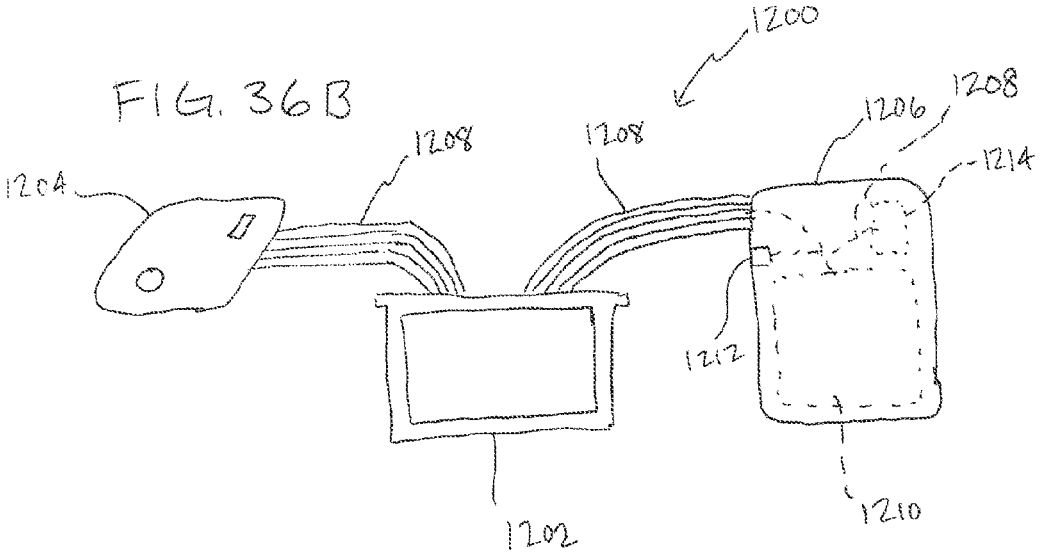
FIG. 36B is a schematic view of the camera assembly of FIG. 36A showing the control panel, pivotable camera device, and battery pack coupled together with electrical connections therebetween.
Figure 38:
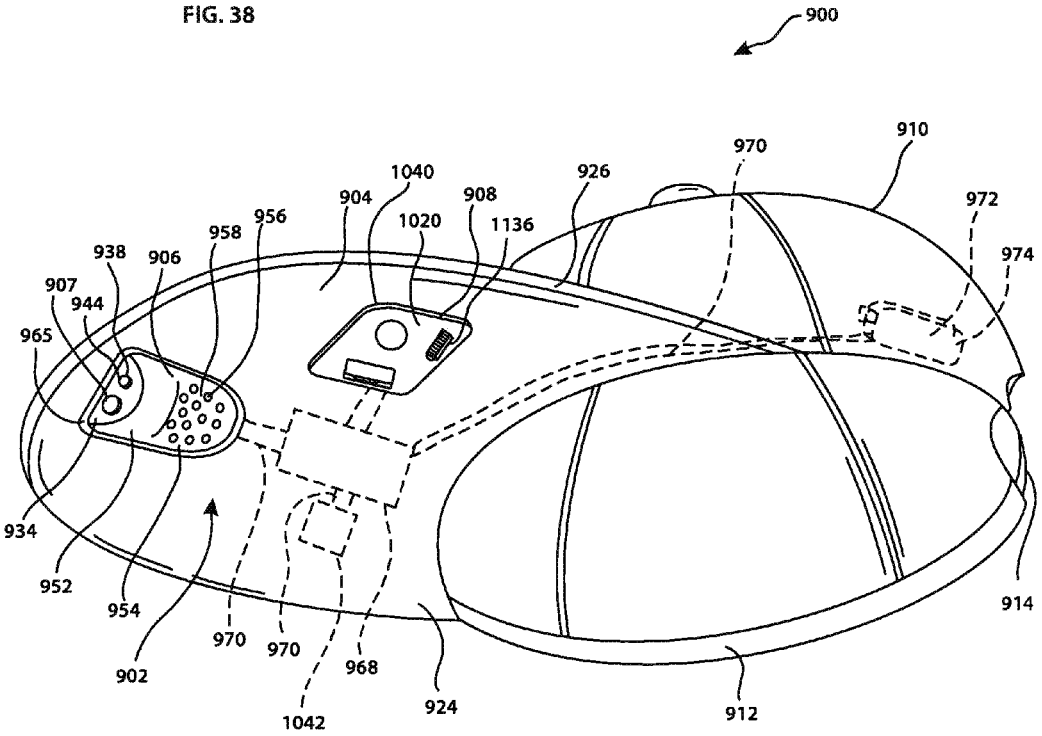
FIG. 38 is a perspective view of a camera hat showing a camera device including a lens housing and a control panel mounted to a brim portion of the hat.

The alternative pivoting camera assembly 1200 is shown in FIGS. 36A and 36B. In this form, the camera assembly 1200 includes a pivoting camera device 1202 substantially similar to the camera device 750 described above, but that is electrically coupled with an external control panel 1204 and external battery pack 1206 by electrical connections 1208 such as wires, electrical ribbon conductors, circuit boards, traces, or the like. As such, the camera device 1202 is lighter and more compact because it does not need to internally house the power source 732, switches 744, or directional pad 746 and their associated circuitry and electrical connections. The camera device 1202 can be pivotably coupled and secured between storage and use positions as set forth above with respect to the earlier described pivoting camera device 750. The control panel 1204 can take the form of any control panels described herein, including the control panels 54, 1804 discussed above and control panel 908 discussed below. As such, the control panel 1202 can include similar control members such as switch devices and the like.

The battery pack 1206 is sized to receive a power source 1210 therein, which can be replaceable, such as AAA, AA, coin cell, or the like, or rechargeable. In the form utilizing the rechargeable power source 1201, the battery pack 1206 can include a port 1212 sized and configured to receive a plug therein from an external power source to recharge the battery 1210. Additionally, the battery pack 1206 can include a storage device 1214 therein, such as a removable or permanent memory card, or the like. The storage device 1214 is electrically coupled to the camera device 1202 through electrical conductors 1208, and, as such, the battery pack 1206 can be utilized to store the memory having any media captured by the camera device 1202, such as photos or videos via the memory card 1214.

Turning now to alternative camera hats 900 shown in FIGS. 38-49. The camera hat 900 of this form is configured to capture images and video forwardly of the hat 900 using a digital camera device 902 mounted to a brim portion 904 of the hat 900. The camera hat 900 includes a lens housing 906 that holds a lens device 907 of the camera device 902 in a fixed orientation generally parallel with the brim 904 extending along the fore-and-aft axis C thereof. The lens device 902 is operably and electrically coupled with a control panel 908 mounted to the brim 904 that is configured to provide a user of the camera hat 900 with control mechanisms for operating the camera device 902. The digital camera device 902 can be configured to operate at less than 30 frames per second or 30 frames per second or more, as discussed above.

The camera hat 900 also includes a crown portion 910 with the brim portion 904 extending from a forward lower edge of the crown portion 910. As set forth in the other forms described above, the crown portion 910 can be made of a fabric material that is generally flexible, such as a plurality of panels sewed together to form the desired dome shape of the crown portion 910. A hat band 912 extends around a lower portion of the crown adjacent to a bottom edge thereof. The hat band 912 can have elastic and/or wicking properties for enhancing the comfort of a wearer of the camera hat 900. The crown portion 910 can also include strengthening structure such as relatively more rigid strips of material sewed along the inside of the crown portion 910. Additionally, the crown portion 910 can be fitted or can have an adjustment strap 914 having a snap fit or hook and loop structure.

In the illustrated form, the brim portion 904 includes a brim insert 916 having upper and lower surfaces 918 and 920. The brim insert 916 preferably has a generally rigid, semi-rigid, or shape-retentive structure that can maintain a curved appearance and provide a base for mounting electronic components. For aesthetic purposes, the brim portion 904 can also include upper and lower fabric coverings 922 and 924 extending over the brim insert 916 and concealing it from view. The fabric coverings 922 and 924 can be stitched to the crown portion 910 where they meet at the rear of the brim portion 904. A piping or edge material 926 extends along an outer edge 928 of the brim insert 916 connecting the upper and lower fabric coverings 922 and 924.

Figure 39:
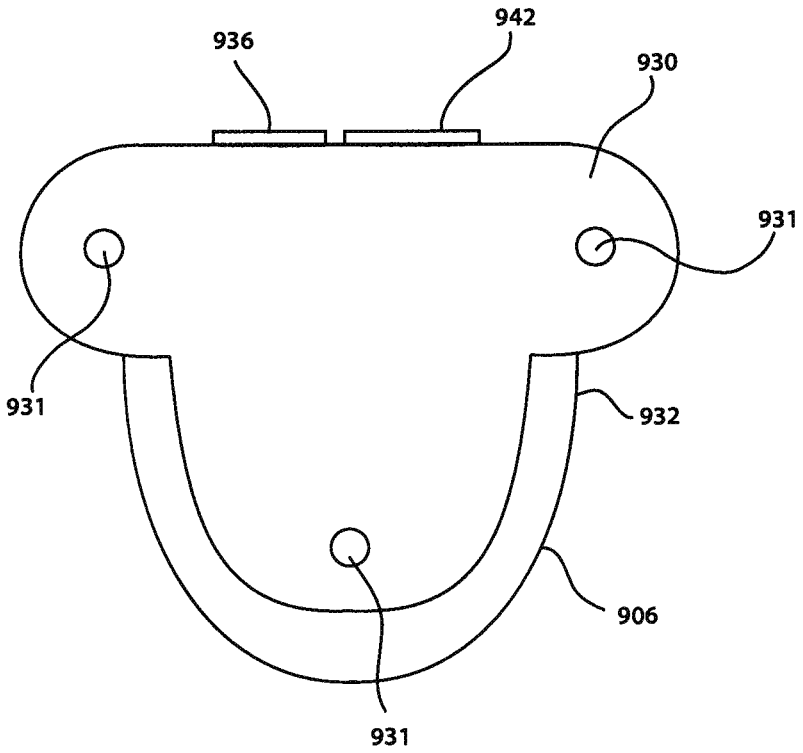
FIG. 39 is a bottom plan view of a lens housing for a camera device showing a base therefor having openings therein for mounting the lens housing to the brim portion.
Figure 40:
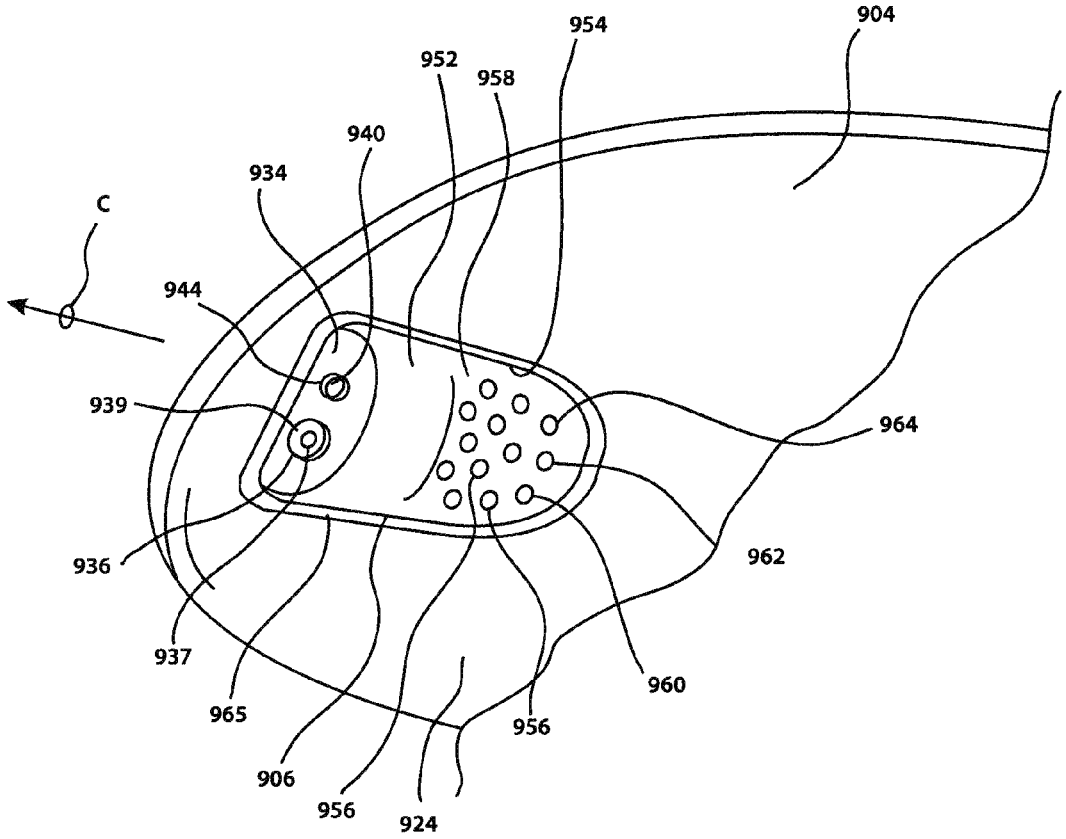
FIG. 40 is a fragmentary view of the underside of the brim portion of the hat showing a lens housing having a lens device, a microphone, and status indicators mounted thereto.
Figure 41:
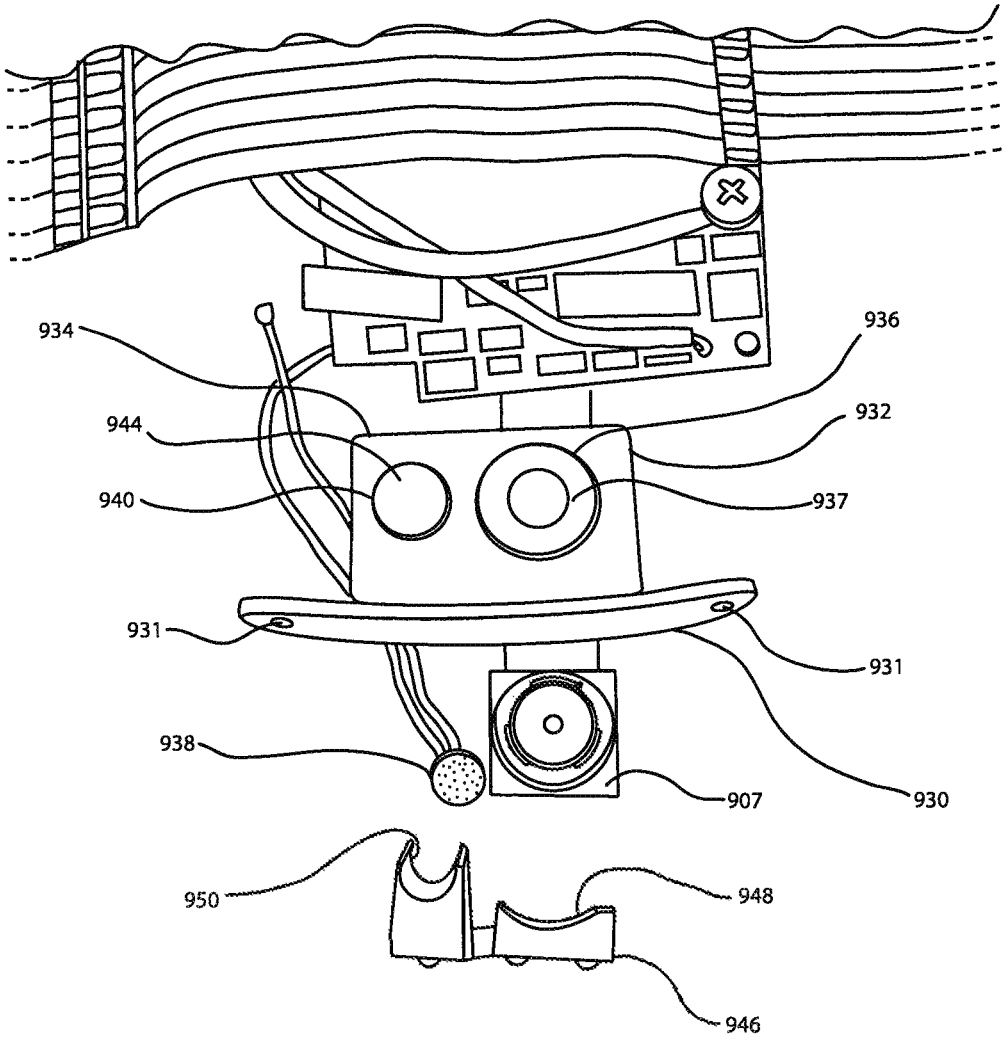
FIG. 41 is a photographic view of an alternative lens housing sized to receive a lens device and a microphone therein and a seat insert to engage the lens device and microphone.
Figure 47:
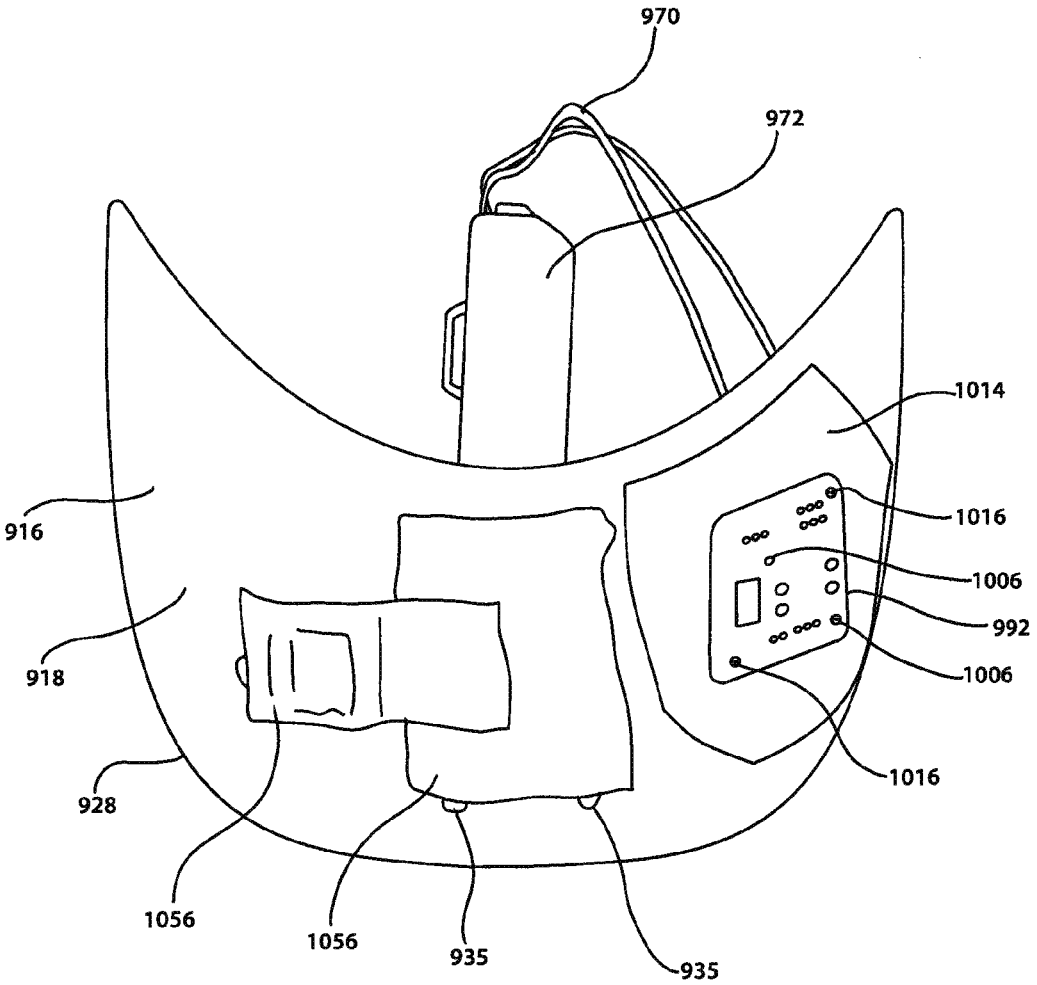
FIG. 47 is a photographic view of a topside of the brim portion insert for a hat showing a radio frequency blocking metallic fabric covering a circuit board and storage device and a control panel circuit board mounted to a thin flexible sheet adhered to the brim portion.
Figure 48:
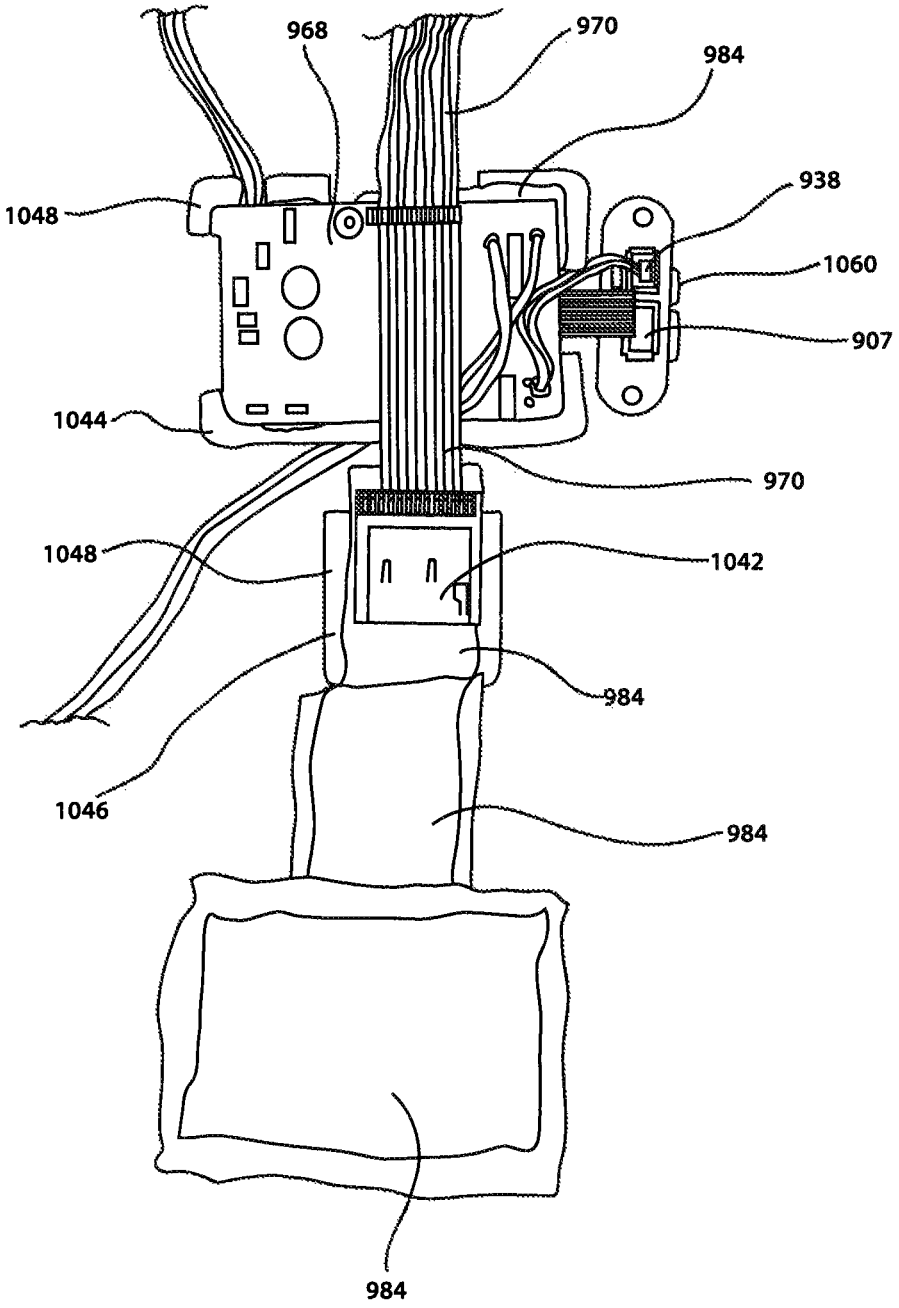
FIG. 48 is a photographic view of a camera device main circuit board coupled to a lens device, microphone, and storage device with the circuit board and storage device received within trays and configured to be covered by metallic fabric.
Figure 49:
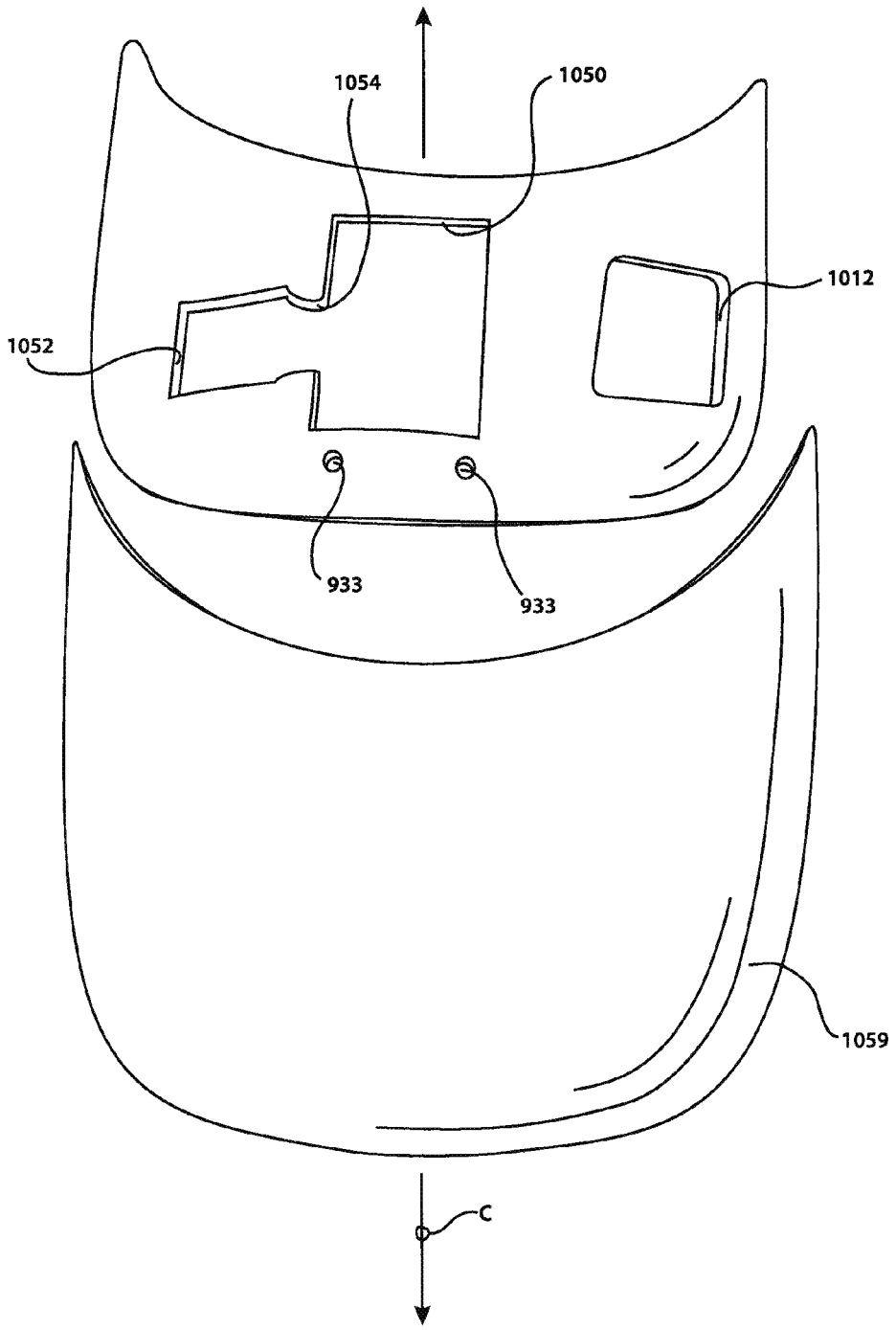
FIG. 49 is a photographic view of the brim insert for a hat having openings therein for mounting camera device components and a brim insert covering member.

Turning now to details of the camera device 902 as shown in FIGS. 38-41. As set forth above, the lens housing 906 is mounted to the brim insert lower surface 920. The housing 906 includes a base 930 configured to be engaged against the brim insert lower surface 920 and a hollow projecting portion 932 that projects away from the brim portion 904. The base 930 is preferably curved so that the lens housing 906 sits flush with the curvature of the brim insert 916. As shown in FIG. 39, the base 930 can have two or more openings 931 therethrough that align with openings 933 in the brim insert 916, preferably adjacent to the edge 928 of the brim insert 916 generally centered on and on the lower surface 920 thereof along the fore-and-aft axis C of the brim portion 904. The openings 931 and 933 are sized to receive rivets 935 therein to permanently mount the lens housing 906 to the brim insert 916. For example, the rivets 935 can have a flanged upper portion and a tubular lower section so that the upper portion engages against the lens housing base 930 and the lower section projects through the base 930 and the brim insert 916. The lower tubular section can then be split into a plurality of portions which are spread outwardly to form an upset rivet head to tightly and permanently secure the base 930 to the brim insert 916 as shown in FIG. 47.

The lens housing 906 includes a camera opening 937 in a forward facing surface 934 thereof. The lens device 907 is inserted into the hollow projecting portion 932 so that it is in aligned position with the camera opening 932 to capture images and/or videos through the camera opening 932. The housing 906 is preferably made of a rigid material, such as plastic or metal, to protect the lens device 907 from physical damage. If desired, the housing can include a forwardly projecting wall 936 that extends forwardly from surface 934 encircling the camera opening 937 having an interior surface 939 that tapers outwardly so as to not interfere with the field of view of the lens device 907. The interior surface can further have a traditional camera lens stepped structure.

In the illustrated form, the lens housing 906 is sized to also receive a microphone 938 therein laterally adjacent to the lens device 907. As such, the lens housing 906 includes a microphone opening 940 laterally adjacent to the camera opening 932 in the forward facing surface 934 so that the microphone 938 can freely record audio, such as audio associated with a video captured by the lens device 907. As shown, another forwardly projecting wall 942 that extends forwardly from surface 934 encircles the microphone opening 940 to create an annular space therebetween. This space can advantageously be utilized to receive a foam insert 944 that minimizes undesired sound created by wind blowing past the microphone 938 from being recorded.

A seat insert 946 is sized to be inserted into the hollow projecting portion 932 of the lens housing 906 after the lens device 907 and the microphone 938 are disposed within the housing 906. As such, the seat alignment insert 946 includes a camera mount 948 and a microphone mount 950. As shown, the mounts 948 and 950 include concave portions configured to engage the annular surfaces of the lens device 907 and microphone 938. With the lens housing 906 mounted to the brim insert 916, the seat alignment insert 946 is captured within the housing projecting portion 932 at its upper side by the brim insert 916 and on its curved seat portions 948 and 950 engages on the lens device 907 and the microphone 938, respectively, so they stay substantially vertically centered in their respective openings 932 and 940.

The lens housing 906 can take any desired form. In a first example shown in FIGS. 38-40, the lens housing 906 includes a generally box-shaped forward portion 952 and convexly tapering rear portion 954. As shown, the rear portion 954 can have a relatively smaller depth than the forward portion 952. The rear portion 954 can also include a plurality of bumps or protuberances 956 spread out in a generally uniform pattern on a downwardly facing surface 958 thereof. The lens housing 906 is configured to project through an opening 959 in the lower fabric covering 924. A gasket 965 can be positioned around the lens housing 906 downwardly and closely adjacent to the base 930 thereof where the lower fabric covering 924 encircles or surrounds the lens housing 906. The gasket 965 preferably elastically engages lens housing 906 and clamps the lower fabric covering 924 adjacent to the lens housing opening 959 therein against the lens housing base 930 so that the fabric 924 does not droop or otherwise have an undesirable appearance as a result of the opening 959 to preserve the aesthetics of the hat.

Additionally, the lens housing 906 can also have status indicators 960, 962, and 964 mounted thereto. The status indicators 960, 962, and 964 can be LEDs having a generally dome-shaped lens so that they can be energized to indicate to a user of the camera hat 900 of the current mode of operation of the hat. For example, the first indicator 960 can correspond to a memory status to indicate to the user that files are being stored, that there is insufficient space for additional files, or the like. The second indicator 962 can be a record indicator showing the user of the hat 900 that the camera device 902 is currently recording images and/or video. The third indicator 964 can be a battery indicator to indicate to a user of the hat 900 that the battery life is low or empty. Moreover, the bumps 956 can have a generally similar appearance to the downwardly projecting lenses of the LEDs 960, 962, and 964 so that when the user is not operating the camera device 902 and the LEDs 960, 962, and 964 are not energized, the LEDs 960, 962, and 964 can then appear to simply be a part of an aesthetic pattern. Alternatively, the indicators 960, 962, 964 can include rearwardly opening hoods therearound to conceal the LEDs from view from a position forward of the hat 900 and preferably from generally peripheral positions as well. The hoods would then allow a user of the camera hat 900 to have a visual indication of the operation status of the hat, but also allow a user to shade the light projected from the LEDs 960, 962, 964 that might alarm or startle an intended target of the camera device 902, such as when trying to discretely capture images and/or videos of wildlife.

Figure 42:
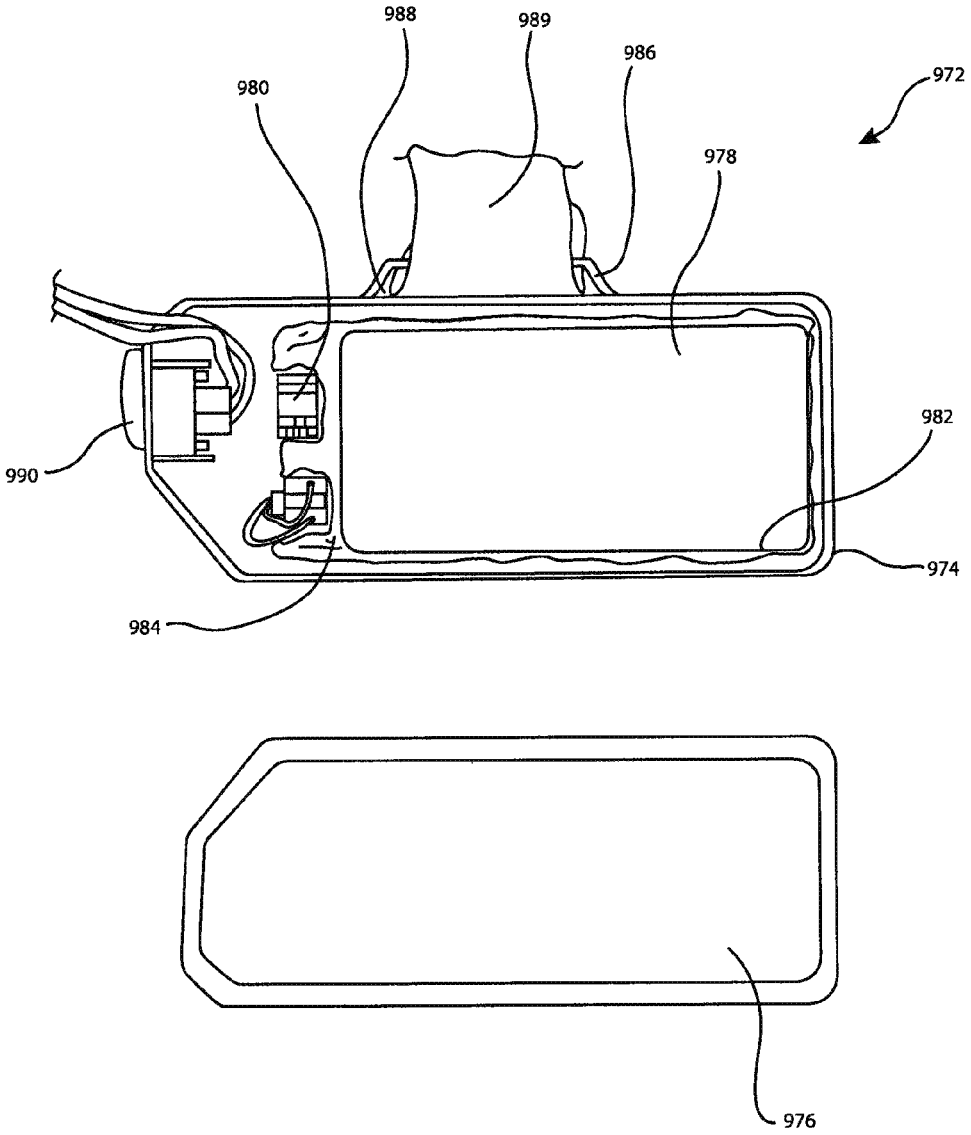
FIG. 42 is a photographic view of a power module showing a housing sized to receive a battery therein and having a switch device mounted thereto.

The lens device 907 and microphone 938 are coupled to the control panel 908 through a main circuit board 968 and electrical connections 970 including wires, ribbon connectors, printed ribbon connectors, traces, solder, and the like. The camera device 902 is powered by a power source 972 mounted to the crown portion 910 or, if desired, the brim portion 904. As shown, the power source 972 is electrically coupled to the circuit board 968 with wiring 970 running along the brim insert 916 and into the crown portion 910. The power source 972 is preferably disposed within the pocket created between the crown portion 910 and the hat band 912. As shown in FIG. 42, the power source 972 includes a housing 974 having a cover 976 to be secured thereto. The housing 974 is sized to receive a battery 978 therein, which is preferably rechargeable. With a rechargeable battery 978, the cover 976 can be permanently secured so that it doesn't have to be removed, such as with ultrasonic welding, snap-fit structure, or the like. A rechargeable battery 978 may require a battery circuit board 980 to condition the electrical energy received at and sent from the rechargeable battery 978. As such, the battery circuit board 980 can preferably be disposed within the housing 974 adjacent to an opening to a rechargeable battery protective covering 982 with electrical connections connecting the rechargeable battery 978 and the circuit board 980 through the opening. A thin, flexible adhesive securing member 984, such as a piece of tape can then cover and secure the battery circuit board 980 to the battery protective covering 982.

Alternatively, if replaceable batteries are desired, such as coin-cell, AAA, AA or the like, the cover 976 can be configured to open, such as with a slide-out snap-fit structure, pivoting tab and slot structure, or the like. The housing 974 can further include a handle member 986 that is preferably integral with the housing 974. The handle member 986 projects from a side of the housing 974 so that a loop opening 988 is defined between the handle member 986 and the main portion of the housing 974. With this configuration, a loop of material 989 can be passed through the opening 988 and attached to the crown portion 910 or the hat band 912 thereof to secure the power source housing 974 to the crown portion 910, such as between the hat band 912 and the lower portion of the crown portion 910 adjacent thereto.

The power source 972 can further include a switch device 990, such as a slide switch, pushbutton switch, or the like, to be a master on/off switch. With this configuration, a user can set the master switch device 990 to the off position, which would disable the camera device from operating despite actuation of other control members or mechanisms. This will prevent unintended operation of the camera device 902 and preserve battery life.

The main circuit board 968 also electrically couples to the control panel 908. More details of the control panel 908 of this form will be discussed with respect to FIGS. 43-47. The control panel 908 includes a circuit board 992 that acts partially as a base for the control panel 908. As discussed above, the control panel 908 includes a variety of control mechanisms on a lower, downward facing surface 994 thereof for operating and controlling the operation of the camera device 902. An operation control member 996, preferably a pushbutton switch, is mounted to the circuit board 992. Actuation of the operation control member 996 is configured to start and stop operation of the camera device 902 to capture images and/or video. A digital media and power transfer interface 998, such as a mini-USB, a USB, or other socket and plug structure, is also mounted to the circuit board 992. The interface 998 is configured to receive a plug therein to download images and video captured by the camera device 902 and provide recharging power to the rechargeable battery 978. For example, the interface 998 can be configured to receive a plug therein that is coupled to computing device or an electrical outlet, such as a wall outlet or a car outlet. The circuit board 992 can also have a resolution switch device 1000, such as a slide switch, mounted thereto to provide a user of the camera hat 900 with the ability to switch between a high definition setting and a relatively lower standard resolution. This conveniently allows a user to select high definition for selected images and/or video, but to preserve file storage space by switching to a lower resolution for images and/or video that do not require high definition. Alternatively or in addition, the control panel 908 can include a momentary switch device configured to operate a zoom function of the lens device 907.

A frame member 1002 is mounted and secured to the lower surface 994 of the circuit board 992. The frame member 1002 has a generally rectangular or diamond-shaped configuration to extend around the control mechanisms, including the operation switch 996, the interface 998, and the resolution switch 1000 that project downwardly away from the circuit board lower surface 994. As such, upper surfaces 1004 of the frame member are generally co-planar to seat flush on the circuit board lower surface 994. As shown, the circuit board 992 and the frame member 1002 have a generally diamond-shaped perimeters and footprints. The circuit board 992 can be secured to the frame member 1002 using screws 1006 that pass through openings 1008 in the circuit board 992 and thread into bores 1010 in the frame member 1002.

The circuit board 992 with the frame member 1002 mounted thereto can then be inserted into an opening 1012 in the brim insert 916 having a perimeter generally the same and equal in size to the diamond-shaped footprint of the circuit board 992 and frame member 1002. In order to prevent the circuit board 992 and frame member 1002 from falling downwardly out of the opening 1012, a thin, flexible sheet 1014 is placed over the opening 1012 on the brim insert upper surface 918 and screws 1016 or the like pass through the sheet 1014 and the circuit board 992 and threadedly engage bores 1018 in the frame member 1002.

Wires 970 connecting the control panel circuit board 992 and the main circuit board 968 extend along the brim insert lower surface 920, so the circuit board 992 and frame member 1002 secured thereto are effectively held in place by the combination of the wires 970 being adhered to the brim insert lower surface 920 and the sheet 1014 extending along and being adhered to the brim insert upper surface 918.

With this configuration, the upper and lower fabric brim coverings 922 and 924 can be disposed over the brim insert 916 and the components mounted thereto. As such, the circuit board 992 and the frame member 1002 are concealed from view. A control panel cover 1020 is configured to be mounted outside of the lower fabric covering 924 and snap fit to the frame 1002 through openings 1021 cut in the lower fabric covering 924. For example, the cover 1020 can include upwardly projecting tabs 1022 with outwardly projecting hooks 1024 that snap fit into grooves 1026 in the frame member 1002 to provide the cover 1020 with a snap-fit connection to the frame member 1002. The cover 1020 includes an operation switch opening 1028, an interface opening 1030, and an elongate resolution switch opening 1032 that are aligned with the fabric cut-out openings 1021 so that the corresponding user-operated components can project through the fabric 924 and be accessible to a user of the hat 900. In the illustrated form, a flexible switch cover member 1034 is positioned above the operation switch opening 1028 extending over and covering the opening 1028. The flexible switch cover member 1034 is configured to be depressed by a user of the hat 900 to engage and depress a plunger of the operation switch device 996 to operate the camera device 902. The flexible cover member 1034 can then resiliently return to its original position along with the switch plunger. Additionally, the resolution switch 1000 includes an actuator 1036 accessible downwardly of the cover 1020 so that the user can slide the actuator 1036 along the elongate opening 1032 between the resolution settings. Next, the interface opening 1030 may include a removable cover 1038 to keep foreign debris from entering the interface 998. The interface cover 1038 can be pivotably attached to the control panel cover 1020 to be pivotable with respect thereto. If desired, a gasket 1040 can be mounted to the cover 1020 between the cover 1020 and the fabric 924. In a preferred form, lower surfaces 1041 of the frame member 1002 are curved to generally align with the curvature of the brim insert 916 in the area where the control panel 908 is mounted to the brim insert 916. In this form, the control panel cover 1020 can be flexible so that it lies flush with the frame member lower surfaces 1041 and therefor follows the curvature of the brim portion 904.

Referring now to FIGS. 46A-48, the main circuit board 968 is also coupled to a storage device 1042 with a ribbon connector 970. The storage device 1042 is operably coupled to the camera device 902 to store images and/or video captured by the camera device 902. The storage device 1042 is further capable of transferring the images and/or video to an external device through the interface 998. If desired, the brim insert 916 can include recessed areas 923 corresponding to areas that do not have one of the camera components mounted thereto. The recessed areas 923 lower the overall weight of the brim insert 916, which otherwise may be relatively heavy due to the components mounted thereto.

In order to block radio frequency emissions in accordance with applicable standards, the main circuit board 968 and the storage or memory device 1042 adjacent thereto can be received in metal trays 1044 and 1046 which can have the tape 984 covering inside surfaces thereof if desired. The trays 1044 and 1046 each have a base wall 1047 that extends over the circuit board 968 and storage device 1042, respectively and side walls 1049 that can have outwardly extending flanges 1048 at ends of the side walls 1049. As such, the trays 1044 and 1046 can be disposed in openings 1050 and 1052 in the brim insert 916 sized to receive the trays 1044 and 1046 and the flanges 1048 engage the brim insert lower surface 920. Preferably, the openings 1050 and 1052 are connected by a channel 1054 so that the main circuit board 968 and the storage device 1042 can be encompassed in a single radio frequency blocking structure or assembly. To cover the open tops of the trays 1044 and 1046 and to span above and below the channel 1054 between the trays 1044 and 1046, a metallic fabric 1056 having an adhesive thereon can be applied to cover any openings and/or gaps. As shown, the metallic fabric 1056 engages and adheres to the flanges 1048 of the trays 1044 and 1046 and the brim insert 916 with strips thereof extending between the trays 1044 and 1046 above and below the channel 1054.

Figure 46A:
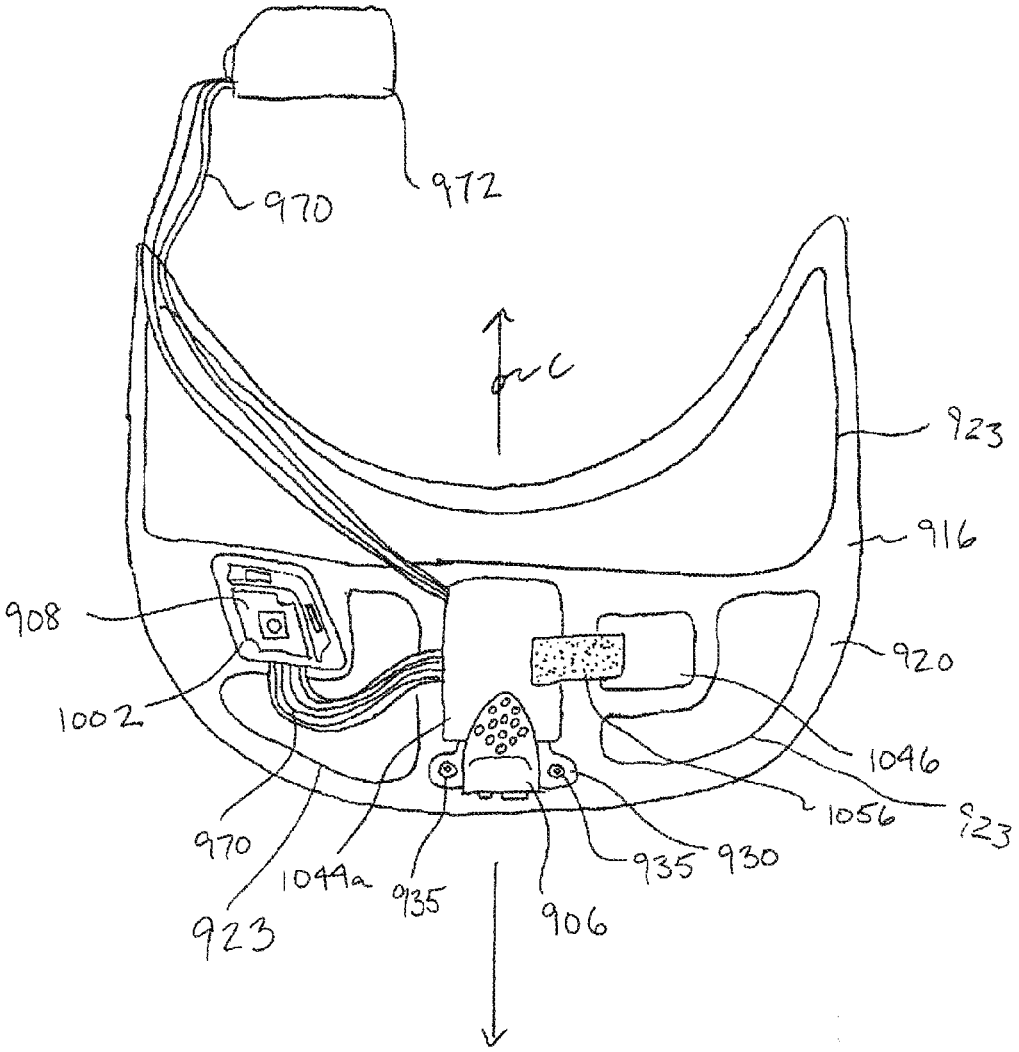
FIG. 46A is a bottom plan view of the underside of a brim insert of the brim portion for a hat showing a camera device mounted thereto including a control panel, a lens housing, and radio frequency blocking trays for receiving a circuit board and a storage device therein showing a central tray longitudinally overlapping the lens housing along the brim fore-and-aft axis.

In the form shown in FIG. 46A, the tray 1044*a* extends forwardly to be adjacent to the lens housing 906, and specifically the rear portion 954 thereof. The lens housing 906 rear portion 954 can extend over the substantially rectangular base wall 1047 of the tray 1044*a*, or alternatively, the base wall 1047 can have a cut-out portion corresponding to the shape of the rear portion 954 so that they overlap in a longitudinal direction along the brim axis C. In another form shown in FIG. 46B, the tray 1044*b* is spaced from the lens housing 1060.

Figure 46B:
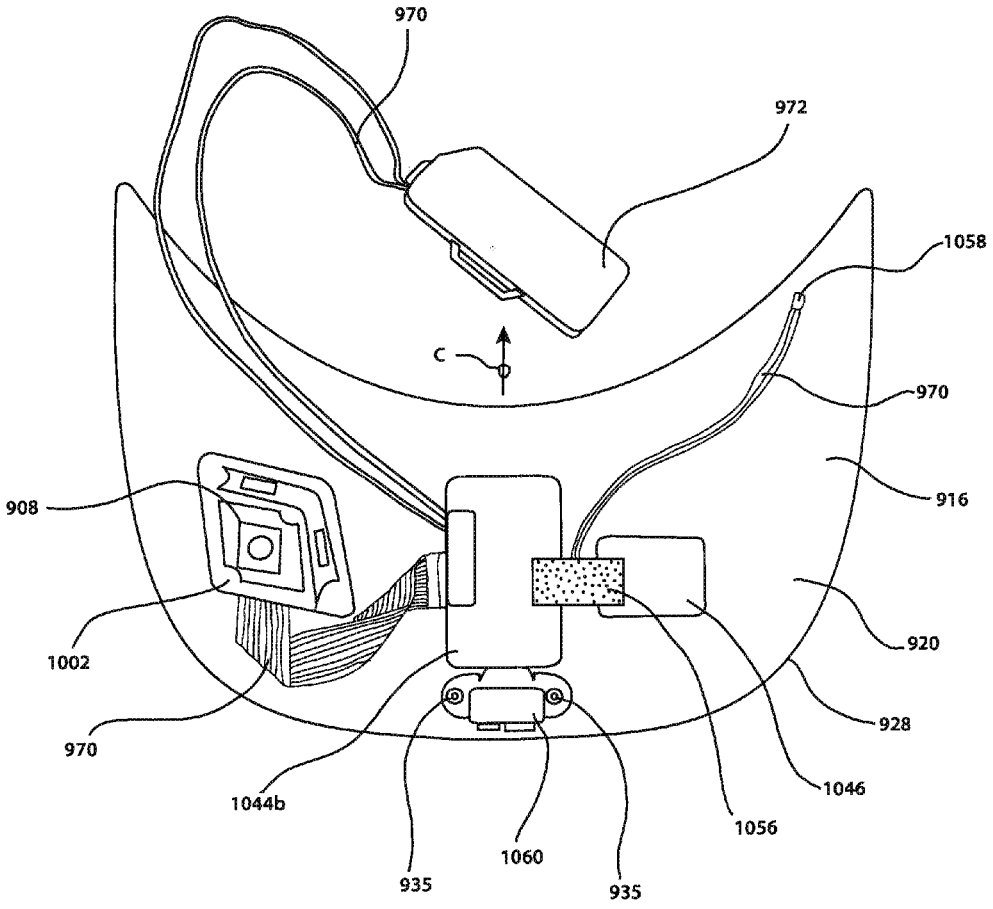
FIG. 46B is a photographic view of the underside of a brim insert of the brim portion for a hat showing a camera device mounted thereto including a control panel, a lens housing, and radio frequency blocking trays for receiving a circuit board and a storage device therein showing an alternative central tray location spaced from the lens housing along the brim fore-and-aft axis.
Figure 46C:
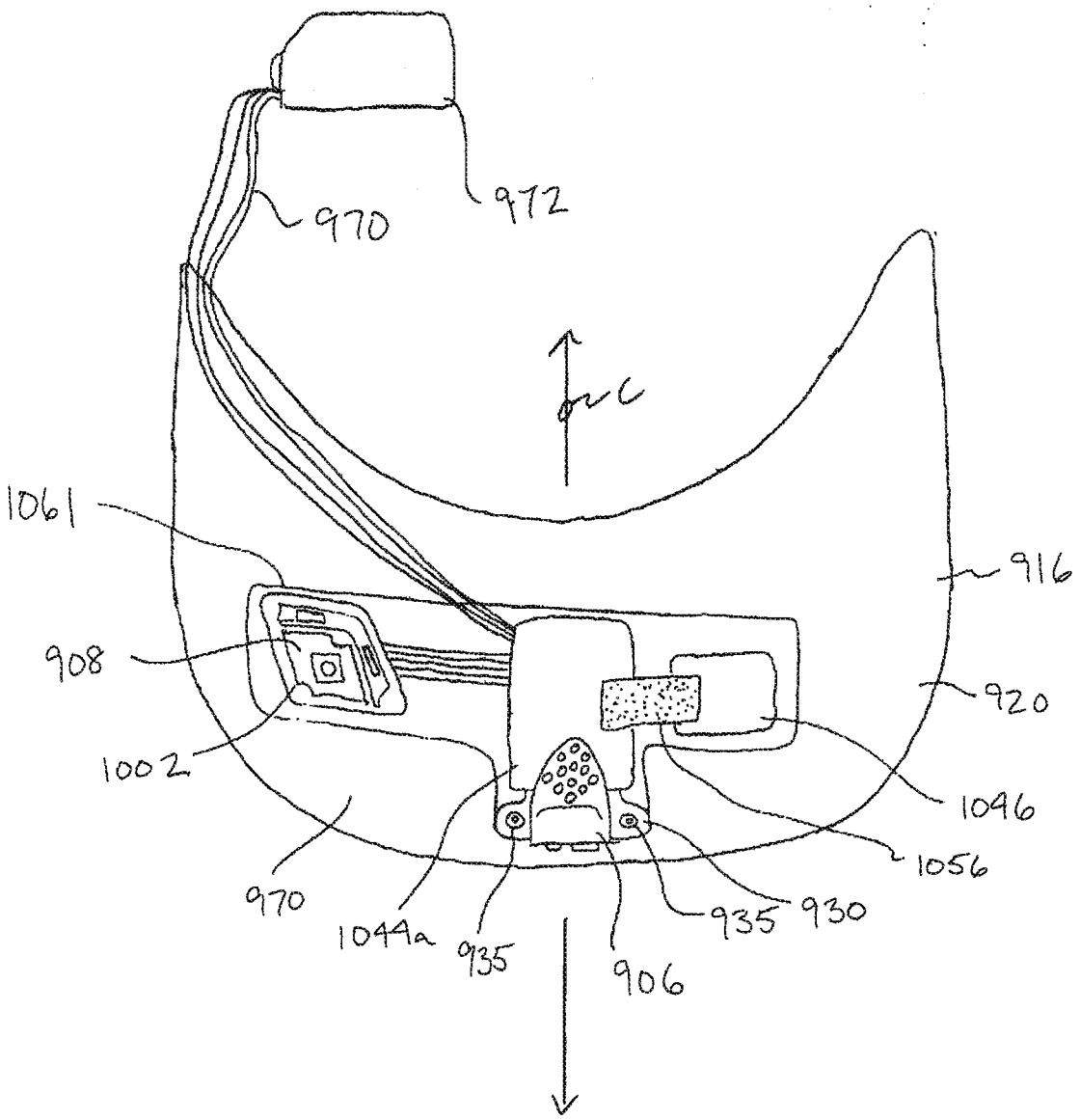
FIG. 46C is a bottom plan view of the underside of a brim insert of the brim portion of a hat showing a camera device mounted thereto in a common housing including a control panel, a lens housing, circuit board, and storage device therein.

By another approach, as shown in FIG. 46C, the camera components mounted to the brim 1916 and discussed with respect to FIG. 46B can be contained within a single housing or enclosure 1061. The enclosure 1061 can be constructed from a heat dissipating material, such as aluminum, copper, or alloys thereof. The enclosure 1061 can further be configured to have a sufficient thickness of material to block radio frequency, so the individual coverage trays 1044, 1046 and the tape 1056 are not required. Additionally, the enclosure 1061 allows the camera components to be pre-assembled and mounted to the brim 916 in a single stop rather than individually mounted.

In a preferred form, the brim portion 904 also includes an insert covering member 1059. The insert covering member 1059 is configured to have substantially the same size and shape as the brim insert upper surface 918 so that it can cover any camera hat components that project above the brim insert upper surface 918 and provide a uniform upper surface for the brim portion 904. Preferably, the insert covering member 1059 has a thin profile so as to not add significant depth to the brim portion 904, but is sufficiently rigid to also prevent any components from being visible by protruding into the brim upper fabric covering 922.

Figure 43:
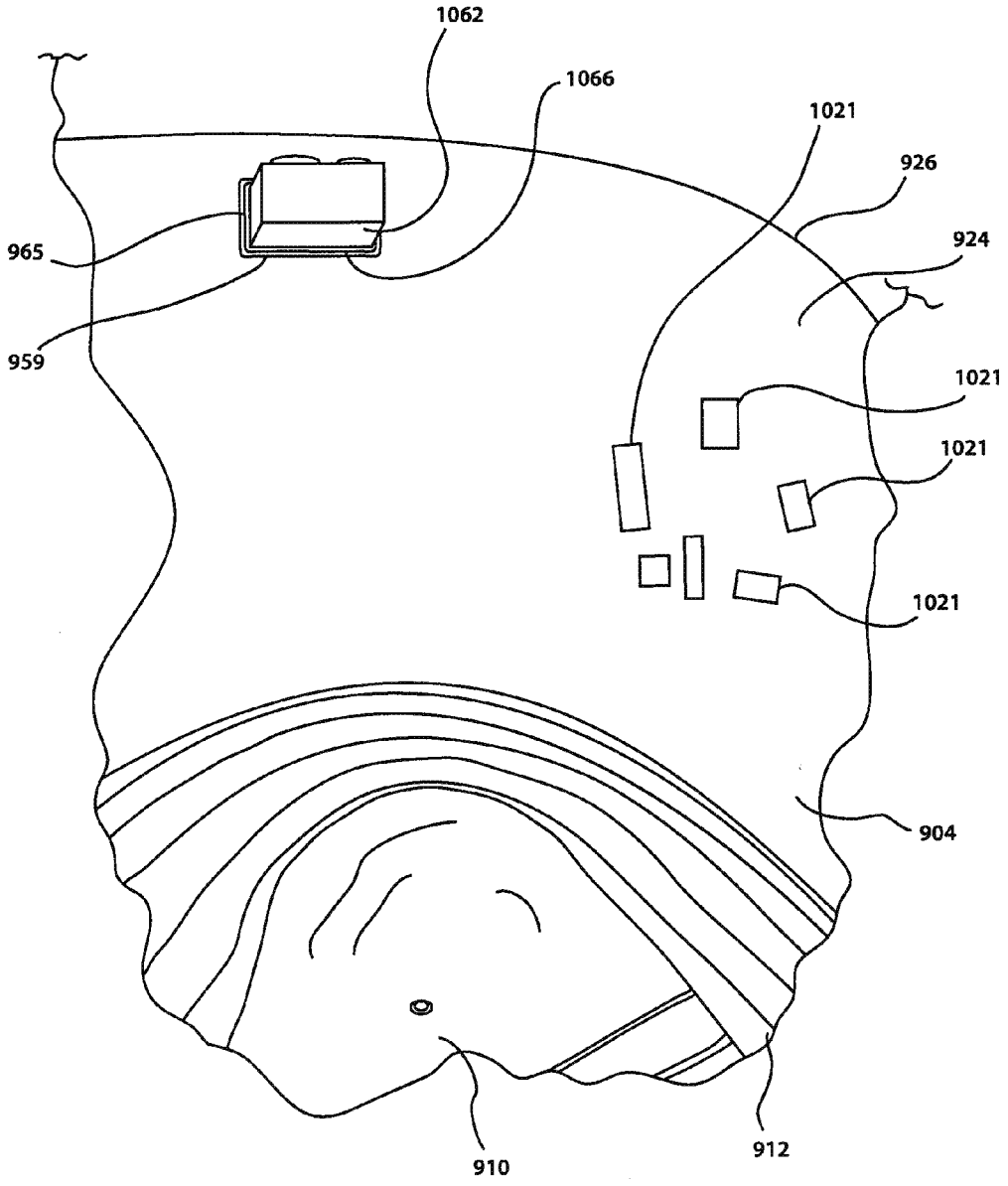
FIG. 43 is a photographic view of a brim portion for a hat showing a lens housing mounted thereto and cut-out openings in a fabric covering thereof for mounting of a control panel.
Figure 44:
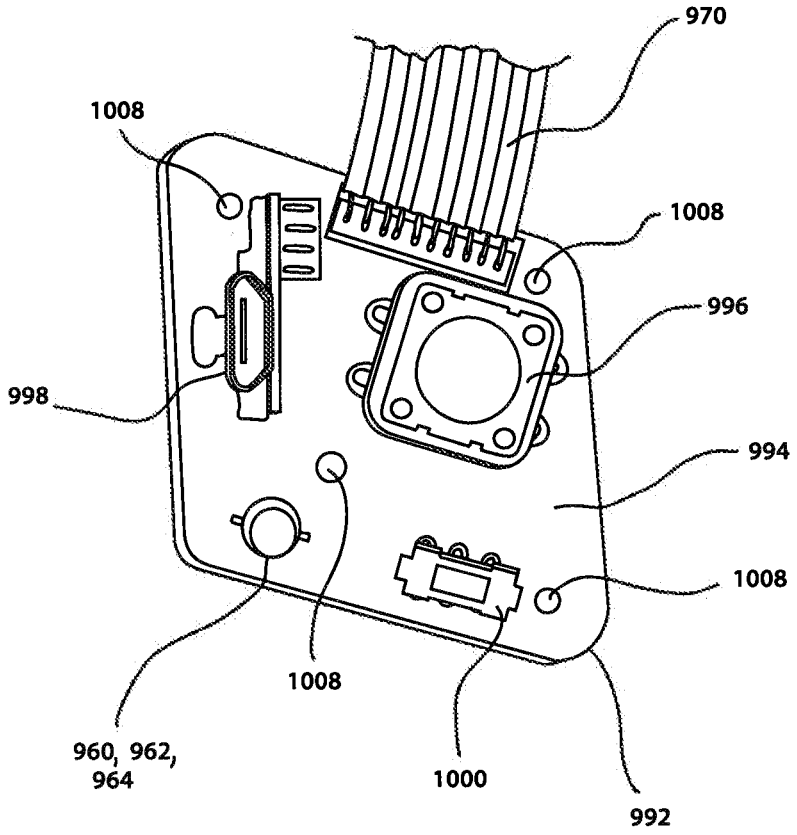
FIG. 44 is a photographic view of a control panel circuit board having an operation switch device, a resolution switch device, an interface for being electrically coupled to a storage device, and a LED mounted thereto.
Figure 45:
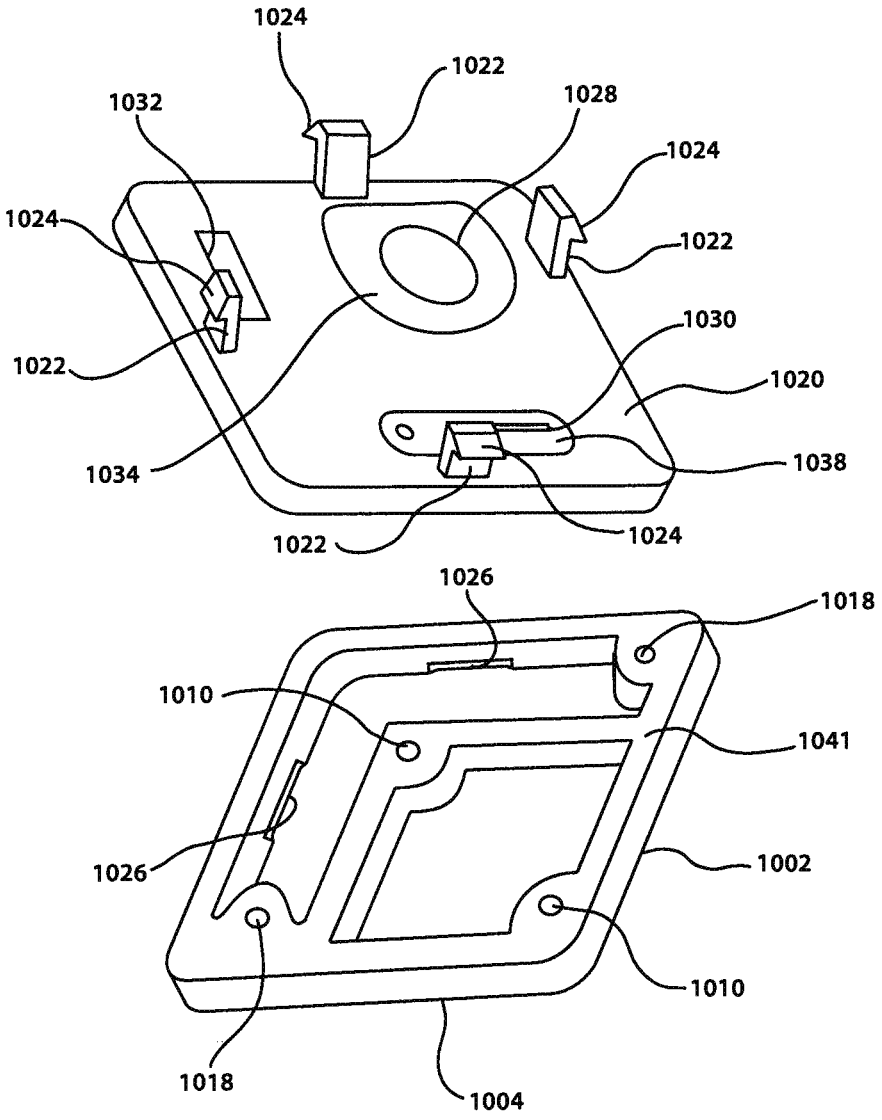
FIG. 45 is an exploded, perspective view of a control panel cover and frame member configured to be connected together.

Another form of a lens housing 1060 is shown in FIGS. 43 and 46. In this form, the housing 1060 does not include the tapering rear portion 954, instead simply having the generally box-shaped forward portion 952. In this form, the status indicators 960, 962, and 964 can be disposed at a rear facing surface 1062 of the lens housing 1060 or can be disposed in the control panel 908 as shown. If in the housing 1060, the LEDs can be recessed so that they cannot be seen forwardly of the hat 900. If in the control panel 908, the control panel cover 1020 can then include hoods 1064 similar to those discussed above to minimize stray light from the LEDs. Moreover, the lens housing 1060 can have a gasket 1066 extending therearound like that discussed above.

Figure 50:
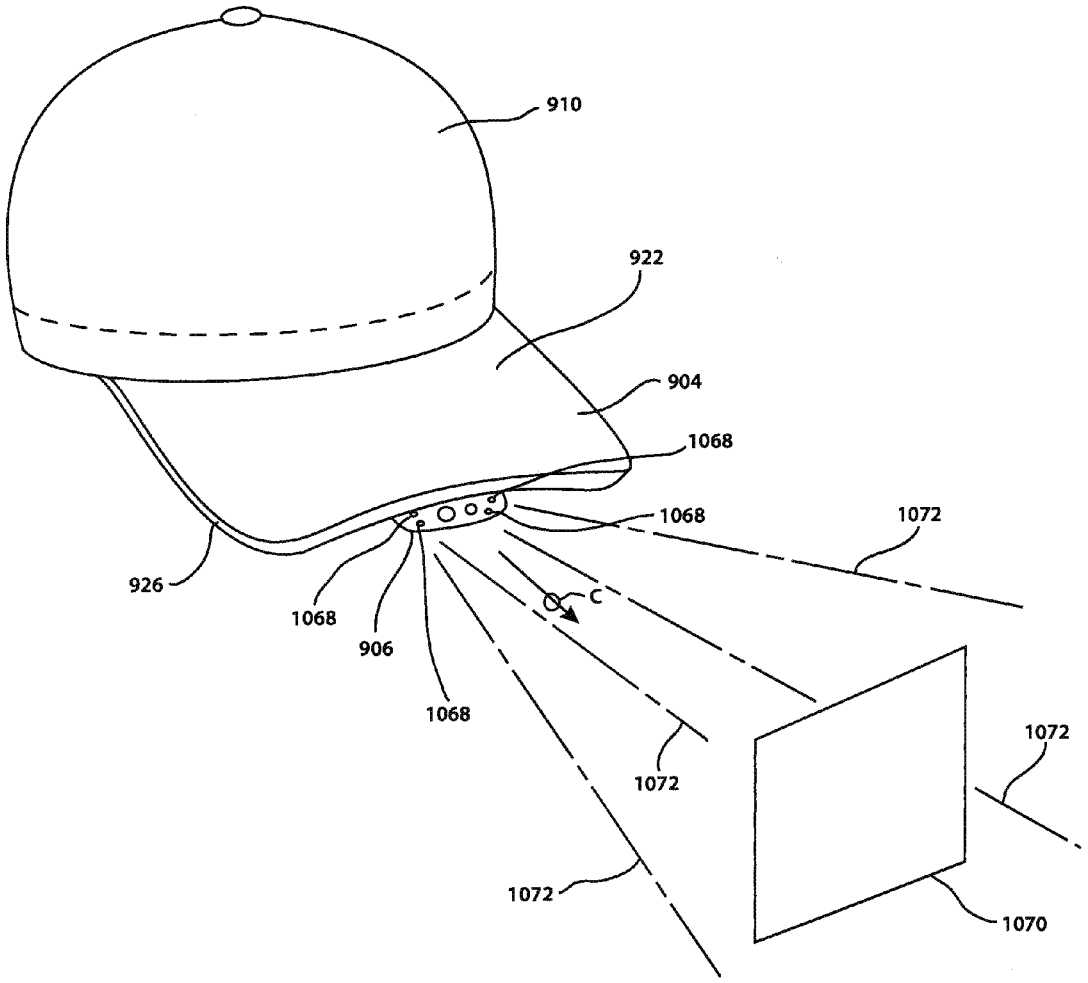
FIG. 50 is a perspective view of a camera hat having a camera device mounted thereto showing a sighting mechanism utilizing laser diodes to frame a camera sighting area forwardly of the hat.

Turning now to various camera sighting mechanisms as shown in FIGS. 50-58. In the form of FIG. 50, the lens housing 906 includes four or more narrow light beam projectors, such as laser diodes 1068 mounted at corners of the forward facing surface 934 thereof. The laser diodes 1068 are configured to frame a camera sighting area 1070 forwardly of the hat 900. For example, laser diode beams 1072 can each be configured to be spaced about 6 inches from an adjacent corner of the camera sighting area 1070 at a range of about 4 feet from the hat 900. With this frame of reference, a user of the hat 900 will know approximately what the camera is focused on for capturing desired images and/or video. The laser diode beams 1072 can be effective to about 15 feet.

In another form of FIGS. 51-54, a sight 1100 has a stored position lying along the brim portion 904 so that it extends generally parallel with the brim fore-and-aft axis C. The sight 1100 is configured to pivot from the stored position to a use position where it extends downwardly generally normal to with the brim portion 904 or perpendicular to its fore-and-aft axis C. The sight 1100 includes a pair of frames 1102 configured to be positioned forwardly of a wearer's eyes with the sight 1100 in the use position. The frames 1102 can be generally circular as shown, have a more oval configuration, or other suitable open or closed shapes, such as a half-circle, square, or the like. The frames 1102 are spaced approximately 65 mm from center to center, which corresponds to a general eye spacing for users of the hat. A central arm 1104 connects the frames 1102 and pivotably couples the frames 1102 to the brim portion 904. The arm 1104 includes a pair of generally arcuate side portions 1106 extending from the frames 1102 toward the centerline C of the brim portion 904. The arm 1104 also includes a generally straight pivoting portion 1108 connecting the arcuate portions 1106. In the illustrated version, the sight 1100 pivotably couples to the brim portion 904 by the pivoting portion 1108 extending through the lens housing 906. The frames 1102 can also include tabs 1109 projecting from a side thereof that conveniently provide a user with a gripping point for easy pivoting of the sight 1100. As shown in FIG. 51B, the tabs 1109 can be downwardly offset from the frames 1102 so that a user can easily grip the tabs 1109 to pivot the sight 1100 from the stored position adjacent to the brim portion 904.

Figure 54:
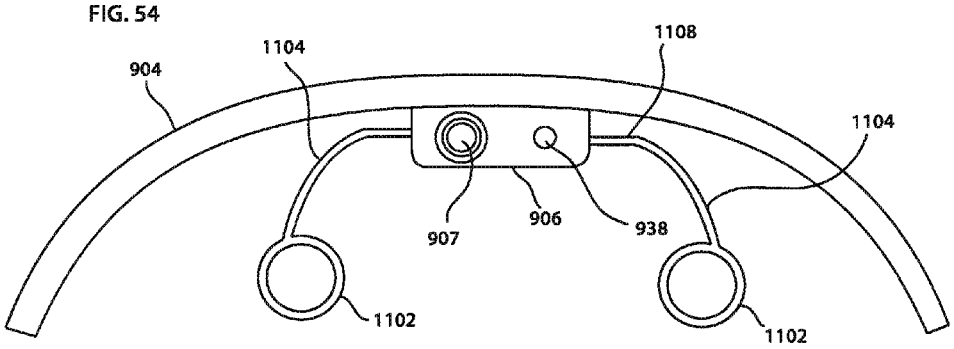
FIG. 54 is a front elevational view of the brim portion of FIG. 51 showing the sighting mechanism pivoted to a use position with the sighting mechanism extending downward generally normal to the brim portion.

A detent mechanism 1110 is shown in FIGS. 52-54 for the sight 1100. The detent mechanism 1110 is configured to releasably hold the sight 1100 in the stored and use positions. To achieve this, the sight pivoting portion 1108 includes a block member 1112 thereon or integral therewith. The block member 1112 includes a generally flat stored face 1114 and a generally flat use face 1116. The brim portion 904 includes a spring 1118 mounted to be secured thereto so that it engages the brim insert 916 at one end thereof. The sight 1100 is mounted to the brim portion 904 so that the block member 1112 compresses the spring 1118 against the brim insert 916. If desired, the brim lower fabric covering 924 or another covering portion can extend between the spring 1118 from the block member 1112. The sight pivoting portion 1108 is vertically restrained from movement by being mounted through or underneath the lens housing 906. With this configuration, the spring 1118 abuts or acts on either the stored face 1114 or the use face 1116 depending on the position of the sight 1100 and the biasing force of the spring 1118 presses against the respective face and therefore in order to pivot the block member 1112, a user must overcome the downward force of the spring acting on the respective faces. Thus, the spring 1118 can substantially hold the sight 1100 in the desired position by preventing undesired rotation of the sight 1100 once it has been pivoted to either the stored or use position.

By one approach, the frames 1102 can be open without lenses or screens therein. As such, the frames 1102 will give a user of the hat 900 a general view of the camera device sighting area 1070, such as with the viewing window of conventional cameras. Alternatively, one or both of the frames 1102 can have a viewing screen therein, such as a liquid crystal display or a clear display having projections thereon. With such a configuration, the arm 1104 can be hollow so that wires can extend therein between the main circuit board 968 and the frames 1102.

Figure 55A:
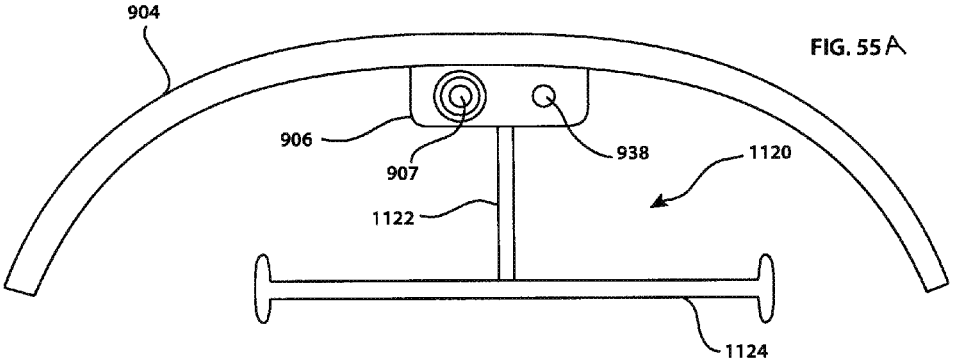
FIG. 55A is a front elevational view of a brim portion for a hat showing a width defining sighting mechanism pivoted to a use position generally normal with the brim portion.

By another approach as shown in FIG. 55A, the hat 900 can include a flip-down width and/or top defining member 1120. The flip-down member includes a central post 1122 connected to a laterally extending width member 1124 at a distal end 1126 thereof. The width member 1124 is configured to provide a visual indication of the width, and optionally the top boundary of the images or video to be taken by the camera device 902 in the sighting area 1070 thereof so that a user of the hat 900 knows the lateral bounds of the image and/or video being recorded. In a preferred form, the central post is about 1.5 inches long and the width member 1124 is about 65 mm wide. Moreover, pivoting of the flip-down member 1120 can be controlled by the pivoting mechanism 1110 discussed above.

Figure 55B:
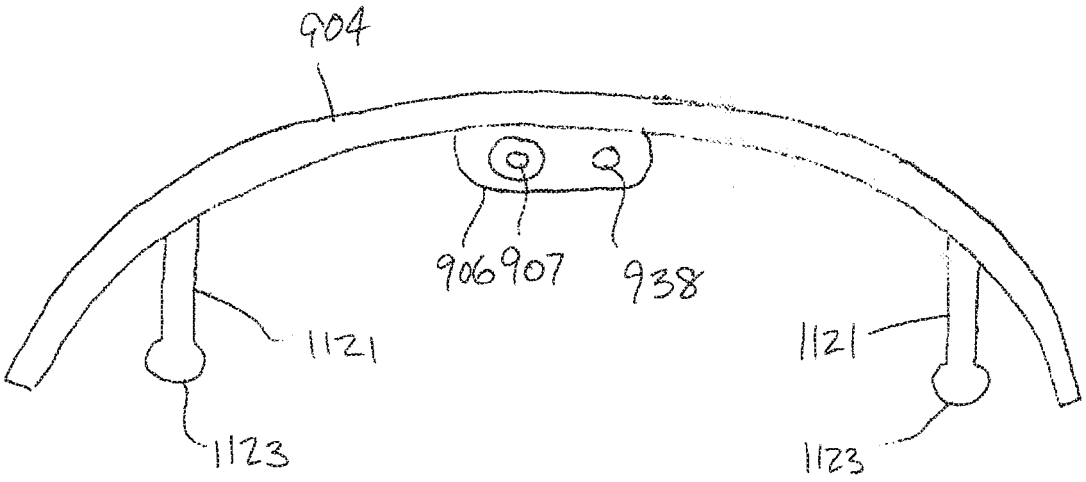
FIG. 55B is a front elevational view of a brim portion for a hat showing a camera sighting mechanism including two posts mounted to the brim portion.

Alternatively, a sight 1119 as shown in FIG. 55B includes a pair of posts 1121 projecting downwardly from the brim portion 904 on lateral sides thereof. The posts 1121 can be positioned so that ends 1123 thereof correspond to the top corners of the camera sighting area 1070 or that a center point between the post ends 1123 corresponds to a center of the camera sighting area 1070. In one example, the posts 1121 are spaced about 2 inches back from a front edge of the brim and are spaced downwardly about 1.75 inches from the camera device 907.

Figure 56:
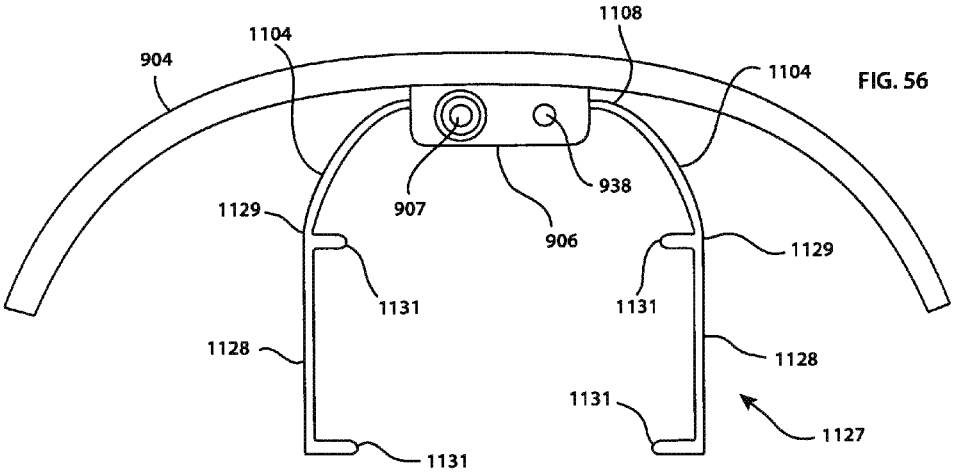
FIG. 56 is a front elevation view of a brim portion for a hat showing a frame defining sighting mechanism pivoted to a use position generally normal with the brim portion.

Another flip-down sight 1127 is shown in FIG. 56. In this form, instead of the frames 1102 or width member 1120 discussed above, the arm 1104 includes generally straight portions 1128 at ends 1129 thereof. The straight portions 1128 define the outer lateral sides of the sighting area 1070 and include inward protrusions 1131 that generally correspond with the top and bottom of the camera sighting area 1070 so that the user can flip-down the sight 1127 and use the straight portions 1128 and the inward protrusions 1131 to frame a desired area for capturing images and/or video. In a preferred form, pivoting of the flip-down sight 1127 can be controlled by the pivoting mechanism 1110 discussed above.

Figure 57:
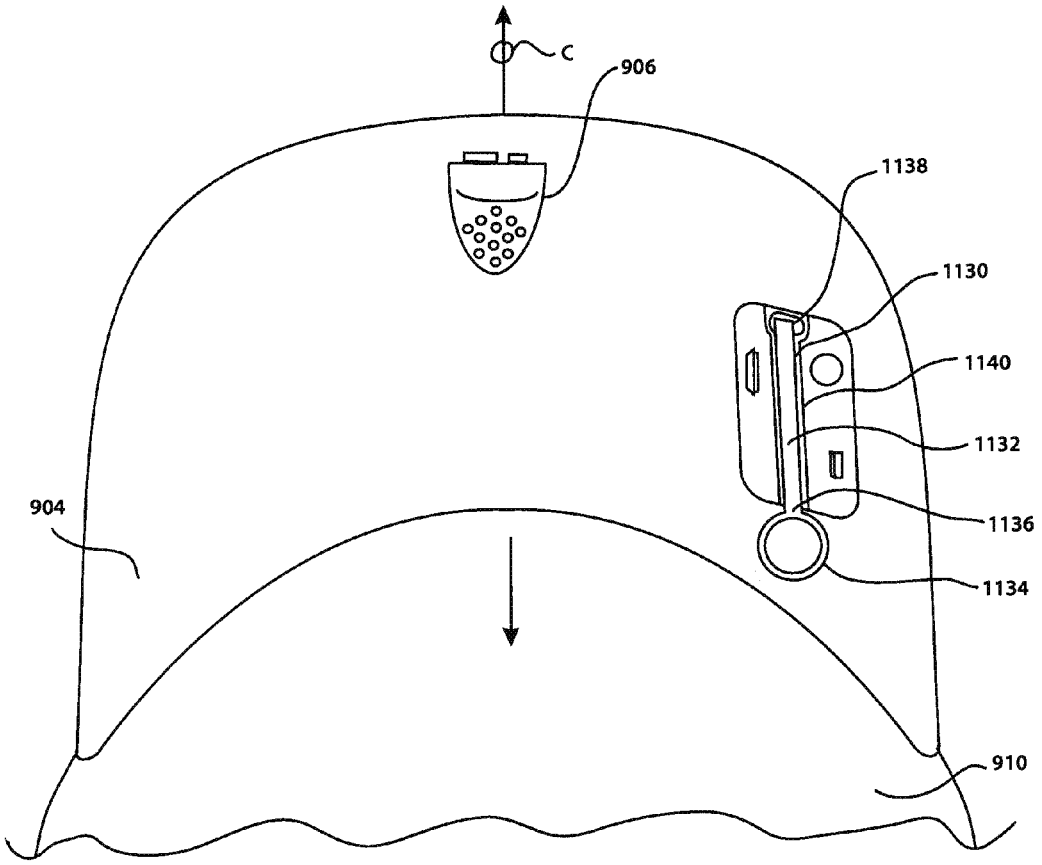
FIG. 57 is a bottom plan view of a brim portion for a hat having a camera device mounted thereto with a control panel and a pivoting sighting mechanism with the pivoting sighting mechanism pivoted up to a stored position.
Figure 58A:
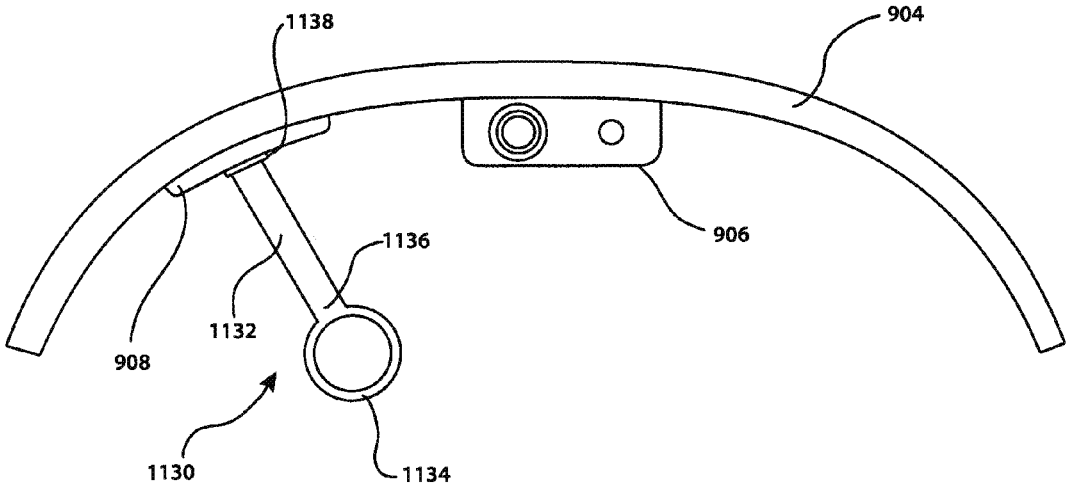
FIG. 58A is a front elevational view of the brim portion of FIG. 57 showing the pivoting sighting mechanism pivoted down to a use position.
Figure 58B:
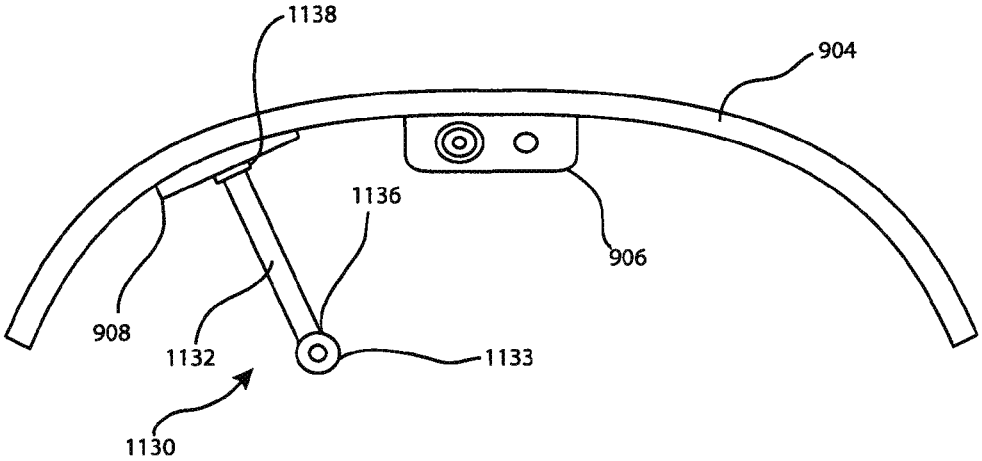
FIG. 58B is a front elevational view of the brim portion of FIG. 57 showing an alternative pivoting sighting mechanism having a tube at a distal end thereof.
Figure 58C:
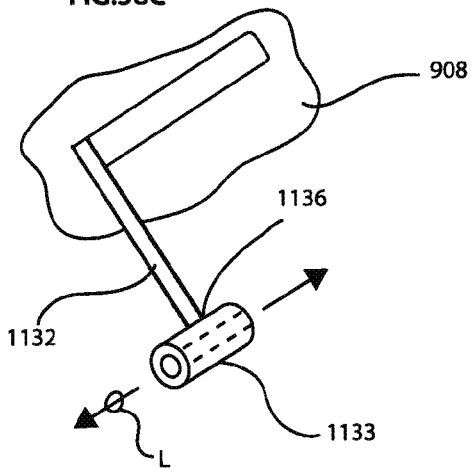
FIG. 58C is a fragmentary perspective view of the brim portion showing the alternative pivoting sighting mechanism of FIG. 58B.

In another form, the hat 900 can include a pivoting sight 1130 that is mounted to the brim portion 904 offset from the centerline thereof as shown in FIGS. 57-58B. In this form, the sight 1130 includes a post member 1132 attached to a frame 1134 at a distal end 1136 thereof. The frame 1134 can be configured similarly to the frame 1102 discussed above. The post member 1132 pivotably couples to the brim portion 904, such as the brim insert 916 or the control panel 908, with a hinge or ball joint 1138. With this configuration, a user can pivot the frame 1134 about the ball joint 1138 to a position forwardly of their eye, so that the user can preview an image and/or video to be recorded by the camera device 902. If desired, the sight 1130 can be incorporated into the control panel 908 so that the post member 1132 lies along the control panel cover 1020 or in a channel 1140 therein. By another approach as shown in FIGS. 58B and 58C, the post member 1132 can have an elongate tube sighting portion 1133 at the distal end 1136 thereof. The elongate tube sighting portion 1133 advantageously requires a user to closely align their view of one of their eyes down a longitudinal axis L of the elongate tube in order to see clearly through it. As such, the tube sighting portion 1133 can provide a user a relatively more accurate sighting point than the above discussed more open frame 1134 without much axial length thereto. If a user can see clearly through the tube sighting portion 1133, then the user has a more definite or clear indication of the field of view of the camera device 906.

Figure 59:
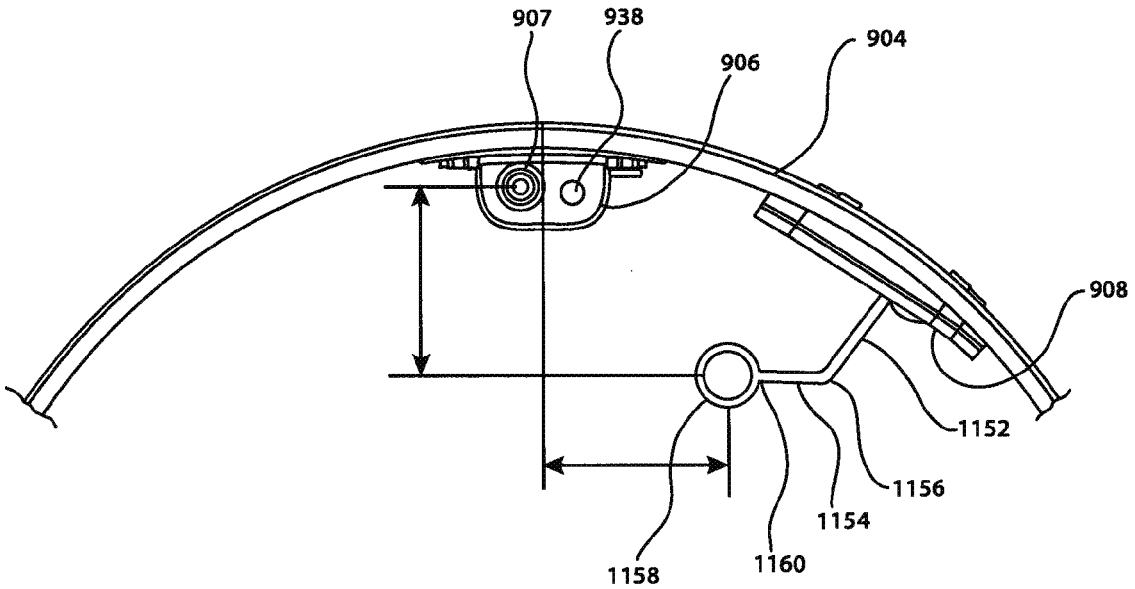
FIG. 59 is a front elevational view of a brim portion for a hat having a camera device mounted thereto with a control panel and an alternatively pivoting sighting mechanism with the alternatively pivoting sighting mechanism pivoted down to a use position.
Figure 60:
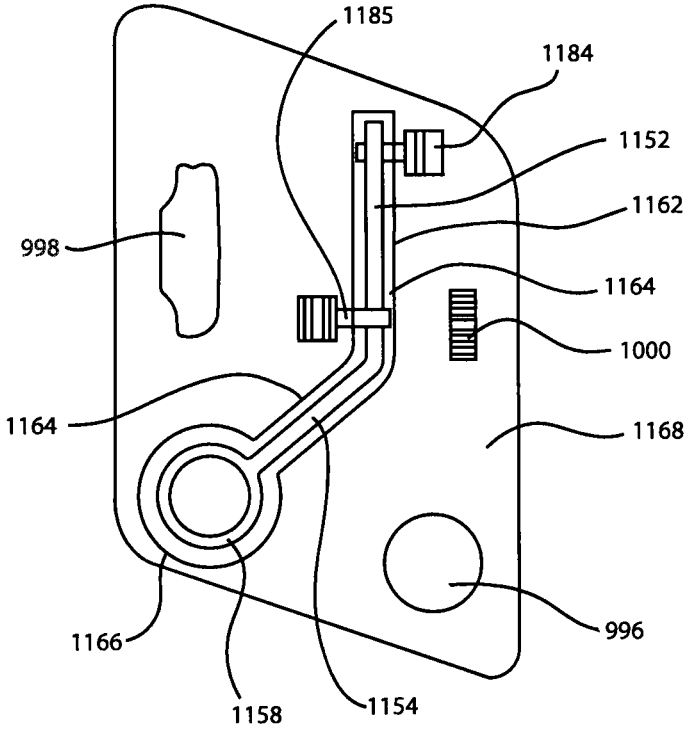
FIG. 60 is a bottom plan view of an alternative control panel for a camera device having an operation switch, a resolution switch, and interface for being electrically coupled to a storage device, and the pivoting sighting mechanism of FIG. 59 pivoted up to a stored position and received within a correspondingly configured recess.

Another pivoting sight 1150 is shown in FIGS. 59 and 60. The pivoting sight 1150 includes base post member 1152 extending downwardly and inwardly in a generally normal orientation to the brim portion 904 and a neck member 1154 extending laterally inwardly from a distal end 1156 of the base member 1152. A frame 1158 is disposed at a distal end 1160 of the neck member 1154. Preferably, the base member 1152, the neck member 1154, and the frame 1158 are integrally formed of a suitable substantially rigid plastic or metal material. As shown, the frame 1158 is generally annular with an open center portion; however, other suitable shapes can also be utilized. Alternatively, the frame 1158 can generally transparent or translucent and have a solid construction without the open center portion.

The base and neck members 1152 and 1154 are sized and configured so that when the pivoting sight 1150 is pivoted to the use position, the frame 1158 is positioned downwardly and outwardly from the brim portion center line C and the lens housing 906 mounted thereon. Preferably, when in the use position, the frame 1158 is about 25 mm to about 30 mm downward of the brim center line C and is about 30 mm to about 35 mm laterally outward of the brim center line C, and more preferably about 28 mm and 32 mm respectively.

Turning now to FIG. 60, the pivoting sight 1150 is shown in a preferable mounting configuration. The pivoting sight 1150 is pivotably mounted to an alternative control panel 1160. The alternative control panel 1160 can include the operation switch device 996, the interface 998, and the resolution switch device 1000, as discussed above. In this form, however, the control panel 1160 includes a recess 1162 therein sized and shaped to receive the pivoting sight 1150 therein when in the stored position. The recess 1162 can include connected elongate channels 1164 to receive the base and neck members 1152 and 1154 of the pivoting sight 1150 and a generally annular recess 1166 at an end thereof to receive the frame 1158. Preferably, the recess 1162 is sufficiently deep so that when the pivoting sight 1150 is disposed therein, it is flush with or recessed from a downward face or surface 1168 of the control panel 1160. So configured, the pivoting sight 1150 is easily accessible to a user of the camera hat to be pivoted between the use and stored positions. If desired, the pivoting sight 1150 can be controlled by the pivoting mechanism 1110 discussed above. In an alternative form, however, the pivoting sight 1150 can be spring loaded to pivot to the use position using a spring loaded stop mechanism 1170 discussed in more detail below with respect to FIGS. 61-64.

Figure 61:
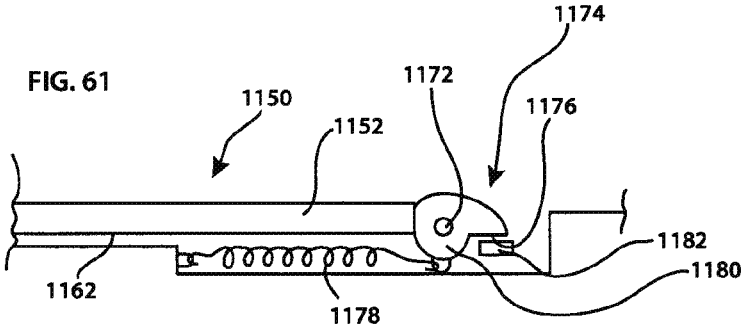
FIG. 61 is a cross-sectional side view of a spring loaded stop mechanism for a pivoting sighting mechanism showing the pivoting sighting mechanism in a stored position and being restricted from being pivoted to a use position by a blocking member engaging the pivoting sighting mechanism.
Figure 62:
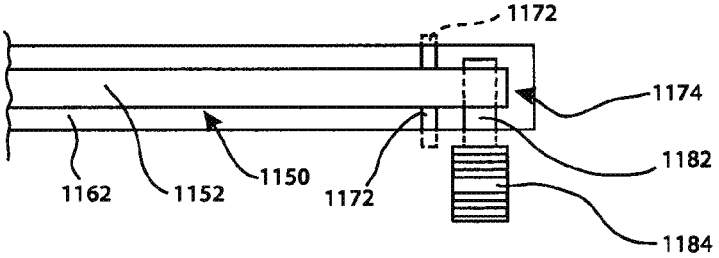
FIG. 62 is a bottom plan view of the spring loaded stop mechanism of FIG. 61 showing the blocking member extending across a recess and restricting the pivoting sighting mechanism from pivoting to a use position.
Figure 63:
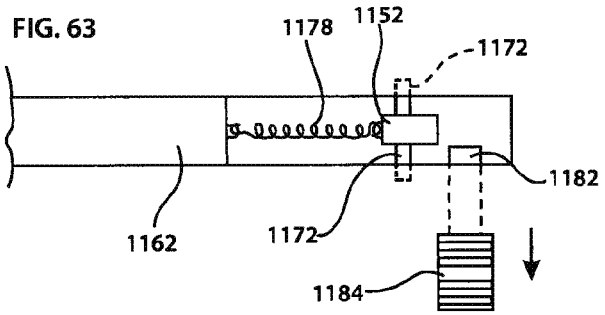
FIG. 63 is a top plan view of the spring loaded stop mechanism of FIG. 61 showing the blocking member withdrawn from the recess and the pivoting sighting mechanism pivoted to the use position by the spring.

Referring now the spring loaded stop mechanism 1170 illustrated in FIGS. 61-64. The spring loaded stop mechanism 1170 will be described within respect to the pivoting sight 1150, however all other pivoting sights described herein could similarly be operated by the mechanism 1170. As shown, the pivoting sight 1150 is received within the recess 1162 of the control panel 1160. The pivoting sight base member 1152 includes outwardly protruding pivot extensions 1172 that extend into adjacent portions of the control panel 1960 so that the pivoting sight 1150 can pivot between the stored and use positions about the extensions 1172. The pivoting sight 1150 also includes a locking portion 1174 on an opposite side of the pivot extensions 1172 of the base member 1152. The locking portion 1174 includes a stop surface 1176 that faces downwardly when the pivoting sight 1150 is in the stored position, as shown in FIG. 61. The spring loaded mechanism 1170 includes a spring 1178 that is secured to the control panel 1160 at one end thereof and to the pivoting sight 1150 adjacent to the pivot extensions 1172 at a protruding portion 1180 thereof. As shown in FIG. 61, the spring 1178 is extended to a stretched configuration between the control panel 1160 and the pivoting sight protruding portion 1180 when the pivoting sight 1150 is in the stored position. In order to stop the spring 1178 from compressing and pulling the protruding portion 1180 so that the pivoting sight 1150 is pivoted to the use position, a blocking member 1182 extends across the recess 1162 downwardly of the stop surface 1176 of the pivoting sight 1150. So configured, the stop surface 1176 of the pivoting sight engages the blocking member 1182, which restricts it from pivoting further. The blocking member 1182 is operably connected to or integral with an actuator 1184 accessible on the control 1160 adjacent to the recess 1162.

Alternatively as shown in FIG. 60, a blocking member 1185 can be positioned intermediately along the sight base member 1152. In this form, the blocking member 1185 extends over the base member 1152 to hold the base member 1152 within the recess 1162. When a user desires to use the sight 1150, the user can shift the blocking member 1185 laterally to uncover the base member 1152 thereby allowing the spring 1178 to pivot the sight 1150 to its use position.

Figure 64:
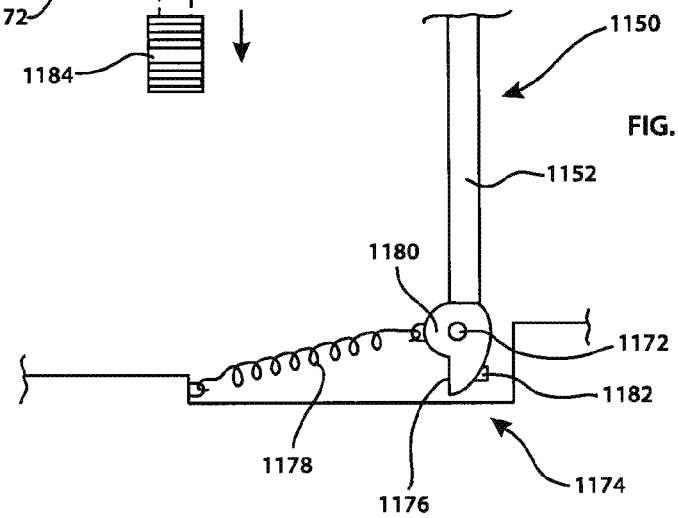
FIG. 64 is a cross-sectional side view of the spring loaded stop mechanism of FIG. 61 showing the pivoting sighting mechanism pivoted to the use position by the bias force provided by the spring.

So configured, the pivoting sight 1150 can be stored within the recess 1162 in a spring-loaded configuration that is prevented from pivoting by the blocking member 1182. Then when use of the pivoting sight 1150 is desired, a user of the hat can slide the actuator 1184 away from the recess 1162 which slides the blocking member 1182 out of engagement with the stop surface 1176 of the pivoting sight 1150. When the blocking member 1182 is removed from engagement with the pivoting sight 1150, the spring 1178 compresses toward its rest condition, which draws the protruding portion 1180 from a generally downward orientation as shown in FIG. 61 to an outward orientation as shown in FIG. 64. The outward orientation of the protruding portion 1180 corresponds to the frame 1158 being in the use position for use by a user of the hat to frame a desired target of the camera device 902. The spring loaded mechanism allows a user to quickly and easily flip out the pivoting sight to take a picture or video, such as during recreational activities such as fishing and hunting. Then, when the pivoting sight is no longer needed, a user of the hat can pivot the sight 1150 back to the stored position and the blocking member 1182 can be restored to its engagement with the stop surface 1176, such as manually or by a spring bias.

Figure 65:
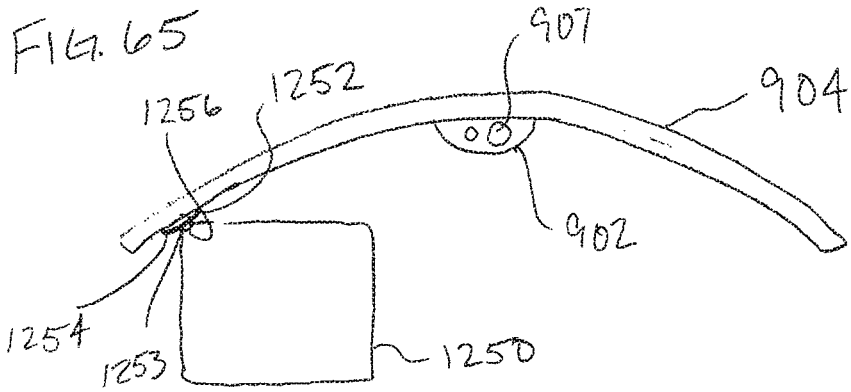
FIG. 65 is a front elevational view of a hat with a universally pivoting display for a camera device mounted thereto showing the display in a use position.
Figure 66:
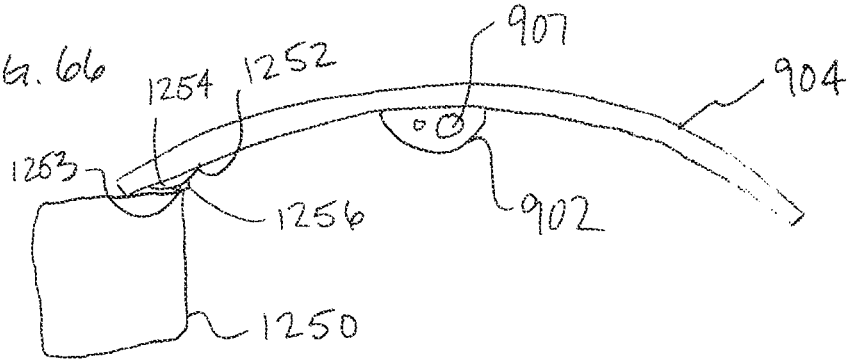
FIG. 66 is a front elevational view of the hat of FIG. 65 showing the camera device display pivoted outwardly to a location generally alongside a brim portion of the hat.
Figure 67:
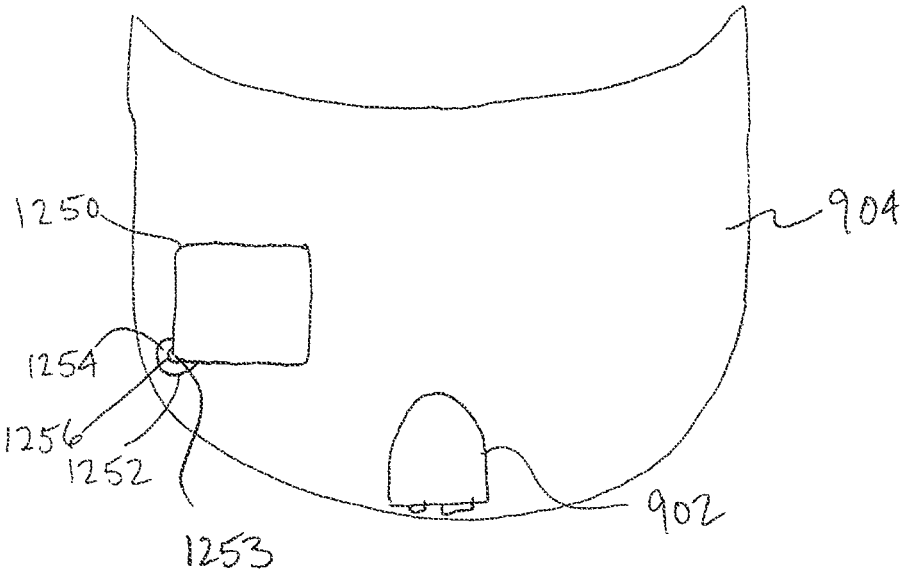
FIG. 67 is a bottom plan view of the hat of FIG. 65 showing the camera device display pivoted to a storage position adjacent to an under surface of the brim portion of the hat.
Figure 70B:
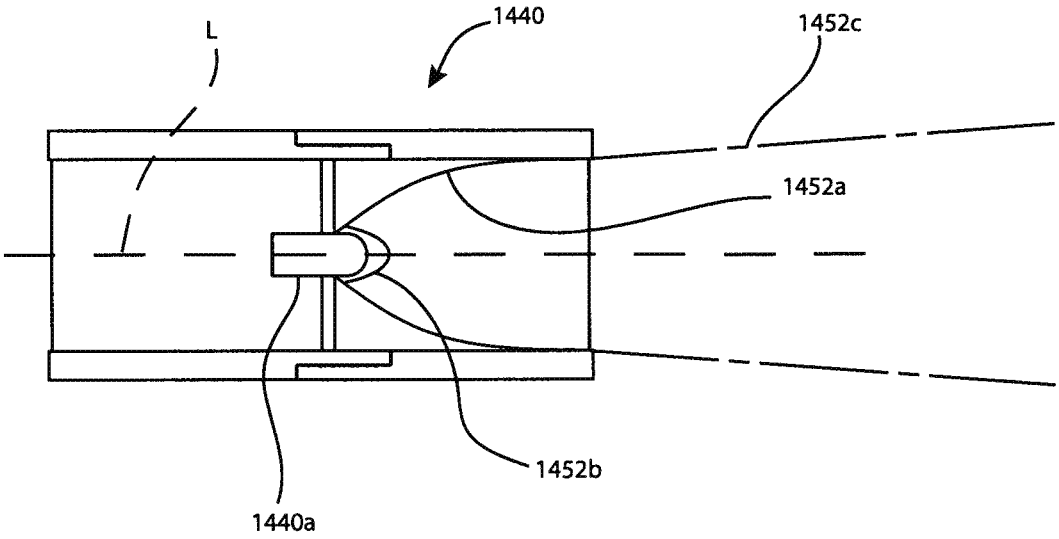
FIG. 70B is a side cross-sectional view showing a parabolic reflector of the upper light device.

As shown in FIGS. 65-67, any of the camera devices described above can include a universally pivoting display 1250 attached to the brim 904 to display images shown through the camera lens or captured thereby. The display 1250 couples to the brim 904 through a universal pivot joint 1252. The universal pivot joint 1252 includes a base 1254 coupled to the brim 904 with the base 1254 having a socket 1253 for receiving a ball 1256 mounted to a corner 1258 of the display 1250. So configured, the ball 1256 and socket 1253 form the universal pivot joint 1252, and the display 1250 coupled thereto is allowed to freely pivot within the base 1254. The universal pivot joint 1252 preferably provides a sufficient friction between the ball 1256 and socket 1253 so that when the display 1250 is pivoted to a desired location, it will remain stationary and not pivot due to gravity or as a result of a user moving his head or the like. If desired, the universal pivot 1252 can include preferred pivoting pathways formed by rails and guide tracks on the ball 1256 and socket 1253 so that when a user pivots the display 1250, the pathways allow for easier pivoting to desired locations, such as a use location (FIG. 65), a temporary location pivoted out of view of a user outwardly of the brim 904 (FIG. 66), or a stored location pivoted to a position adjacent to the brim 904 (FIG. 67).

The various camera devices described herein can further include connection and streaming functionalities utilizing a transmitter or transceiver. As set forth herein, the camera devices can connect to other devices using communication networks, such as Bluetooth, Internet, 3G, 4G, near field communication, etc. This connection can further be utilized in conjunction with a software application configured to be operated on a communication device, such as a smart phone, tablet, computer, or the like. The software application can be downloaded from a website, which can be operated by a third party, and installed on the communication device. As such, a user of the communication device can communicate with the camera device mounted to the headgear. The application software can receive media captured by the camera device, such as video, photos, and audio. The retrieved media can then be stored on the communication device, transmitted to a third party using known methods, uploaded to a website or server, such as Facebook, YouTube, Twitter, etc. Moreover, the software application can display a live feed from the camera device, and can further transmit a live stream to a website.

Referring now to FIGS. 68-82, another exemplary form of lighted headgear 1400 is illustrated having a crown portion 1402 and a brim portion 1404. The headgear includes a lower light source 1406, preferably an LED, mounted to a lower surface 1408 of the brim portion 1404, and an upper light source 1410, preferably an LED, mounted to an upper surface 1412 of the brim 1404. The brim 104 may include a brim insert portion 1405. The lower light source 1406 can be mounted to the lower surface 1408 via a light holder 1414. The brim lower surface 1408 may also include a brim lower covering material 1415 that extends across the brim insert 1405. The light holder 1414 and lower light source 1406 can be one of the various light holder embodiments previously described for mounting one or more light sources to a lower surface of a brim including both internal and external mounting configurations previously described herein. In one form, the upper light source 1410 is a three Watt LED having approximately 80-100 lumens and the lower light source 1406 is one or more 10,000 MCD LEDs; however, other energy level LEDs could also be used.

Turning now to the upper light source 1410, a hinge base 1420 is mounted to the brim upper surface 1412. The hinge base 1420 includes a generally flat base portion 1422 and a pair of hinge mounts 1424 extending from an upper surface 1426 of the hinge base 1422. The hinge mounts 1424 include holes 1428 therethrough with a central hinge axis H running therebetween. The generally flat base portion 1422 includes a fore-and-aft axis P that is generally perpendicular to the hinge axis H. The brim portion 1404 can include upper surface covering material 1430 extending over the brim insert 1405, and the base portion 1422 can be mounted externally to the upper surface covering material 1430. Alternatively, the hinge base 1420 can be mounted directly to the brim portion 1404, with the covering material 1430 having an opening 1432 for the hinge mounts 1424 to extend therethrough. Moreover, the hinge base 1420 can be mounted to the brim portion 1404 according to the previously described mounting methods for the other light holder embodiments described herein, such as with adhesive, sewing, Velcro, ultrasonic welding, mechanical connections, or the like.

The upper light source 1410 is mounted to the brim upper surface 1412 via a hinge connection. The upper light source 1410 is received within a light holder 1438 in the form of a "headlight style" light housing assembly 1440. The housing assembly 1440 has a generally elongate shape and includes a light housing member 1442 with a depending hinge portion 1444 that is preferably integral with the housing member 1442. The depending hinge portion includes a hole 1445 therethrough for connecting to the hinge base 1420. The housing member 1442 includes the upper light source 1410 mounted therein. The housing member 1442 includes electrical connections 1446 extending therefrom. The housing member 1442 preferably includes external threading for connecting a cover member 1450 thereto. The cover member 1450 includes corresponding internal threading for connecting to the housing member 1442. The cover member 1450 further includes a cone shaped light focusing and enhancing member 1452 having a generally parabolic shape. The cover member 1450 includes a transparent window or lens 1454 for the beam of light to project therethrough.

The housing assembly 1440 has a central axis L along which the upper light source 1410 is oriented. The upper light source 1440, in the form of an LED, is configured to project a beam of light therefrom along the axis L. Thus, as the housing assembly axis L is pivoted about the hinge axis H, the direction of the beam of light from the upper light source 1410 can be adjusted. The upper light source 1410 is mounted within the housing assembly 1440 inward of a forward end 1450*a* so that the beam of light is received by the enhancing member 1452. The light beam will intersect the enhancing member 1452 for being reflected therein to provide for an enhanced and directed beam of illumination along the axis L. In one form, the enhancing member 1452 is in the form of a parabolic reflector 1452*a* that receives an LED 1440*a* within a cone or lens portion 1452*b* of the parabolic reflector 1452*a*. The resulting beam of light 1452*c* is in the form of a spot beam configured to illuminate far away distances such as greater than 50 feet. Of course, closer distances are illuminated as well. In one form, the LED 1440 is coupled to a heatsink (not shown) for dissipated heat therefrom.

The light housing assembly 1440 is pivotably mounted to the hinge base 1420 to create the hinge connection. A cylindrical hinge member 1456 extends through the hole of the depending hinge portion 1444 and is secured at each end to the hinge mounts 1424 of the hinge base 1420. The hinge portion 1444 is frictionally mounted to the hinge mounts 1424, so the light housing assembly 1440 with the upper light source 1410 therein can be pivoted about the hinge axis H and held in place by the friction of the hinge connection. Therefore, the hinge connection allows the light housing assembly 1440 to be manually adjusted for projecting light upwardly from the brim portion 1404, forwardly from the brim portion 1404, or even downwardly from the brim portion 1404. When adjusted to the project light downwardly, the brim 1404 can block a portion of the beam of light to shield the user's eyes while providing illumination to areas forwardly and downwardly from the user. In one form, when the light housing assembly 1440 is angled downwardly such that it contacts the brim 1404, the angle of inclination Z between a fore-and-aft brim axis B and a central axis L of the light housing assembly 1420 is about 12.5 degrees; however other angles of inclination could also be used. The friction between the hinge base 1420 and the hinge portion 1444 allows the positioning of the light housing assembly 1440 to remain relatively stationary until further adjustment by the user.

In another form, the hinge portion 1444 could extend from the hinge base 1420 with the hinge mounts 1424 depending from the light housing assembly 1440 to create the hinge connection. In another form, the hinge connection could be in the form of a ball-and-socket connection between the hinge base 1420 and the light housing assembly 1440 so that the light housing assembly can be rotationally adjusted in addition to being pivotably adjusted.

Figure 77:
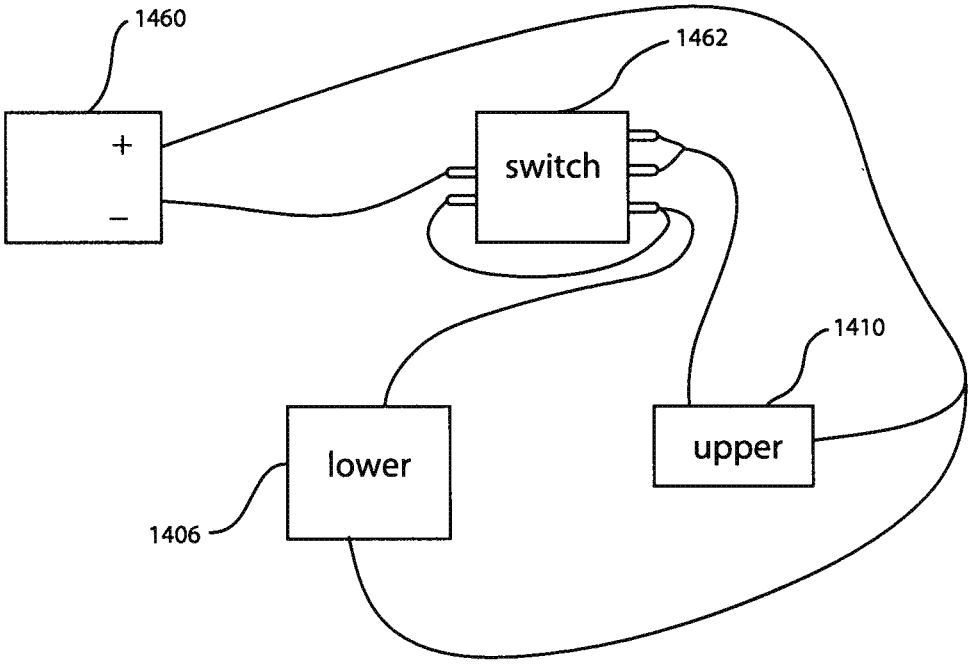
FIG. 77 is a schematic view of the electrical connections of FIGS. 75 and 76.
Figure 78:
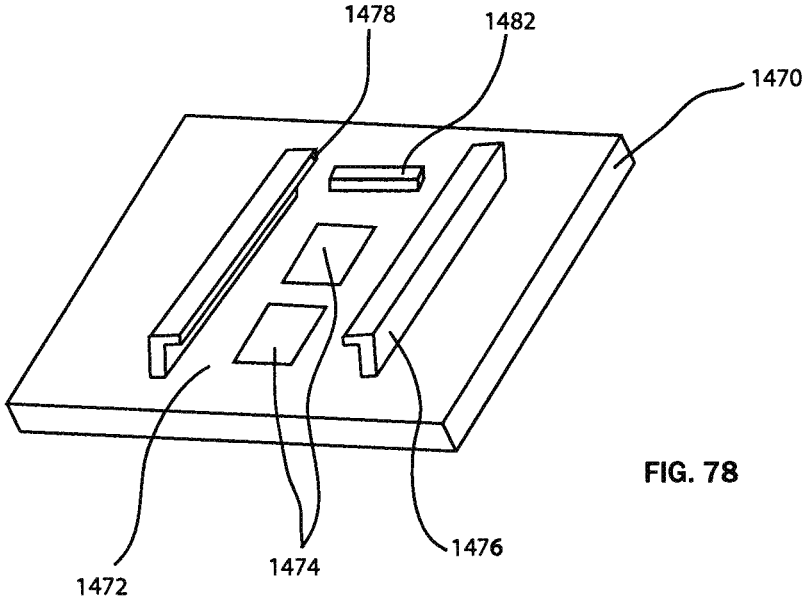
FIG. 78 is a perspective view of a hinge base receptor for mounting an alternative embodiment of the upper light device of FIG. 68.
Figure 79:
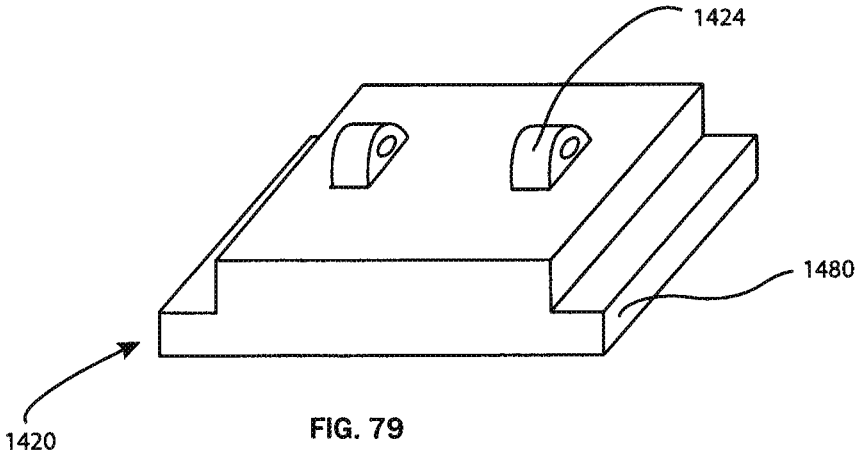
FIG. 79 is a top perspective view of an alternative hinge base configured for mounting to the hinge base receptor of FIG. 78.
Figure 80:
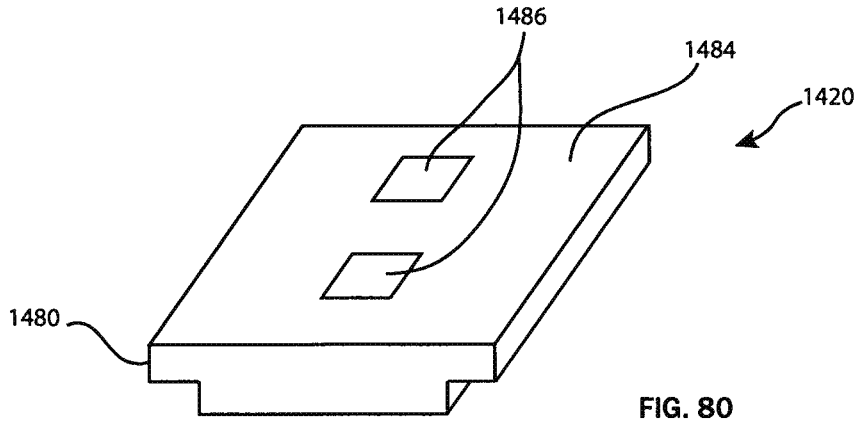
FIG. 80 is a bottom perspective view of the alternative hinge base of FIG. 79.
Figure 81:
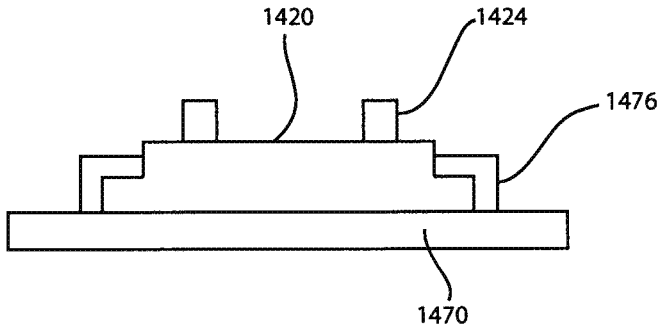
FIG. 81 is a front cross-sectional view showing the connection between the alternative hinge base and the hinge base receptor.
Figure 82:
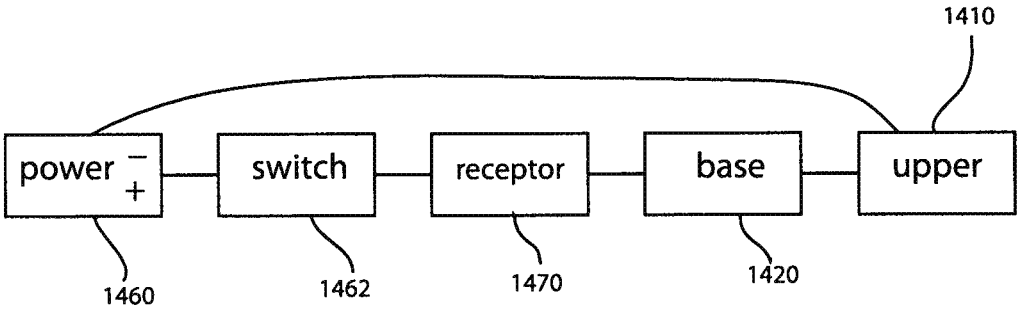
FIG. 82 is a schematic view of electrical connections between the hinge base receptor and the hinge base for connecting the upper light device to the switch device and power source of the hat.

As shown in FIGS. 75-77, the light housing assembly 1440 and the lower light source 1406 mounted to the brim lower surface 1408 are electrically connected to a power source 1460 and a switch device 1462 mounted to the hat 1400. The power source 1460 can be mounted to the crown portion 1402. The switch device 1462 can be mounted to the brim portion 1404. The electrical connectors 1446 of the light housing assembly 1440 can extend through a hole 1447 in the brim 1440 to connect with electrical wiring 1449 for connecting the power source 1460, the switch device 1462, the light housing assembly 1440 having the upper light source 1408, and the lower light source 1406. The electrical wiring 1449 is preferably sandwiched between the brim lower covering material 1415 and the brim insert 1405. A schematic of the electrical connection of the upper light source 1408, the lower light source 1406, the power source 1460, and the switch device 1462 is illustrated in FIG. 77; however other electrical connections could also be used.

In another form, and with reference to FIGS. 78-82, the light housing assembly 1440 and hinge base 1420 can be removably mounted to the brim upper surface 1412 via a sliding connection. A hinge base receptor 1470 is mounted to the brim upper surface 1412 via adhesive, fasteners, or other known connection methods. The hinge base receptor 1470 includes a generally flat surface or floor portion 1472 having electrical connections 1474 thereon. The hinge base receptor 1470 also includes a pair of wall portions 1476 with inward facing cantilevered edges 1478. The light housing assembly 1440 is configured similar to the above description, with a depending hinge portion 1444 pivotably mounted to the hinge mounts 1424 of the hinge base 1420. In this configuration, the hinge base 1420 is mounted to the hinge base receptor 1470 rather than to the brim upper surface 1412. The hinge base 1420 includes a mounting flange 1480 that corresponds to the shape of the wall portions 1476 of the hinge base receptor 1470 so the hinge base 1420 can be slidably received within the wall portions 1476. The hinge base receptor 1470 will frictionally receive and hold the hinge base 1420 therein. The hinge base receptor 1470 can further include a stopwall portion 1482 to ensure the hinge base 1420 is properly received within the hinge base receptor 1470.

The hinge base 1420 further includes a lower surface 1484 having electrical connections 1486 thereon that correspond to the electrical connections 1474 of the floor portion 1472. The hinge base 1420 is received within the hinge base receptor 1470 to create the sliding connection therebetween that aligns the electrical connections 1486 and 1474 completing an electrical connection therebetween. The light housing assembly 1440 is electrically connected to the hinge base 1420 via a wiring harness or the like. The hinge base receptor 1470 is electrically connected to the power source 1460 and the switch 1462 via electrical wiring 1490. Thus, the upper light housing assembly 1440 can be electrically connected to the power source 1460 and switch 1462 through the sliding connection between the hinge base 1420 and the hinge base receptor 1470 for providing power and actuating the operation of the upper light source 1410, as illustrated schematically in FIG. 82. In another form, the hinge base 1420 and hinge base receptor 1470 can be free of electrical contacts, with the second light source 1410 being electrically connected to the power source 1460 and switch 1462 via an auxiliary connection.

Although the above upper light source or headlamp 1410 is disclosed as operating in conjunction with the lower light source 1406, the headlamp 1410 can equally be utilized in conjunction with any of the camera devices described herein. For example, the various switch devices described herein can be electrically coupled to the headlamp 1410 as well as the camera devices so that activation of the camera device also activates the headlamp. Alternatively, the headlamp 1410 can have a separate switch device, so that a user of the camera devices can selectively energize the headlamp 1410, such as at night or in low light areas.

Those skilled in the art will recognize that a wide variety of modifications, alterations, and combinations can be made with respect to the above described embodiments without departing from the spirit and scope of the invention, and that such modifications, alterations, and combinations, are to be viewed as being within the scope of the invention.

The invention claimed is:

1. Headgear comprising:

a head-fitting portion configured to be received on a wearer's head;

a brim portion extending forwardly from a lower edge portion of the head-fitting portion, the brim portion having upper and lower surfaces and an outboard edge extending therebetween;

a camera device pivotably mounted to the brim portion adjacent to the lower surface thereof;

a detent mechanism for releasably mounting the camera device to the brim portion;

a first portion of the detent mechanism of the camera device;

a second portion of the detent mechanism of the brim portion; and wherein the camera device is pivotable between a use position hanging generally down from the brim portion with the first and second detent portions disconnected from each other and a stored position extending generally along the brim portion with the first and second detent portions of the detent mechanism releasably connected together to hold the camera device in the stored position.

2. The headgear of claim 1 wherein the first portion comprises a catch mechanism that is selectively movable relative to a housing of the camera device and the second portion comprises a hook member configured to cooperate with the catch mechanism.

3. Headgear comprising:

a head-fitting portion configured to be received on a wearer's head;

a brim portion extending forwardly from a lower edge portion of the head-fitting portion, the brim portion having upper and lower surfaces and an outboard edge extending therebetween;

a camera lens device mounted to the brim portion to capture media generally forwardly thereof;

a viewfinder mounted to the brim portion so that a wearer can see the view of the camera lens device;

a control panel mounted to the brim portion and coupled to the camera lens device to control operation thereof;

a power source housing mounted to the head-fitting portion and configured to receive a power source therein to be electrically coupled to the camera lens device, the viewfinder, and the control panel to provide power thereto.

4. The headgear of claim 3 wherein the head-fitting portion includes an adjustable strap on a rear portion thereof; and the power source housing is mounted to the adjustable strap.

5. The headgear of claim 3 wherein the power source housing is further includes a storage device disposed therein, the storage device configured to store media captured by the camera lens.

6. The headgear of claim 3 wherein the power source housing further includes a port therein configured to receive a plug therein.

7. The headgear of claim 3 wherein the viewfinder is pivotably mounted to the brim portion and configured to be pivoted between a stored position extending generally along the brim portion and a use position extending generally transverse to the brim portion.

8. Headgear comprising:

a head-fitting portion configured to be received on a wearer's head;

a brim portion extending forwardly from a lower edge portion of the head-fitting portion, the brim portion having upper and lower surfaces and an outboard edge extending therebetween;

an electronic device having a plurality of components mounted to predetermined mounting areas of the brim portion having a predetermined thickness thereof;

one or more reduced thickness portions of the brim portion spaced from the predetermined mounting areas and being thinner than the mounting areas for reducing weight of the brim portion.

9. The headgear of claim 8 wherein the brim portion includes a brim insert and upper and lower fabric coverings extending over top and bottom surfaces of the brim insert; and the brim insert includes the reduced thickness portions.

10. Headgear comprising:

a head-fitting portion configured to be received on a wearer's head;

a brim portion extending forwardly from a lower edge portion of the head-fitting portion, the brim portion having upper and lower surfaces and an outboard edge extending therebetween;

a one-piece housing mounted to the brim portion; and a camera device including a lens, a control panel, and a storage device disposed within the housing to mount the camera device to the brim portion.

11. The headgear of claim 10 wherein the one-piece housing is of a heat dissipating material.

12. The headgear of claim 10 wherein the one-piece housing is of a material configured to block radio transmissions.

13. Headgear comprising:

a head-fitting portion configured to be received on a wearer's head;

a brim portion extending forwardly along a fore-and-aft axis from a lower edge portion of the head-fitting portion, the brim portion having upper and lower surfaces and an outboard edge extending therebetween;

a camera device mounted to the brim portion and configured to capture media forwardly thereof within a camera sighting area;

a pair of depending post members mounted directly to the brim portion extending generally transverse to the fore-and-aft axis thereof, the post members spaced laterally from one another and from the lower edge portion of the head-fitting portion to provide a frame of reference of the camera sighting area to a wearer.

14. Headgear comprising:

a head-fitting portion configured to be received on a wearer's head;

a brim portion extending forwardly along a fore-and-aft axis from a lower edge portion of the head-fitting portion, the brim portion having upper and lower surfaces and an outboard edge extending therebetween;

a camera device mounted to the brim portion and configured to capture media forwardly thereof within a camera sighting area;

a camera sighting arm pivotably mounted to the brim portion to be movable between a stored position extending along the brim portion and a use position extending generally transverse to the brim portion;

a tube shaped portion of the camera sighting arm disposed at a distal end thereof opposite of the brim portion, the tube-shaped portion configured to align forwardly of an eye of a wearer and provide a frame of reference of the camera sighting area therethrough to a wearer.

15. Headgear comprising:

a head-fitting portion configured to be received on a wearer's head;

a brim portion extending forwardly along a fore-and-aft axis from a lower edge portion of the head-fitting portion, the brim portion having upper and lower surfaces and an outboard edge extending therebetween;

a camera device mounted to the brim portion and configured to capture media forwardly thereof within a camera sighting area;

a camera sighting arm pivotably mounted to the brim portion to be movable between a stored position extending along the brim portion and a use position extending generally transverse to the brim portion;

a locking mechanism having a first position extending underneath the camera sighting arm to lock the camera sighting arm in the stored position and a second position allowing the camera sighting arm to pivot to the use position.

16. Headgear comprising:

a head-fitting portion configured to be received on a wearer's head;

a brim portion extending forwardly along a fore-and-aft axis from a lower edge portion of the head-fitting portion, the brim portion having upper and lower surfaces and an outboard edge extending therebetween;

a camera device mounted to the brim portion and configured to capture media generally forwardly thereof within a camera sighting area;

a viewfinder of the camera device mounted to the brim portion via a universal connection.

17. The headgear of claim 16 wherein the universal connection includes a base socket portion of the brim portion and a ball portion of the viewfinder configured to be disposed within the base socket portion.

18. The headgear of claim 17 wherein the ball portion is provided on a corner of the viewfinder.

19. The headgear of claim 17 wherein base socket and ball portions include mating guide and rail portions allowing the viewfinder to be moved between predetermined positions.

20. The headgear of claim 17 wherein the base socket and ball portions are configured so that frictional engagement will hold the viewfinder in a desired position.

21. The headgear of claim 16 wherein the universal connection allows a wearer to move the viewfinder between a use position hanging generally down from the brim portion, a stored position extending generally along the brim portion, and an out of view position extending laterally outwardly from the brim portion.

* * * * *